US012318022B2

(12) United States Patent
McSmith et al.

(10) Patent No.: US 12,318,022 B2
(45) Date of Patent: Jun. 3, 2025

(54) FLAT-PACK LIQUID DISPENSING STATION

(71) Applicant: ALL POINTS MEDIA, LLC, Beaverton, OR (US)

(72) Inventors: Kyle McSmith, Salem, OR (US); Andrew Martin Gough, Beaverton, OR (US); Brian Hexum, Portland, OR (US); Darrell McSmith, Tigard, OR (US); Makenzi McSmith, Portland, OR (US)

(73) Assignee: ALL POINTS MEDIA, LLC, Beaverton, OR (US)

( * ) Notice: Subject to any disclaimer, the term of this patent is extended or adjusted under 35 U.S.C. 154(b) by 304 days.

(21) Appl. No.: 17/396,547

(22) Filed: Aug. 6, 2021

(65) Prior Publication Data

US 2022/0039551 A1 Feb. 10, 2022

Related U.S. Application Data

(60) Provisional application No. 63/062,364, filed on Aug. 6, 2020.

(51) Int. Cl.

| | |
|---|---|
| ***A47F 3/14*** | (2006.01) |
| ***A47F 5/11*** | (2006.01) |
| ***A47F 5/16*** | (2006.01) |
| ***A47K 5/12*** | (2006.01) |

(52) U.S. Cl.

CPC ..... *A47F 3/142* (2013.01); *A47F 5/11* (2013.01); *A47F 5/16* (2013.01); *A47K 5/1202* (2013.01); *A47K 5/1205* (2013.01); *A47K 2005/1218* (2013.01)

(58) Field of Classification Search

CPC .... A47F 3/142; A47F 5/11; A47F 5/16; A47F 5/101; A47F 5/118; A47K 5/1202; A47K 5/1205; A47K 2005/1218; A47B 47/0075; B65D 11/1866; B65D 11/1873; B65D 5/52; B65D 5/5206; B65D 5/5213

USPC ..... 222/179, 92, 95, 105, 106, 107, 185.1; 248/127, 150, 151, 152, 174; 40/538, 40/539, 610; 220/4.28, 4.29, 4.31; 229/120.34, 104

See application file for complete search history.

(56) References Cited

U.S. PATENT DOCUMENTS 1,811,074 A * 6/1931 Butler ..... B65D 5/008 229/131.1
2,265,664 A * 12/1941 Markert ..... B65D 5/5061 206/418
2,411,015 A * 11/1946 Wolff ..... B65F 1/02 292/307 R
2,436,030 A * 2/1948 Abbott ..... A47K 5/1205 222/478
2,922,552 A * 1/1960 Berger ..... A47F 1/08 D6/672

(Continued)

*Primary Examiner* — Christopher Garft
*Assistant Examiner* — Michael McDuffie
(74) *Attorney, Agent, or Firm* — Davis Wright Tremaine LLP

(57) ABSTRACT

A flat-pack liquid dispensing station comprised of sheet material and configured to store or use a variety of liquid containers including plastic gallon bottles affixed with liquid dispensing hand pumps. The dispensing station may further comprise a shelf with an opening to accommodate the head of a pump and aid in restricting the movement of the liquid container.

11 Claims, 66 Drawing Sheets

(56) References Cited

U.S. PATENT DOCUMENTS

| | | | | | |
|---|---|---|---|---|---|
| 3,147,906 | A * | 9/1964 | Roccaforte | B65D 5/16 | 229/122 |
| 3,233,787 | A * | 2/1966 | Ross | A47K 5/1205 | 222/179 |
| 4,205,818 | A * | 6/1980 | Lawler | G10G 5/00 | 211/85.6 |
| 5,697,505 | A * | 12/1997 | Sprague | A47F 5/114 | 211/13.1 |
| 5,787,621 | A * | 8/1998 | Leksell | G09F 1/065 | 40/607.1 |
| 6,076,707 | A * | 6/2000 | Feldner | B67D 3/0029 | 248/176.1 |
| 6,708,845 | B2 * | 3/2004 | Weng | A47K 10/32 | 222/61 |
| 7,134,230 | B1 * | 11/2006 | Boens | G09F 1/065 | 40/124.07 |
| 7,407,086 | B2 * | 8/2008 | Borio | B65D 19/20 | 229/101 |
| 7,975,879 | B2 * | 7/2011 | Groesbeck | B67D 3/0022 | 220/592.2 |
| 8,776,415 | B2 * | 7/2014 | Kawaguchi | G09F 1/14 | 40/124.07 |
| 9,107,517 | B1 * | 8/2015 | Moss | A47F 5/118 | |
| 9,474,363 | B1 * | 10/2016 | Orsini | A47B 3/06 | |
| 10,021,995 | B2 * | 7/2018 | Volz | A47F 5/118 | |
| 11,224,889 | B1 * | 1/2022 | Cadkin | B05B 11/1052 | |
| 2010/0018966 | A1 * | 1/2010 | Roberts, Sr. | B65D 19/18 | 220/4.31 |
| 2014/0231451 | A1 * | 8/2014 | Hammond | B67D 99/00 | 222/173 |

* cited by examiner

FLAT-PACK LIQUID DISPENSING STATION

CROSS-REFERENCE TO RELATED APPLICATION(S)

This application claims the benefit of U.S. Provisional Patent Application No. 63/062,364 filed Aug. 6, 2020.

BACKGROUND OF THE INVENTION

The present invention is directed to a liquid dispensing station, and more specifically, to a flat-pack liquid dispensing station, which can be easily packed in a flat package, shipped, and assembled by the end user. Such liquid dispensing stations are often freestanding and may be manufactured from sheet material such as corrugated cardboard, non-corrugated fiberboard made of recycled cardboard, or corrugated plastic. The COVID pandemic has increased the demand to implement measures that minimize the spread of COVID and other contagious diseases. Freestanding liquid dispensing stations often dispense liquid hand sanitizer necessary to curb the spread of COVID in all environments including, but not limited to schools, hospitals, outdoor public gatherings, building lobbies, and disaster relief sites. Hence, there is a demand for liquid dispensing stations that are easy to pack, easy to ship, and easy to assemble.

SUMMARY

Therefore, exemplary embodiments of a flat-pack liquid dispensing station are disclosed.

According to an embodiment, A method for creating a flat-pack liquid dispensing station comprises the steps of outlining on a single piece of sheet material one or more shelves, and three or more wall panels. The wall panels are configured to assemble a freestanding station with a footprint no more than 324 square inches in area, and the freestanding station further comprises an interior space with at least three sides if the wall panels were cut or punched out of the sheet material. The shelves and wall panels are configured so that each shelf may be attached to the wall panels and be positioned within the interior of the freestanding station if the shelf and wall panels were cut or punched out of the sheet material. At least one shelf is a container shelf configured to support a container of liquid and be positioned within the interior of the freestanding station at a height suitable for a user to receive by hand a liquid dispensed from the container if the container shelf was cut or punched out of the sheet material.

According to another embodiment, a flat-pack liquid dispensing station comprises one or more shelves made from sheet material; and three or more wall panels made from sheet material. The wall panels are configured to assemble a freestanding station with a footprint no more than 324 square inches in area, and the freestanding station further comprises an interior space with at least three sides. The shelves and wall panels are configured so that each shelf may be attached to the wall panels and be positioned within the interior of the freestanding station, wherein at least one shelf is a container shelf configured to support a container of liquid and be positioned at a height suitable for a user to receive by hand a liquid dispensed from the container. According to yet another embodiment, a flat-pack liquid dispensing station further comprises a pedal made from sheet material; a head of a liquid dispensing pump being positioned atop a container of liquid; and a strap. The container shelf further comprises at least one strap opening, and one of the three or more wall panels further comprises a pedal opening at or near the bottom of that wall panel when part of the assembled freestanding station, the pedal opening configured for receiving the pedal. The pedal is configured to be pivotally inserted into the pedal opening, and the strap is configured to attach to the pedal, pass through the at least one strap opening and interact with the head of a liquid dispensing pump, such that a depression of the pedal causes the pump to dispense liquid.

DETAILED DESCRIPTION

Figure 1A:
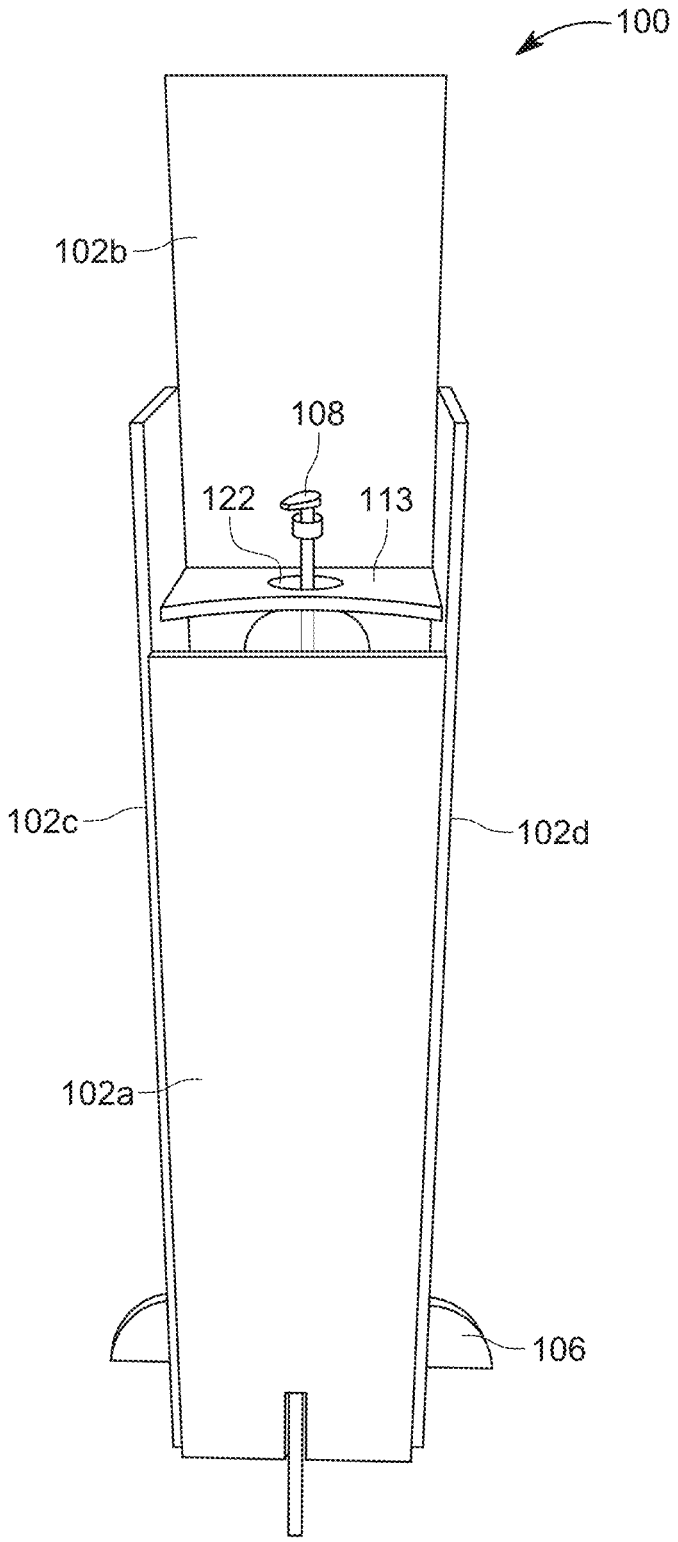
FIG. 1A is a front perspective view of a dispensing station according to an embodiment.

Techniques and systems described below relate to stations (such as hand sanitizers, lotion, or other such stations) that can be cut from a single piece of structural material (e.g., cardboard, corrugated plastic, and other such materials sufficient to support a substance both when not in use and when dispensing (e.g., by activation of a by a user). Such a station can be pre-printed with branding/ad copy, folded and flat-packed for shipment/storage and then assembled/disassembled onsite as needed. Stations in accordance with the present disclosure provide advantages over conventional stations, such as, among other things, being lighter, more compact, less expensive to construct, and less expensive to ship.

Such stations may be referred to by various names such including liquid dispensing stations, dispensing stations, liquid dispensing stands, dispensing stands, hand sanitizer stands, hand sanitizer kiosks and the like.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The following materials illustrate various embodiments of stations and additional information.

Embodiments of an Assembled Dispensing Station

Throughout this specification, reference to a flat-pack liquid dispensing station may also be referred to as a liquid dispensing station, dispensing station, freestanding dispensing station, or station. A flat-pack liquid dispensing station is one that may be packaged in a flat pack. The liquid dispensing station disclosed herein may refer to the station, among other things, as a single component, multiple components, or all of its components; as assembled, disassembled, unassembled; as a design or a tangible object; or some combination thereof.

The following figures showing the exterior of the dispensing station in an embodiment provide an introduction to some aspects of the invention. Turning to FIG. 1A, an example of an assembled flat-pack liquid dispensing station 100 is shown with a front perspective view. The dispensing station comprises wall panels 102, supporting feet 106, a liquid dispensing pump head 108, and a shelf 113. Liquid dispensing pump heads may be referred to in this specification as pump heads, pumps, pump actuators, pump handles and the like. In the embodiment of FIG. 1A, the dispensing station is constructed from corrugated plastic sheets (e.g., Xanita®, Coroplast®, Corex®, corriboard, extruded twinwall plastic-sheet product, corrugated polypropylene resin). In other examples, the dispensing station may be constructed from corrugated fiberboard (e.g. containerboard, fluted corrugated sheet between one or two flat linerboards). In yet other examples, the dispensing station may be constructed from non-corrugated sheet materials (e.g., engineered wood fiberboard, plywood, paperboard, sheet metal, non-corrugated plastic sheets). The invention disclosed, which comprises construction from such materials, provide advantages with regard to numerous factors including: cost and availability of materials, manufacturing cost and time, handling, shipping, assembly, reusability, environmental-friendliness, space, portability, speed of deployment, and flexibility as to the types of liquid containers or bottles used, among other things.

Returning to FIG. 1A, the shelf 113 comprises a pump passthrough opening 122 that allows the pump head to protrude through the shelf. In this embodiment, the pump passthrough opening 122 is positioned along the center line of the shelf. It is envisioned that the pump passthrough opening 122 may be positioned in other areas of the shelf 113 depending on the containers used. The pump passthrough opening 122 may act as a collar to restrict the movement of the pump head or pump neck, and therefore, restrict the movement of the container to keep the pump and container centered within the interior of the dispensing station. The shelf further comprises a crescent shape for its front edge for easier access to the container or bottle of liquid below the shelf 113. This crescent-shaped front edge may aid in changing the bottle, re-centering the bottle, or viewing the amount of liquid left in the bottle. It is contemplated that the liquid may include any type of liquid desired by the public (e.g., liquid hand sanitizer, foaming soap, lotion, water).

Figure 1B:
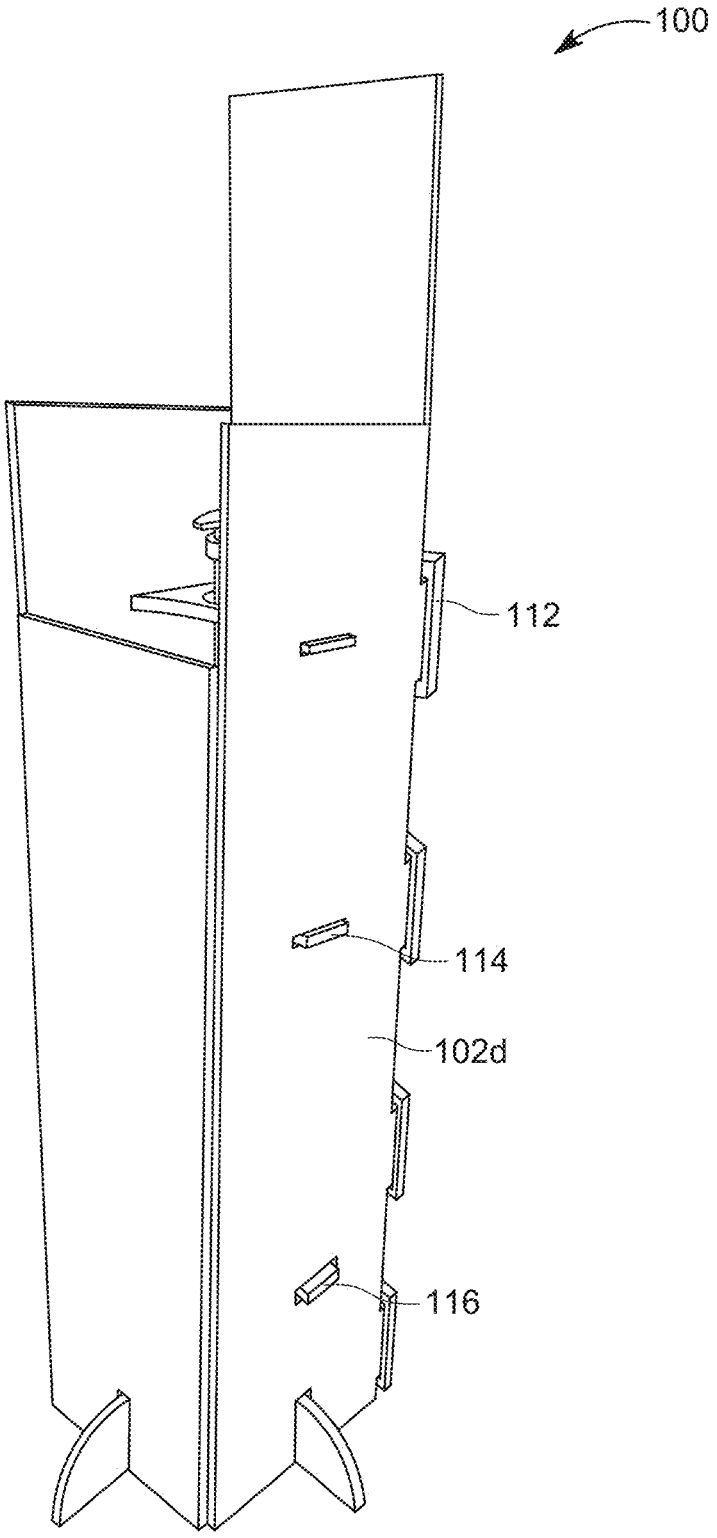
FIG. 1B is a right-front perspective view of a dispensing station according to an embodiment.

FIGS. 1B-1F depict additional perspective views of the dispensing station 100. FIG. 1B shows a right-front perspective view of the dispensing station 100, which brings into view the four wall panel slotted tabs 112 extending past the right side wall panel 102*d*. FIG. 1B also brings into view some shelf tabs 114 protruding through the wall panel shelf slots 116. More detailed discussions of the wall panels 102, supporting feet 106, wall panel slotted tabs 112, shelves 113, shelf tabs 114, and wall panel shelf slots 116 are contained throughout the specification below as various embodiments are discussed.

Figure 1C:
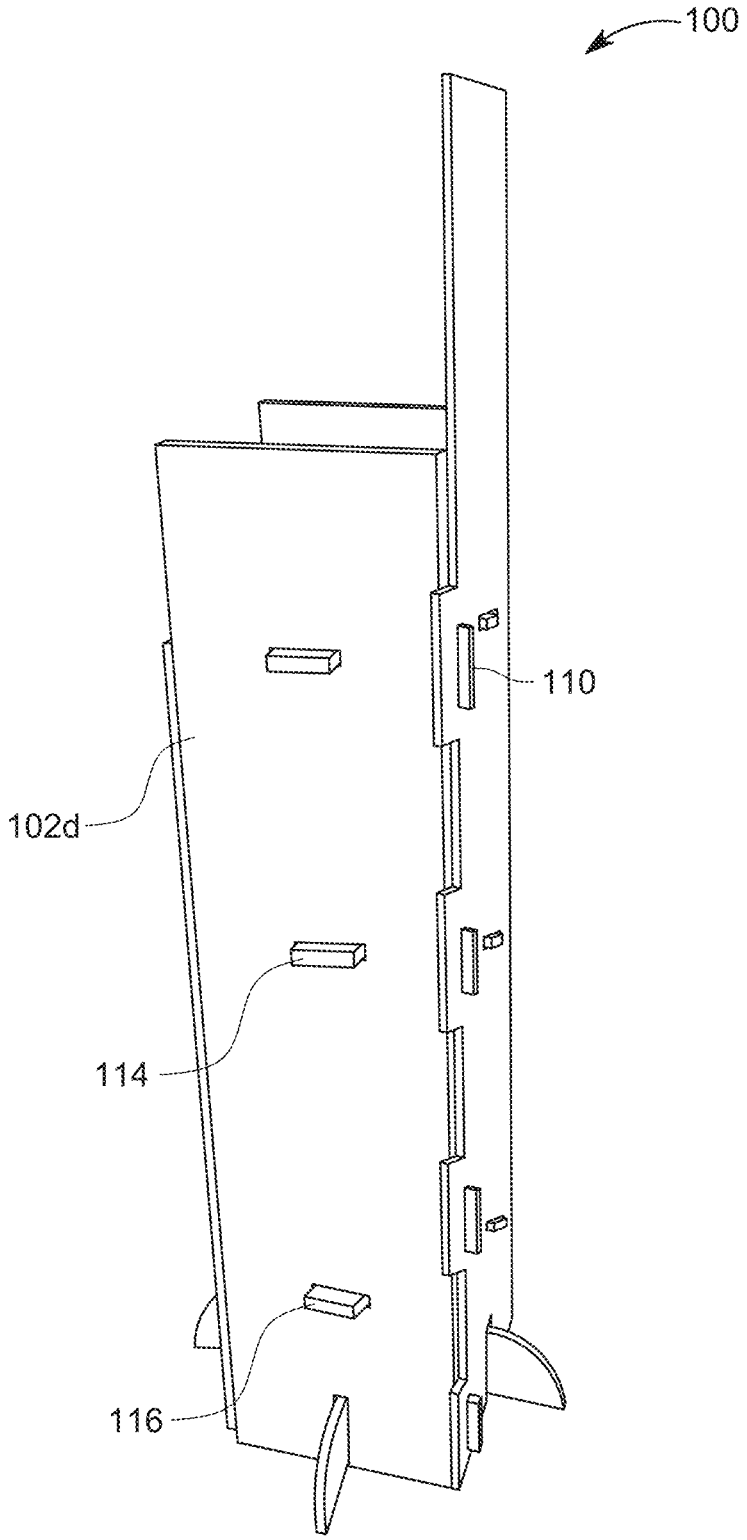
FIG. 1C is a right-rear perspective view of a dispensing station according to an embodiment.

FIG. 1C shows a right-rear perspective view of the dispensing station 100. Depicted in this view are the wall panel tabs 110 of wall panel 102*d*, the right sidewall panel. Additional shelf tabs 114 are seen protruding or inserted through additional wall panel shelf slots 116 of wall panel 102*b*, the rear wall panel. A supporting foot 106*b* is extending out of the bottom of rear wall panel 102*b*.

Figure 1D:
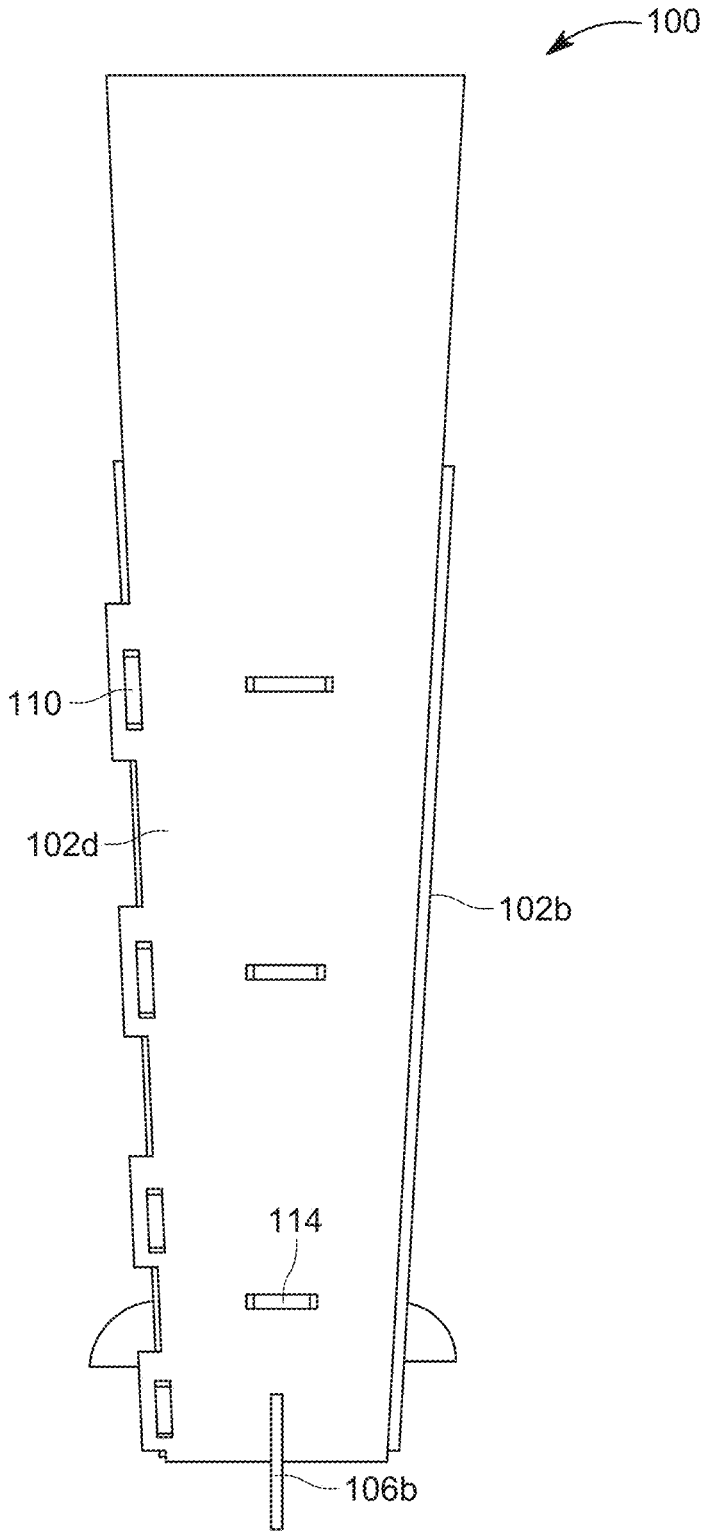
FIG. 1D is a right-side perspective view of a dispensing station according to an embodiment.

FIG. 1D is rear perspective view of the dispensing station 100, again showing rear wall panel 102*b*, the rear supporting foot 106*b*, wall panel tabs 110, wall panel slotted tabs 112, shelf tabs 114, and wall panel shelf slots 116.

Figure 1E:
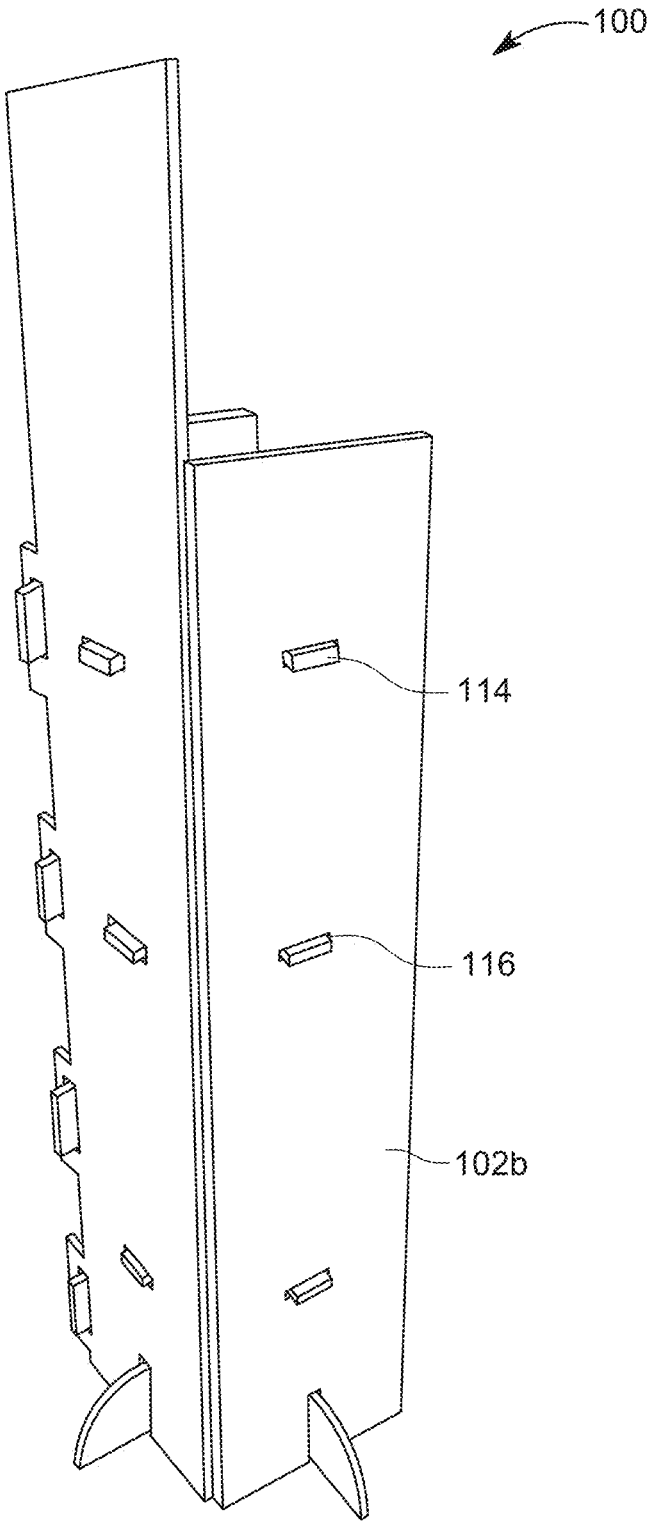
FIG. 1E is a left-rear perspective view of a dispensing station according to an embodiment.

FIG. 1E is a rear left perspective view of the dispensing station 100, revealing additional shelf tabs 114 inserted through the wall panel shelf slots 116 of wall panel 102*c*, the left sidewall panel.

Figure 1F:
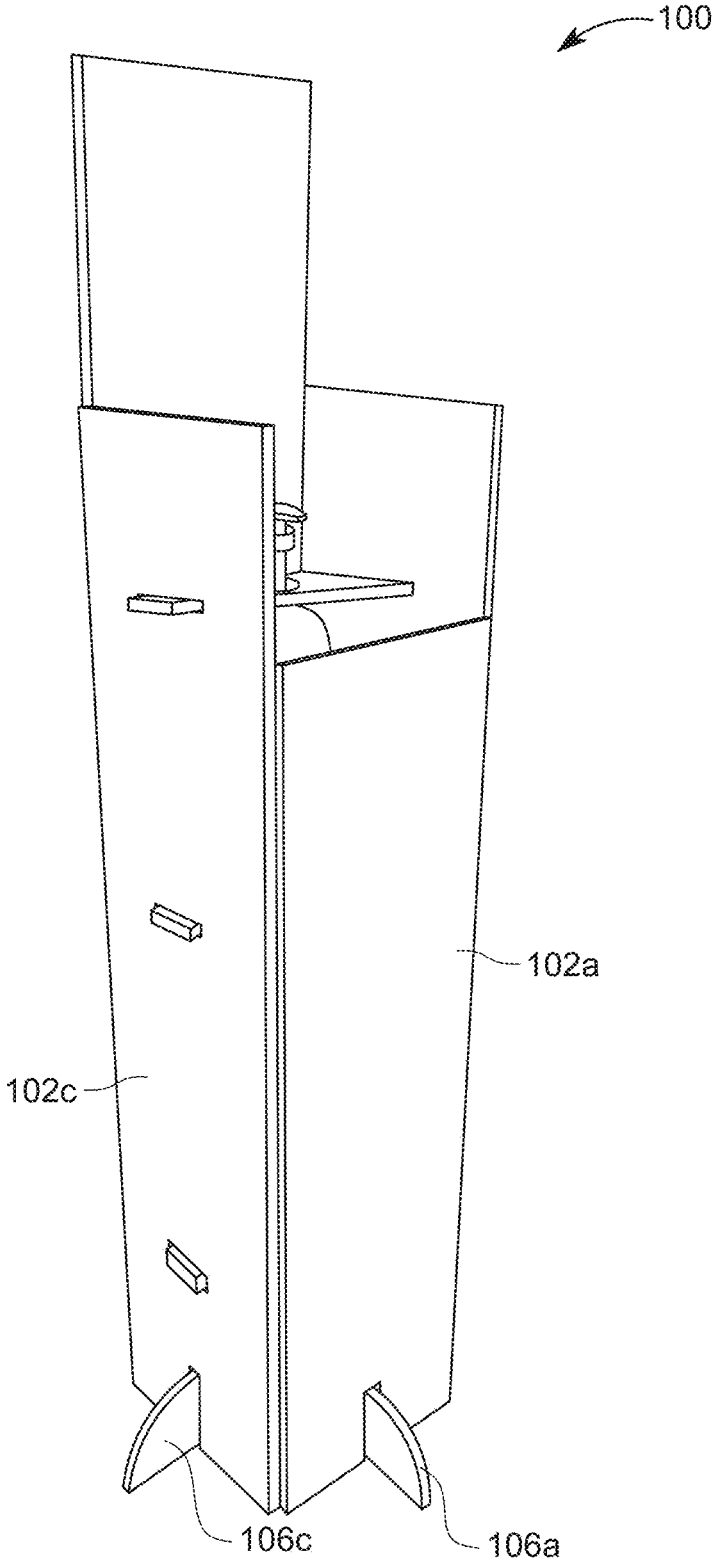
FIG. 1F is a left-front perspective view of a dispensing station according to an embodiment.

FIG. 1F depicts a left front perspective view of the dispensing station 100, which shows the front wall panel 102*a*, left wall panel 102*c*, a supporting foot 106*a* in the bottom front side, a supporting foot on the left 106*c* in the bottom left side.

Deconstructing an Embodiment of a Dispensing Station

The following figures depict the process of deconstructing an embodiment of an dispensing station. The process can be reversed to assemble a dispensing station.

Figure 2A:
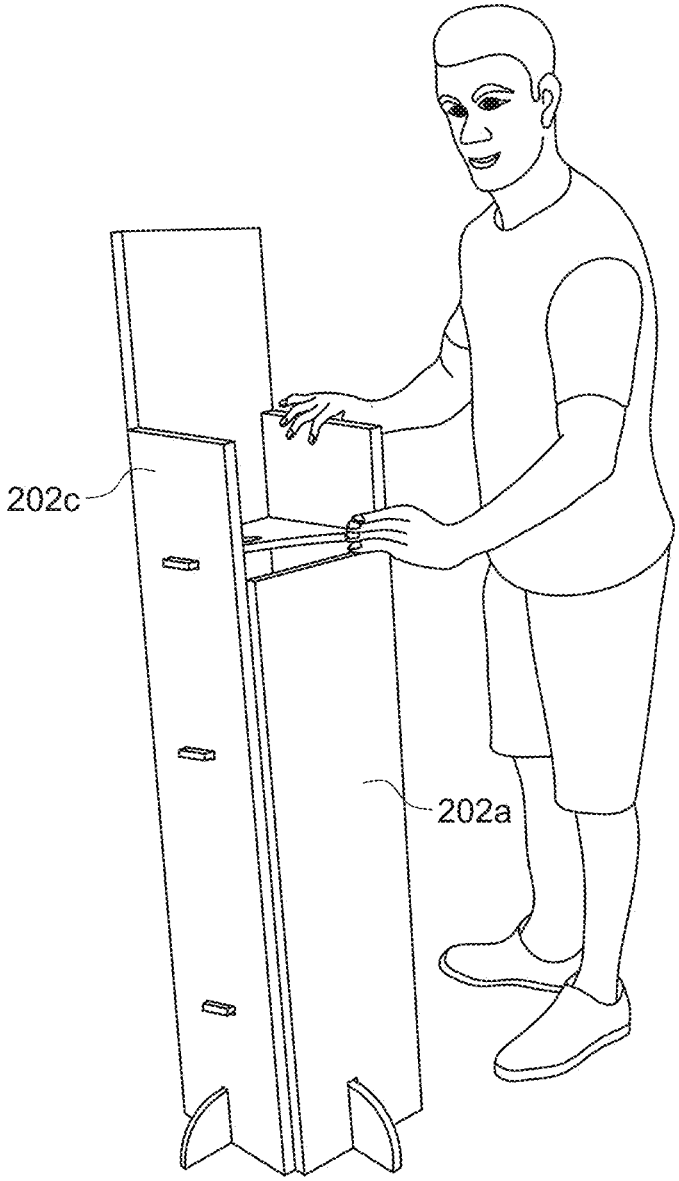
FIG. 2A depicts a dispensing station in the process of being disassembled according to an embodiment.
Figure 2B:
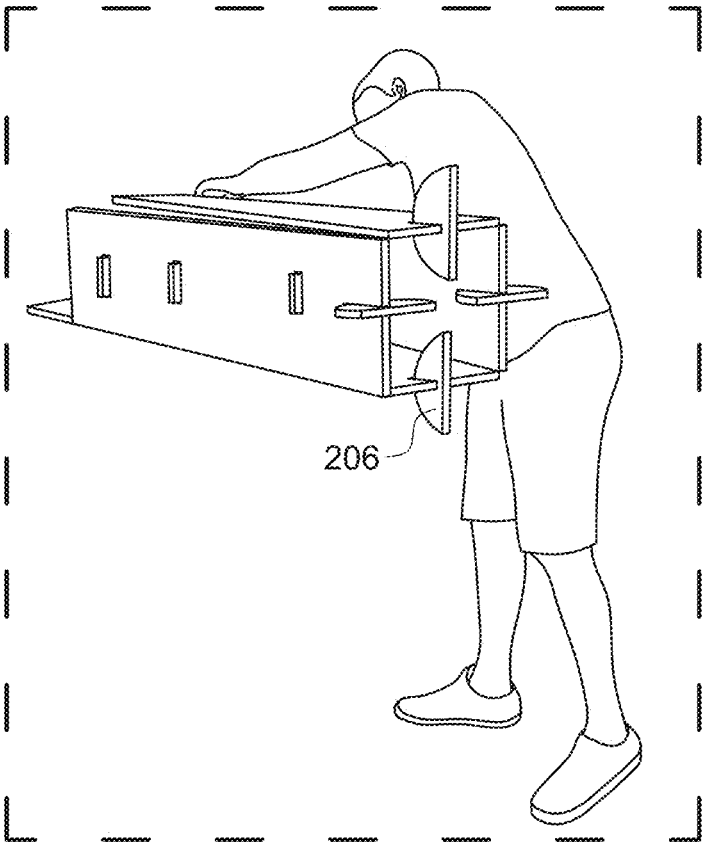
FIG. 2B depicts a dispensing station in the process of being disassembled according to an embodiment.
Figure 2C:
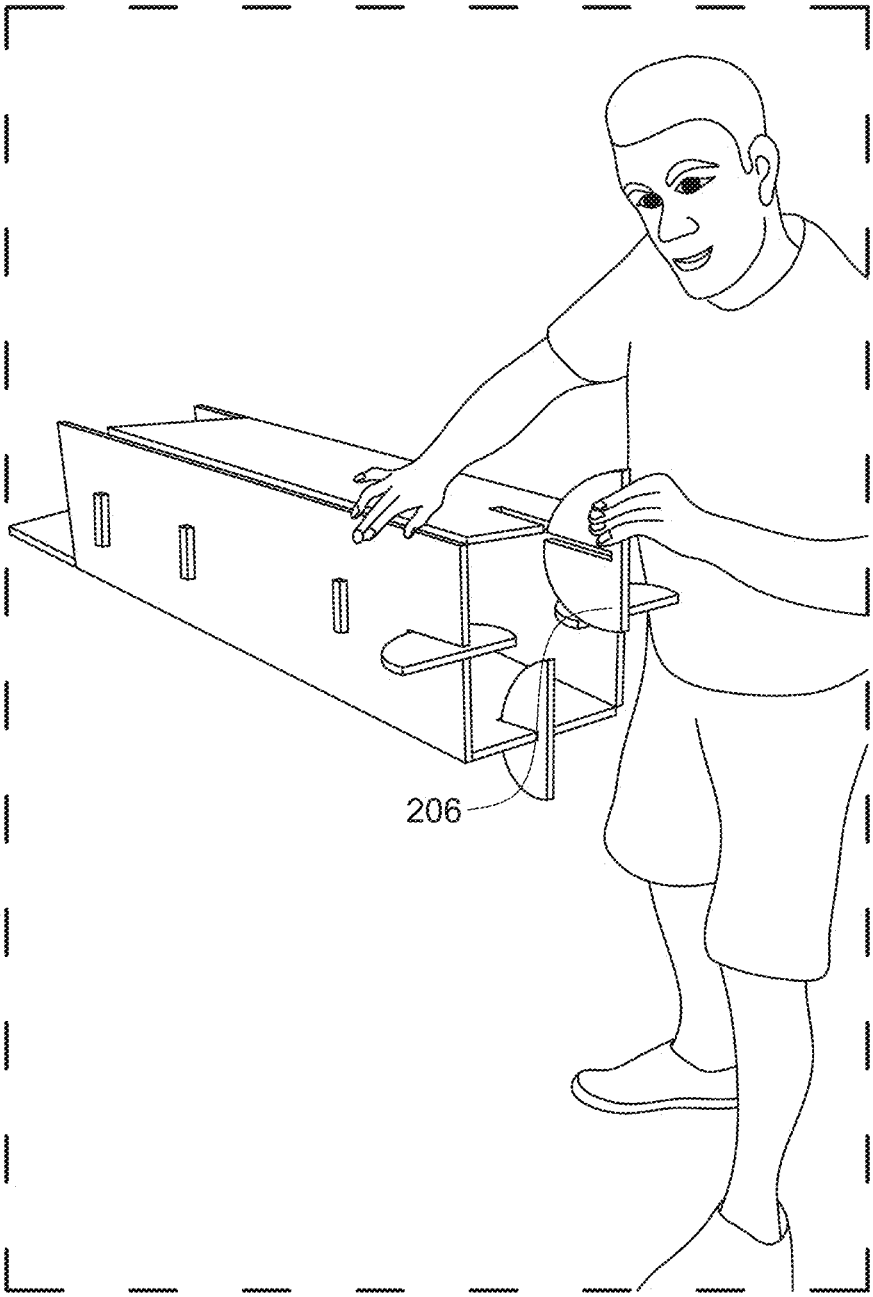
FIG. 2C depicts a dispensing station in the process of being disassembled according to an embodiment.
Figure 2D:
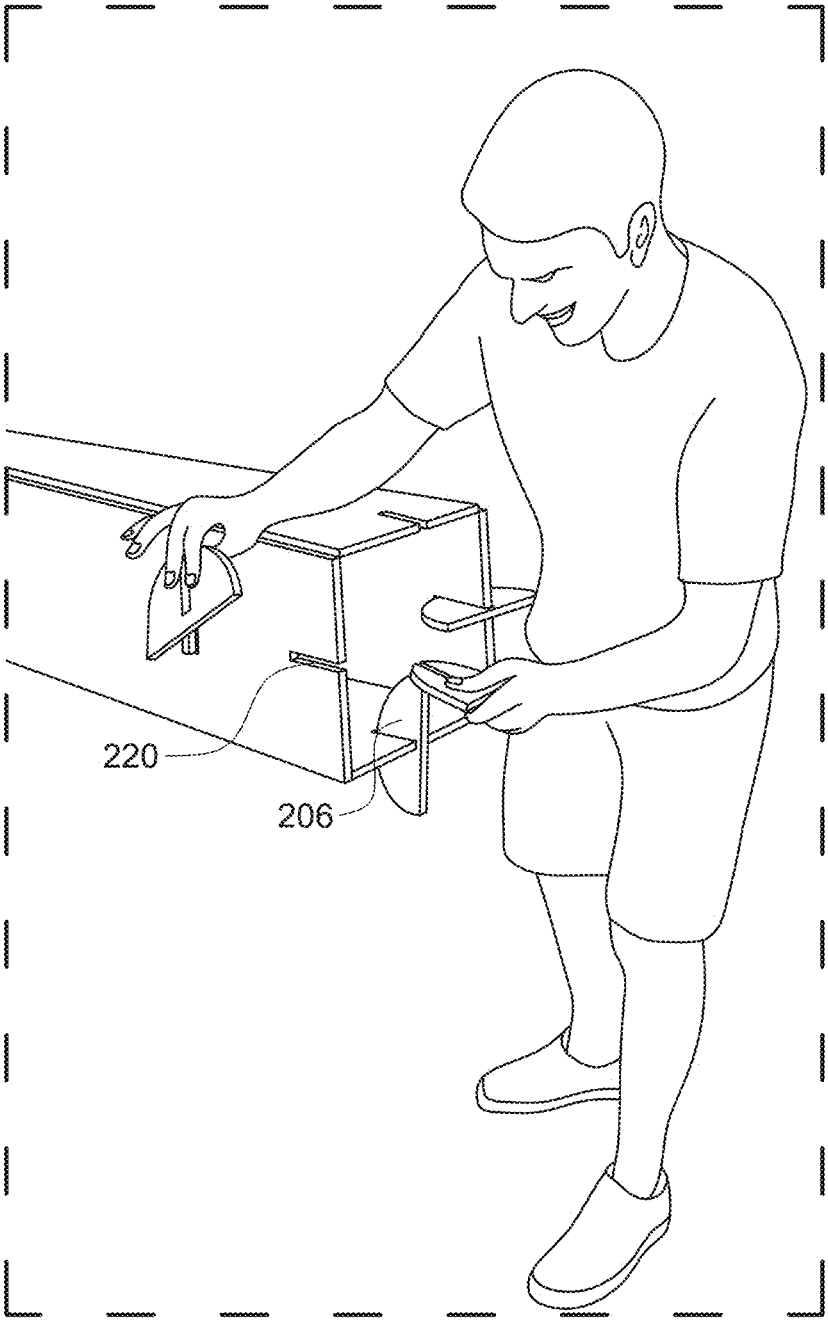
FIG. 2D depicts a dispensing station in the process of being disassembled according to an embodiment.
Figure 2E:
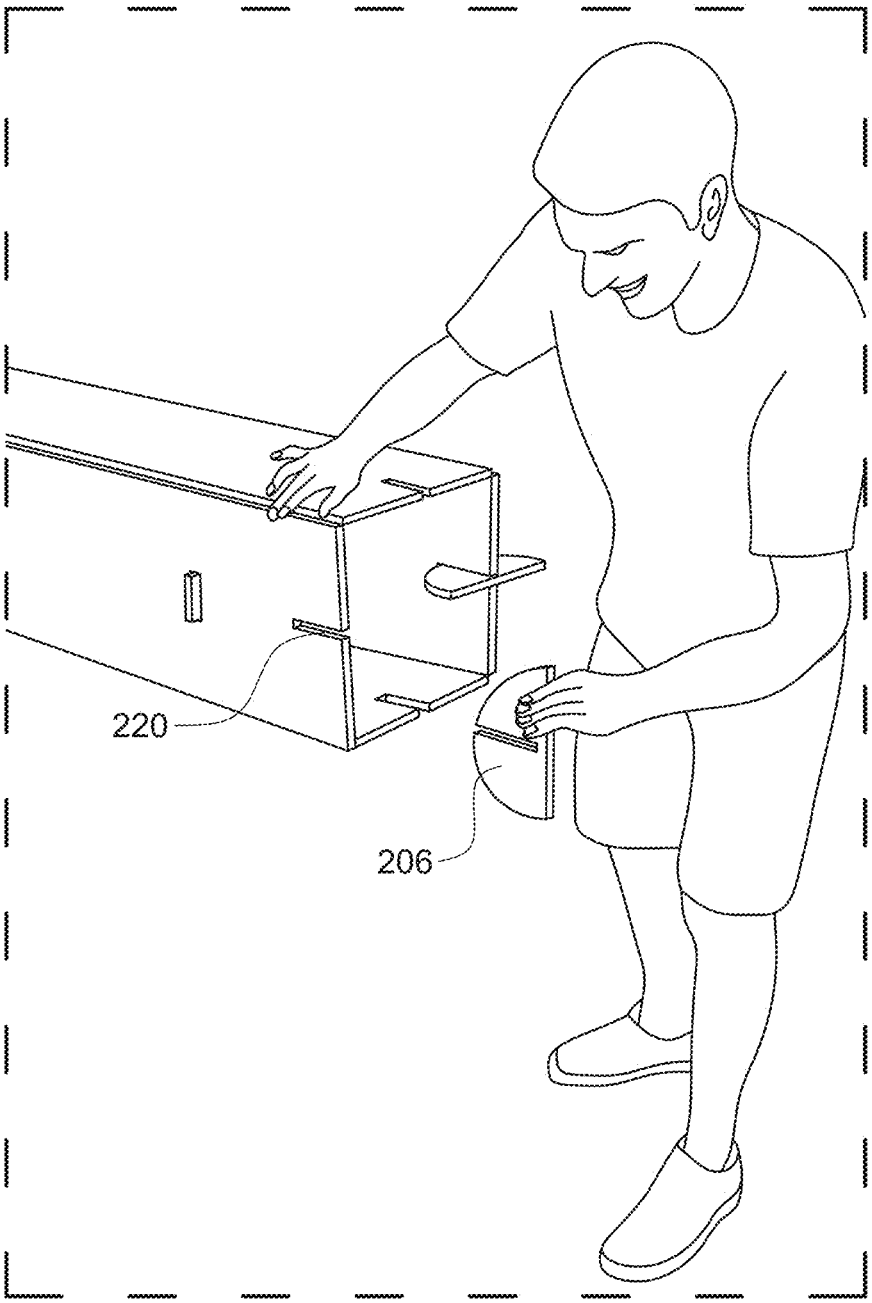
FIG. 2E depicts a dispensing station in the process of being disassembled according to an embodiment.
Figure 2F:
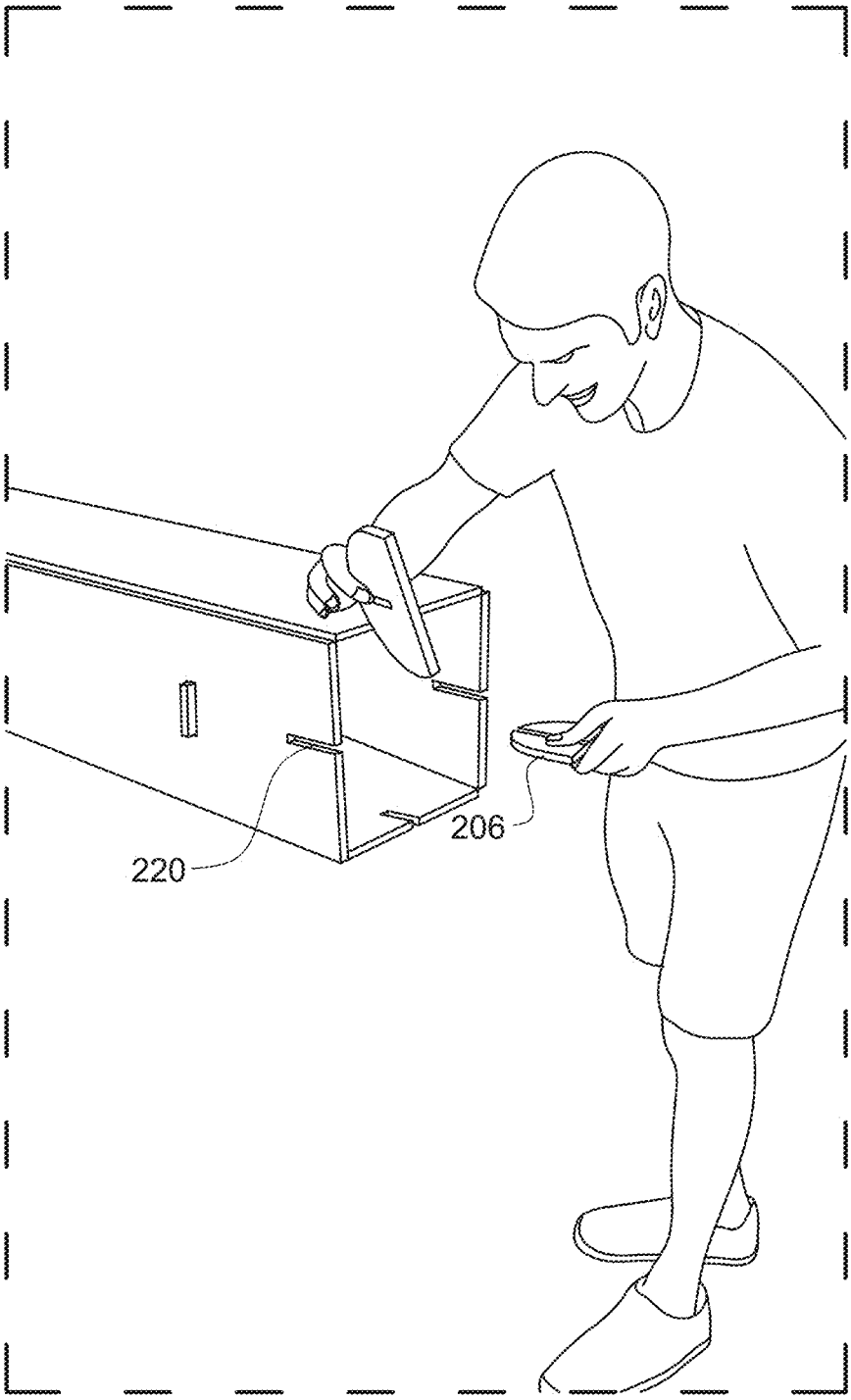
FIG. 2F depicts a dispensing station in the process of being disassembled according to an embodiment.
Figure 2G:
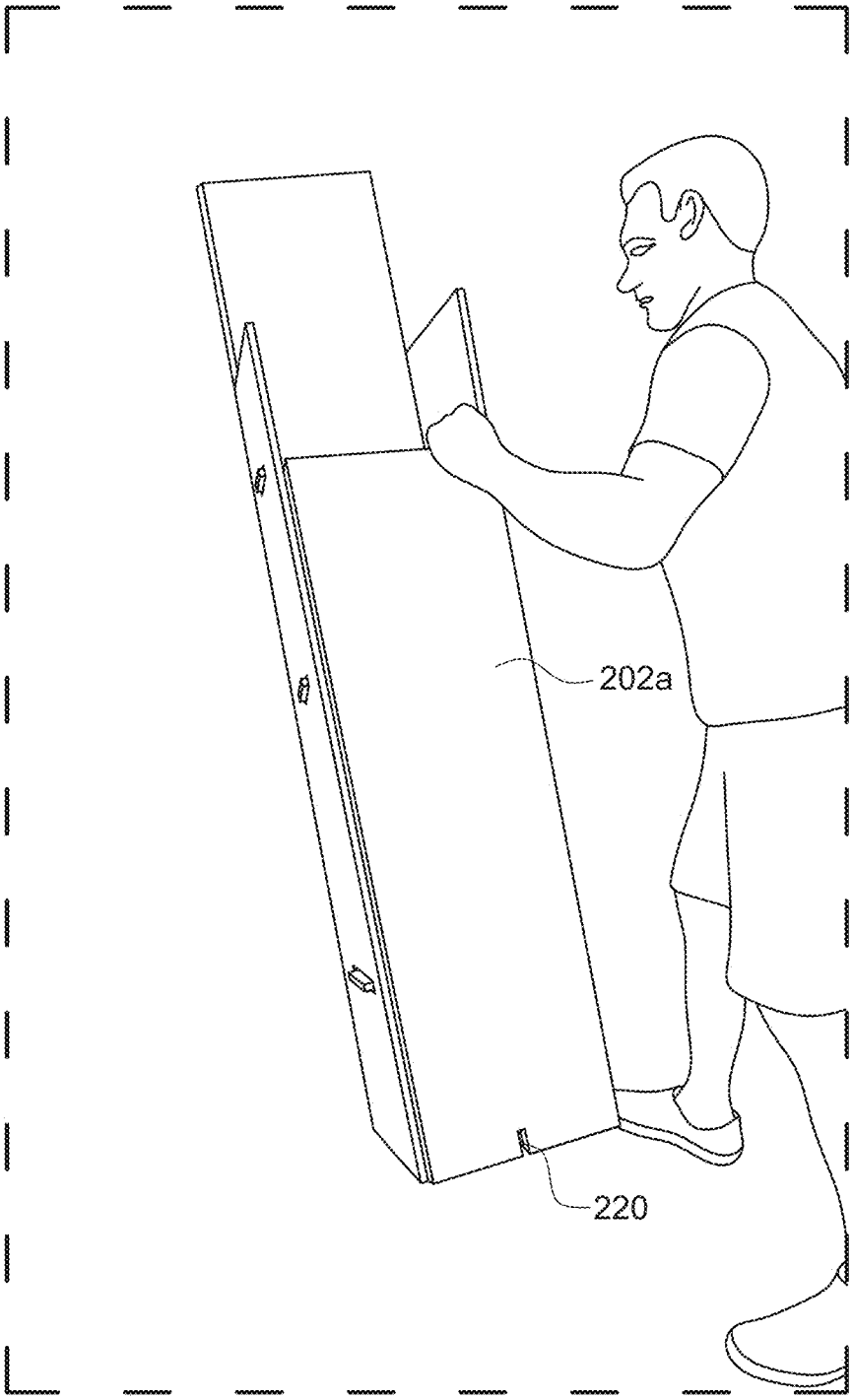
FIG. 2G depicts a dispensing station in the process of being disassembled according to an embodiment.
Figure 2H:
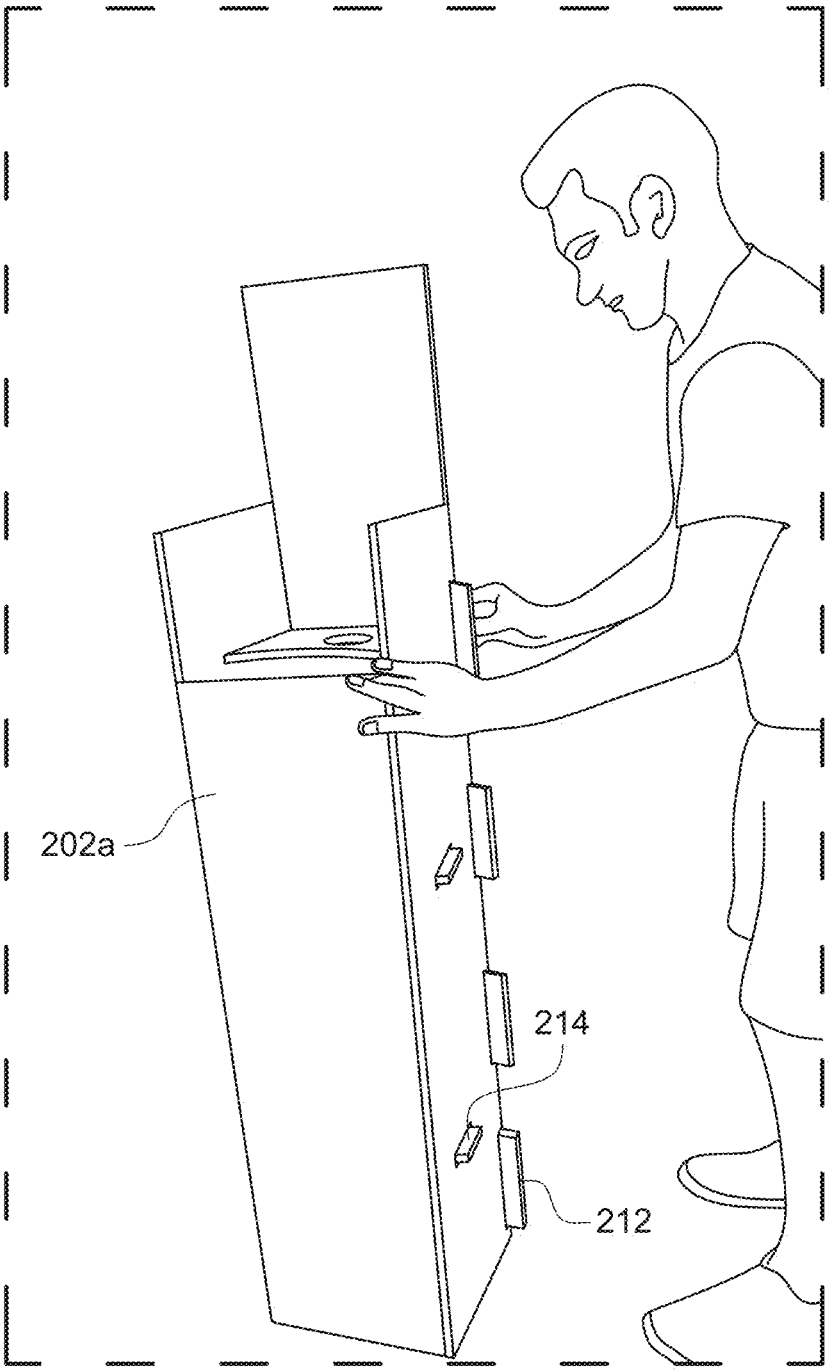
FIG. 2H depicts a dispensing station in the process of being disassembled according to an embodiment.
Figure 2I:
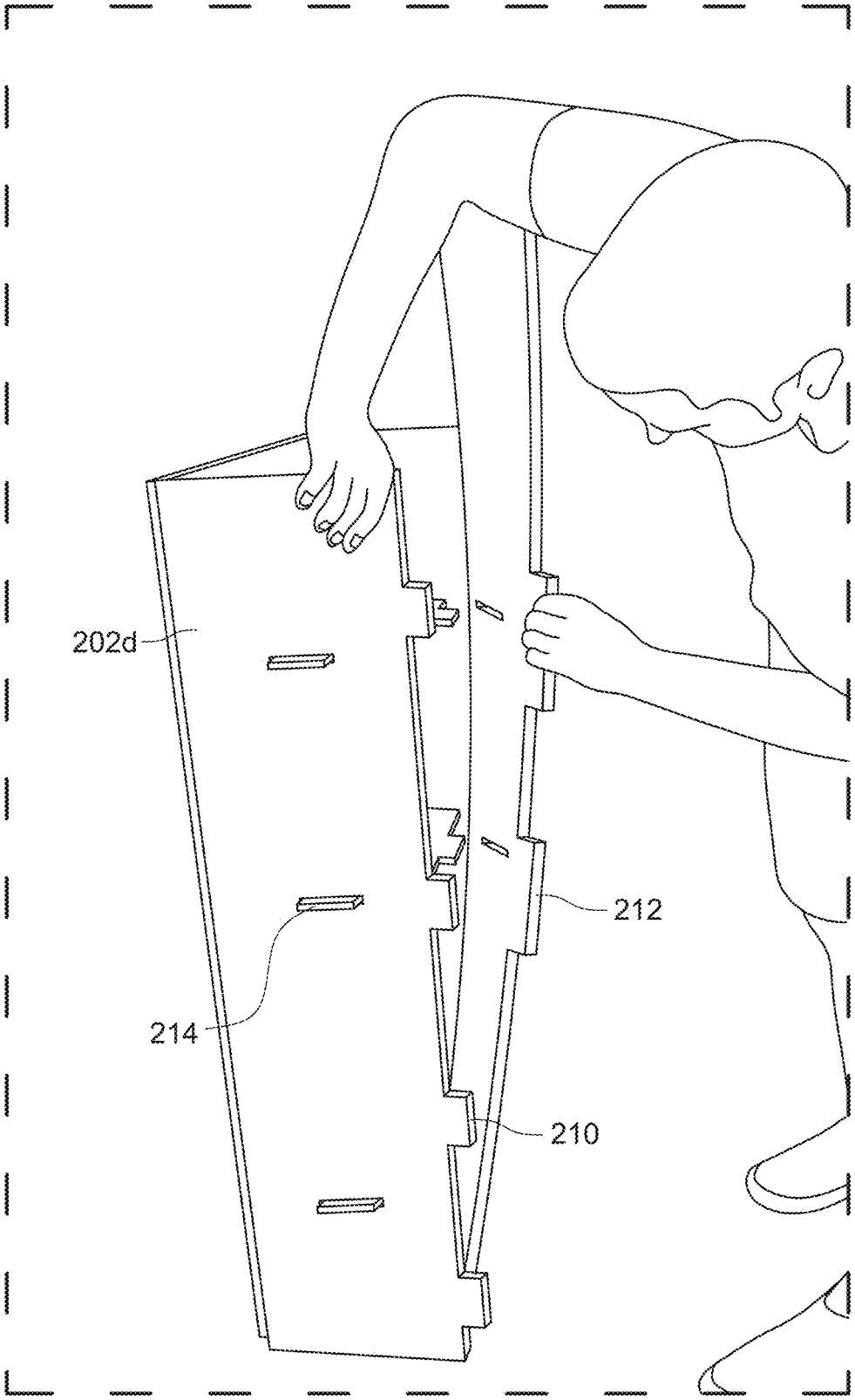
FIG. 2I depicts a dispensing station in the process of being disassembled according to an embodiment.
Figure 2J:
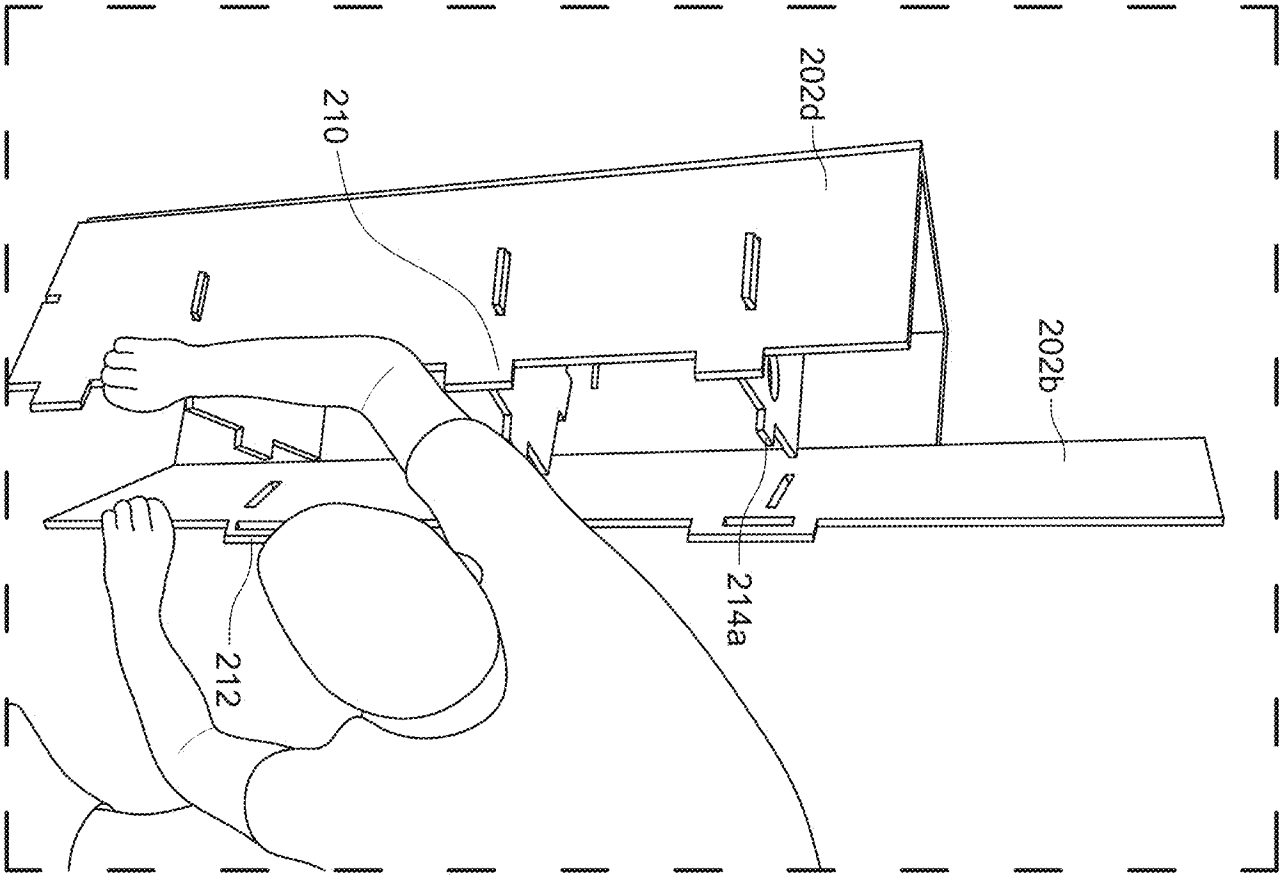
FIG. 2J depicts a dispensing station in the process of being disassembled according to an embodiment.
Figure 2K:
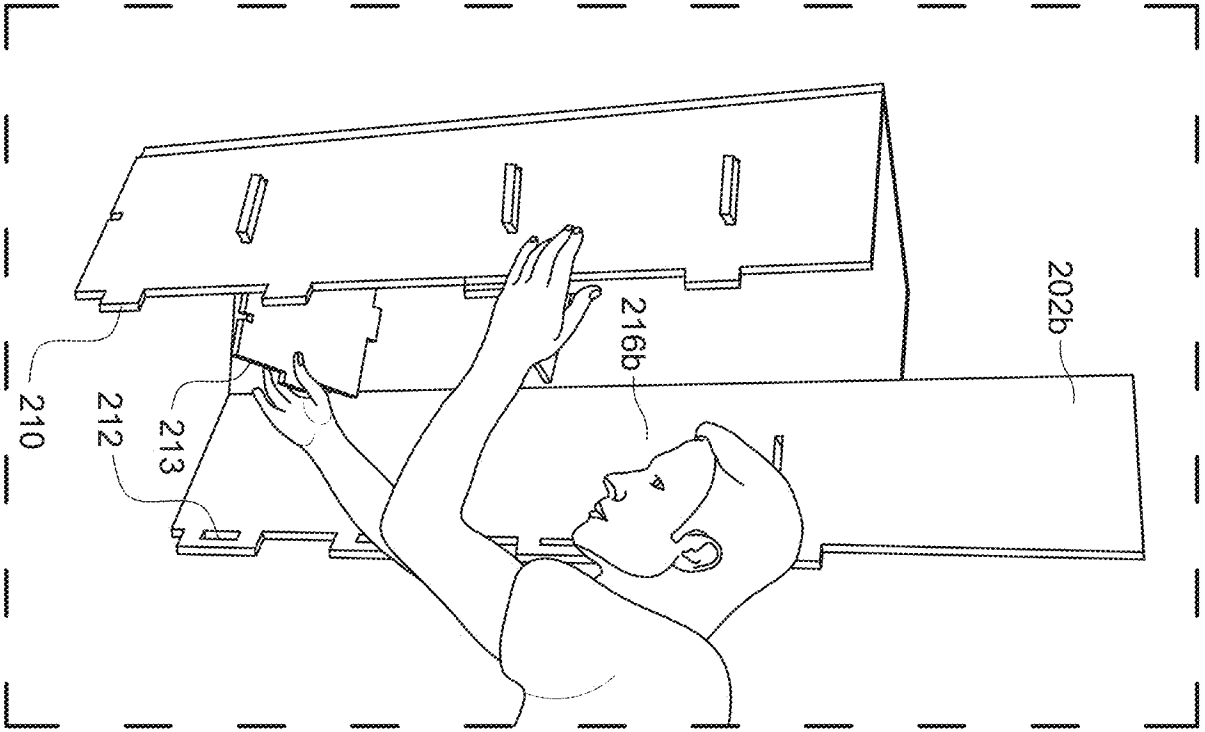
FIG. 2K depicts a dispensing station in the process of being disassembled according to an embodiment.
Figure 2L:
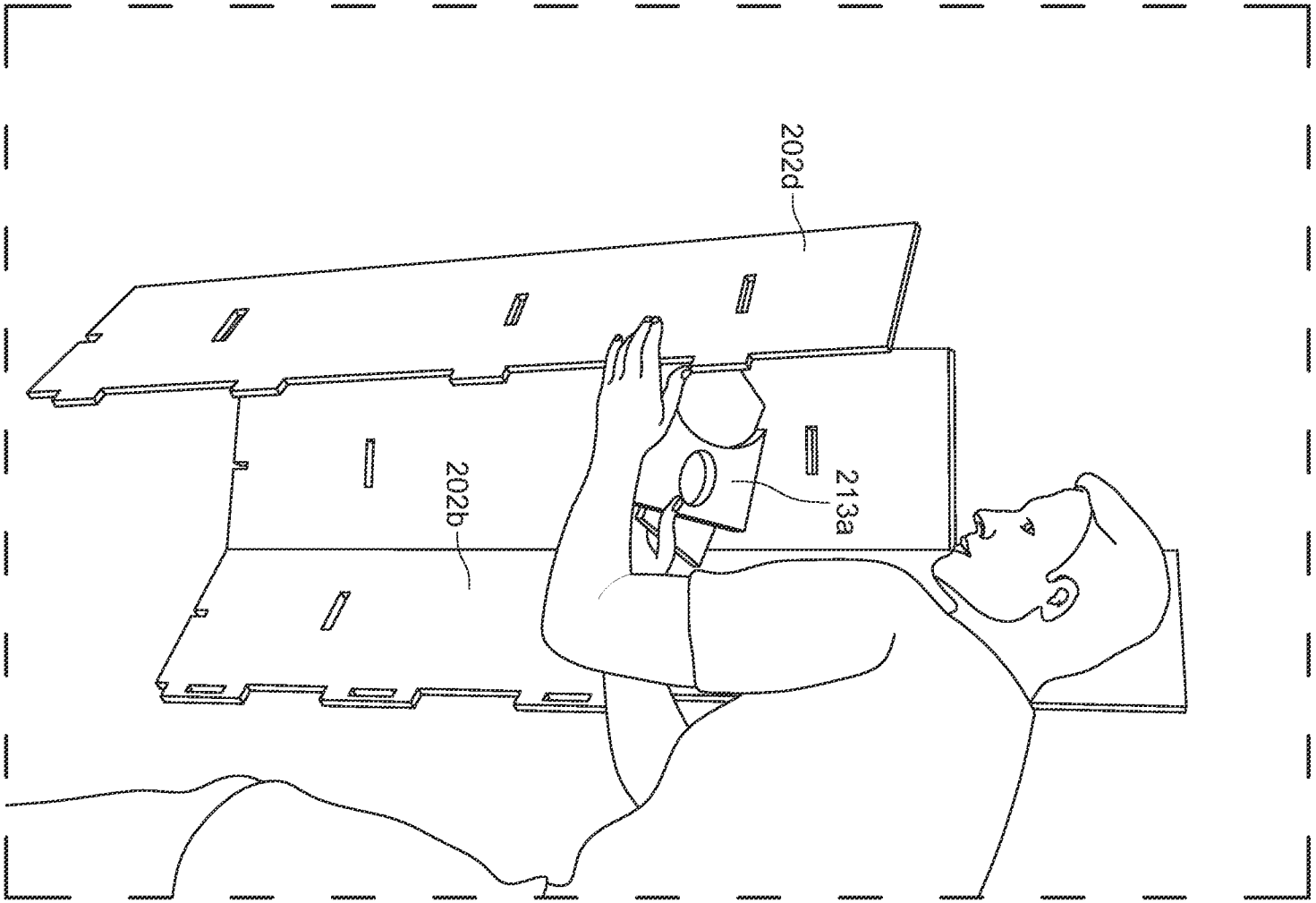
FIG. 2L depicts a dispensing station in the process of being disassembled according to an embodiment.
Figure 2M:
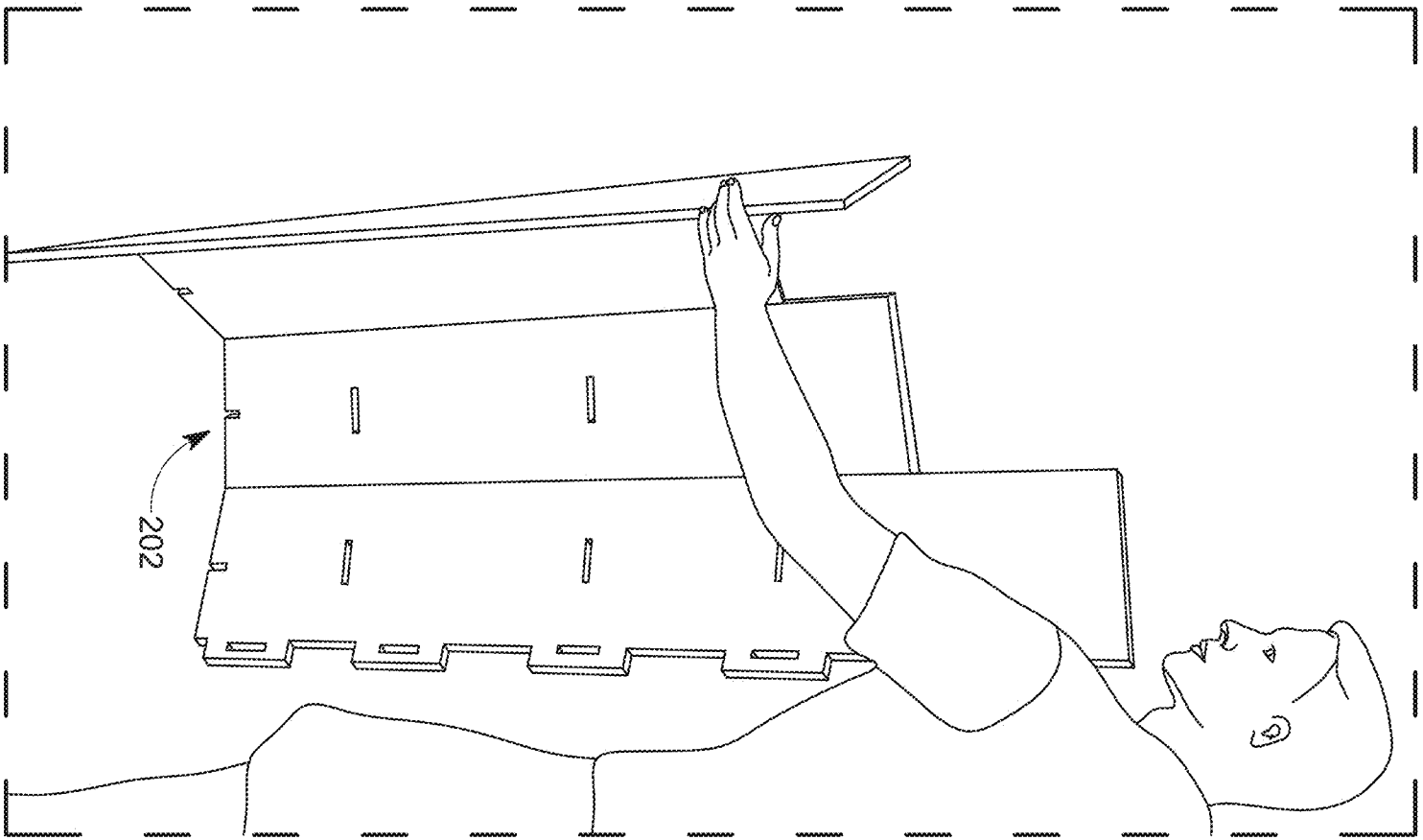
FIG. 2M depicts a dispensing station in the process of being disassembled according to an embodiment.
Figure 2N:
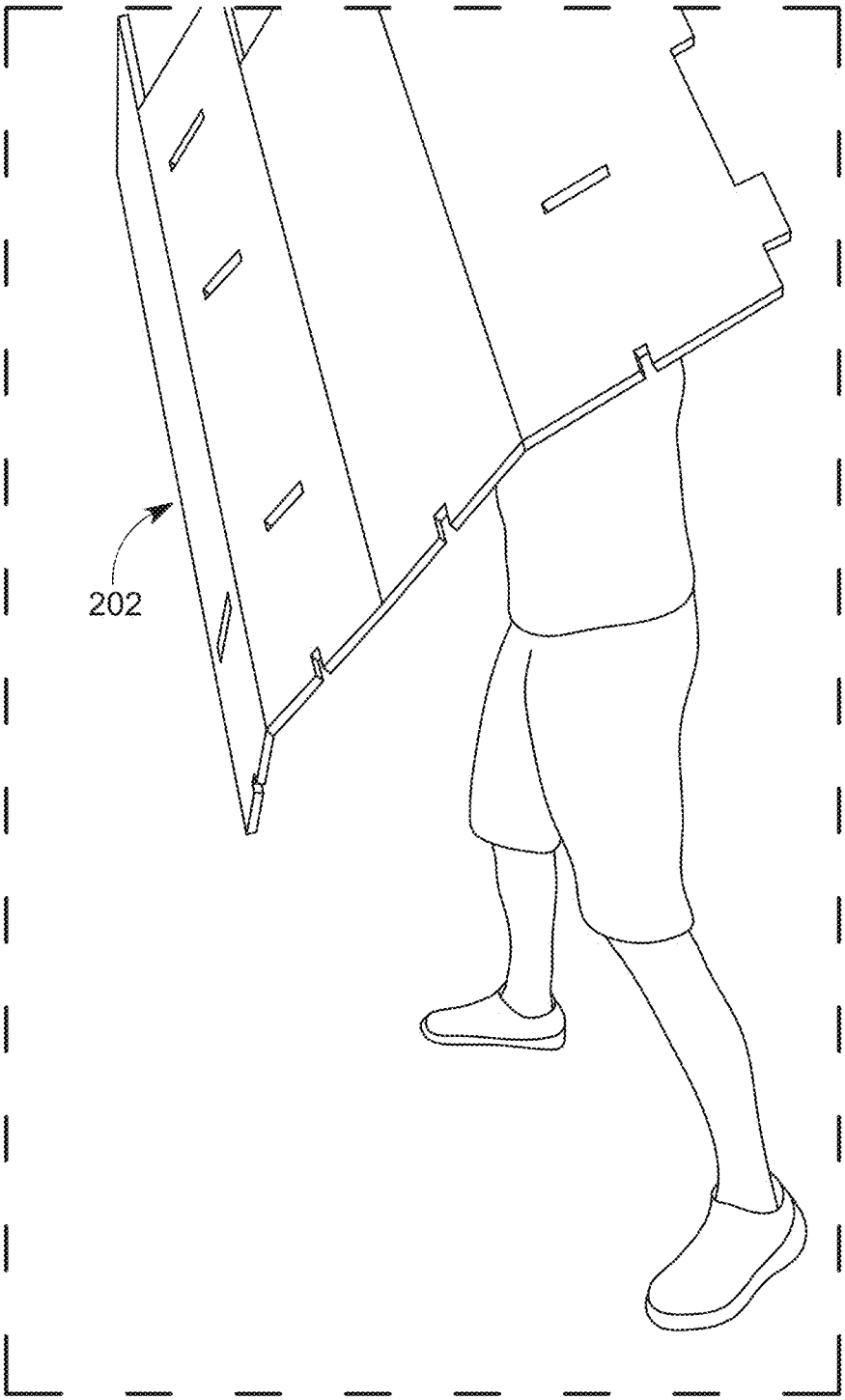
FIG. 2N depicts a dispensing station in the process of being disassembled according to an embodiment.
Figure 2O:
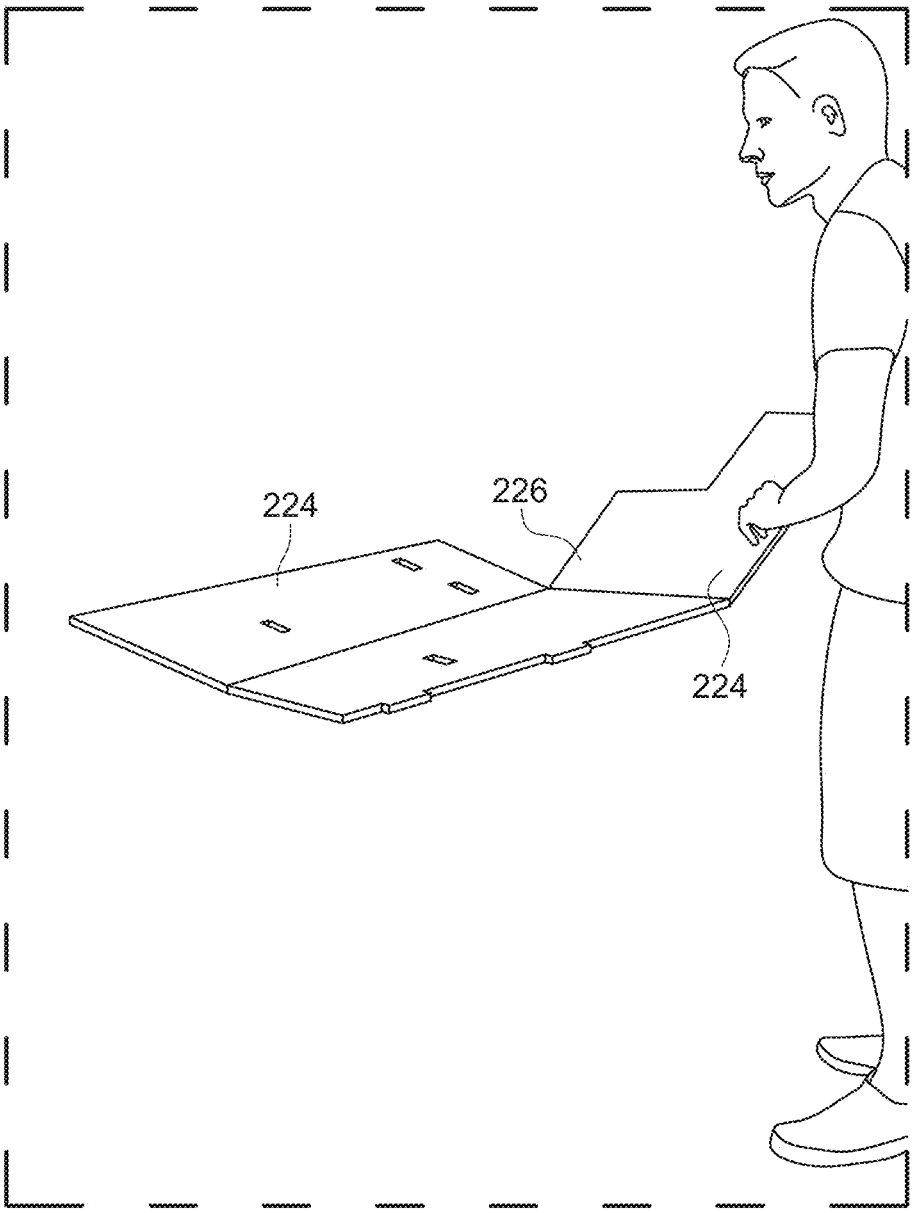
FIG. 2O depicts a dispensing station in the process of being disassembled according to an embodiment.
Figure 2P:
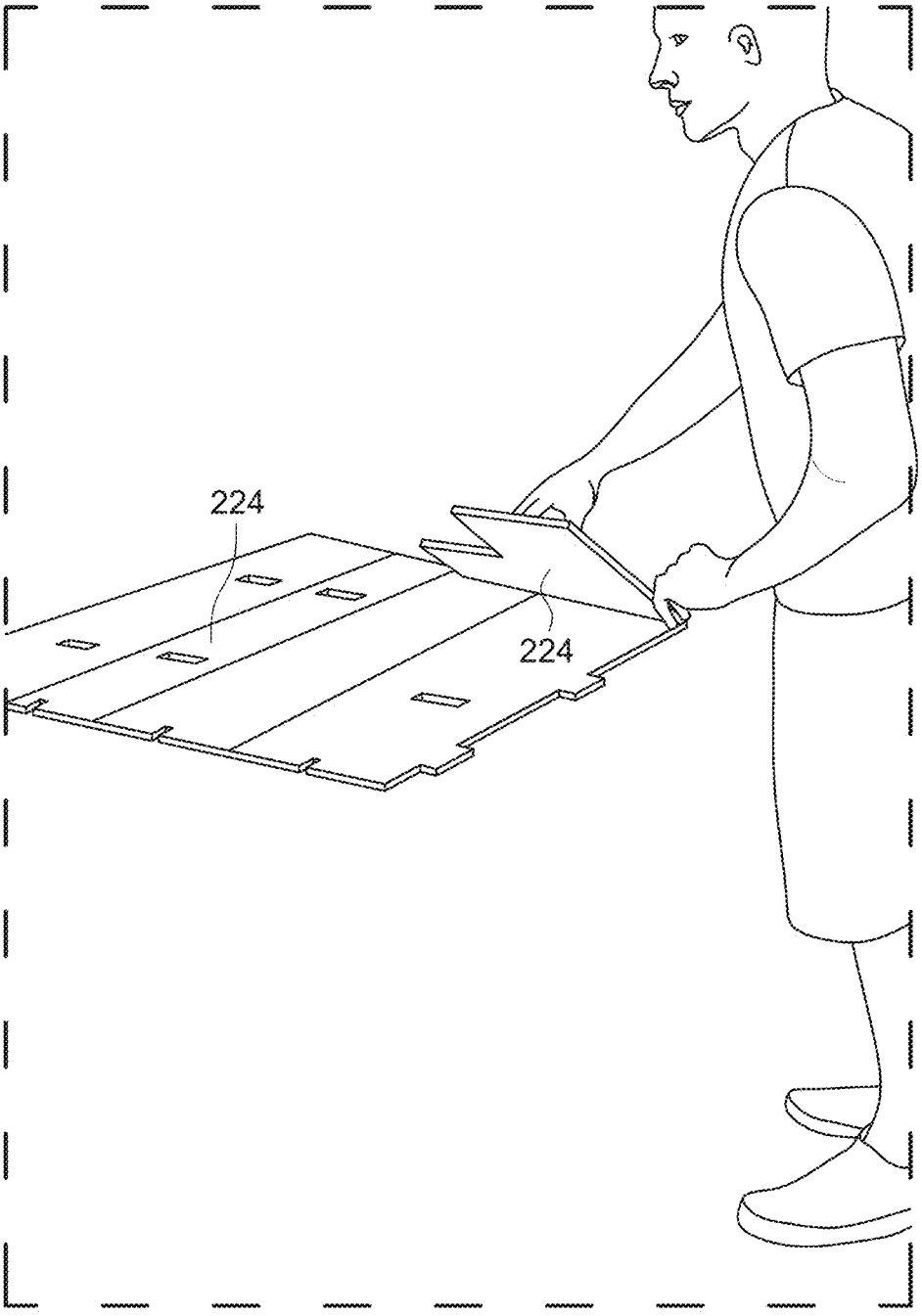
FIG. 2P depicts a dispensing station in the process of being disassembled according to an embodiment.
Figure 2Q:
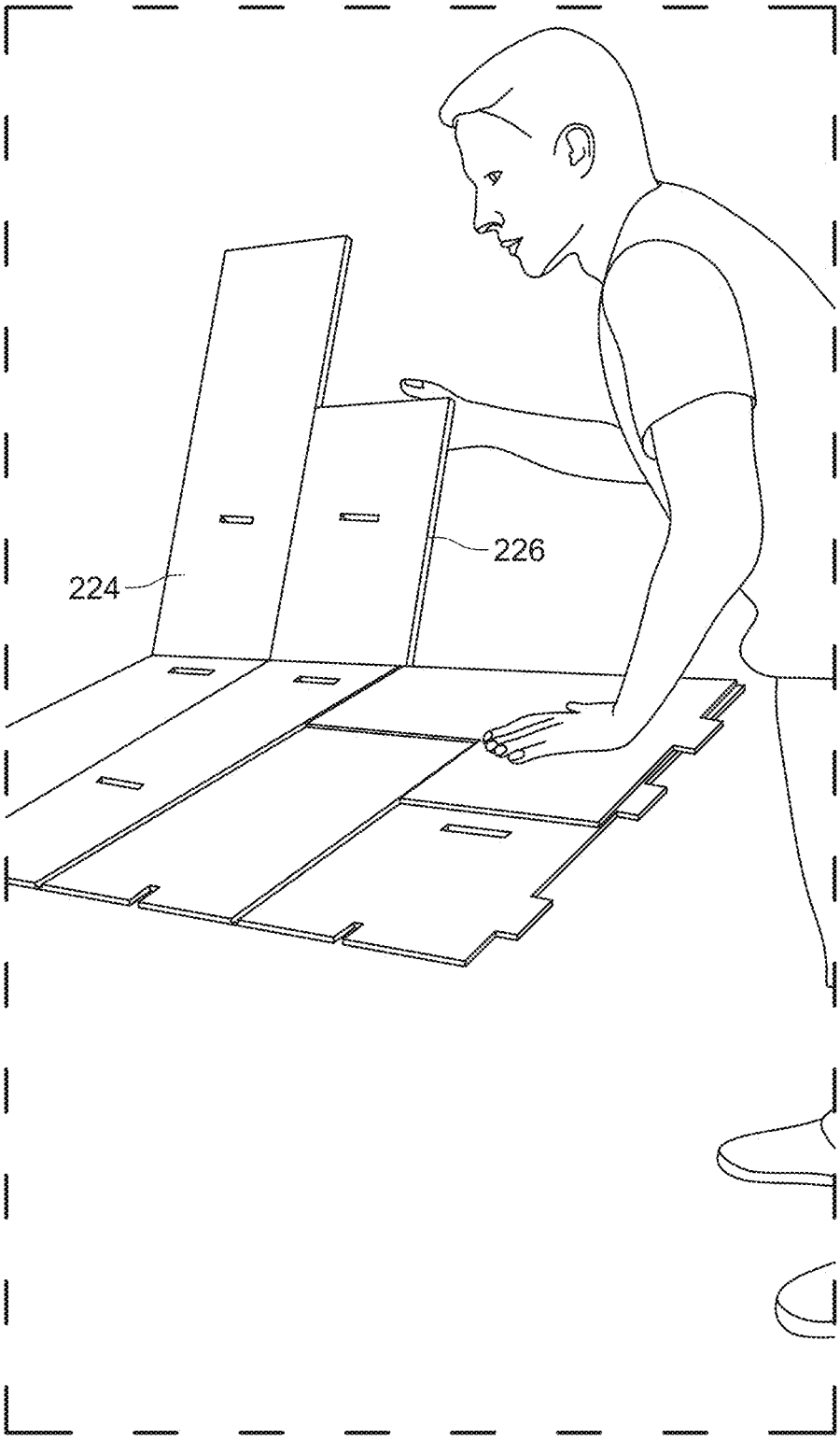
FIG. 2Q depicts a dispensing station in the process of being disassembled according to an embodiment.
Figure 2R:
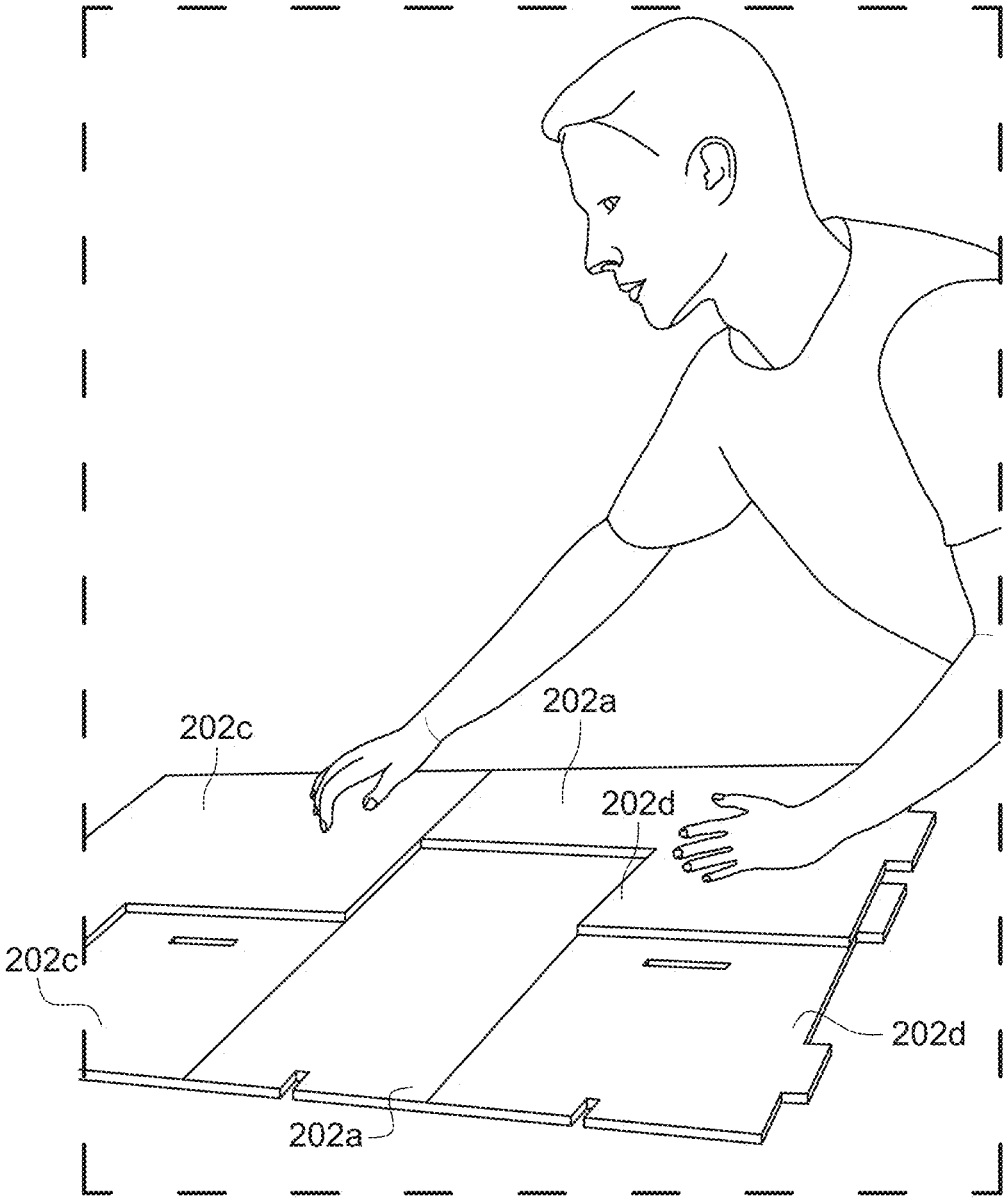
FIG. 2R depicts a dispensing station in the process of being disassembled according to an embodiment.
Figure 2S:
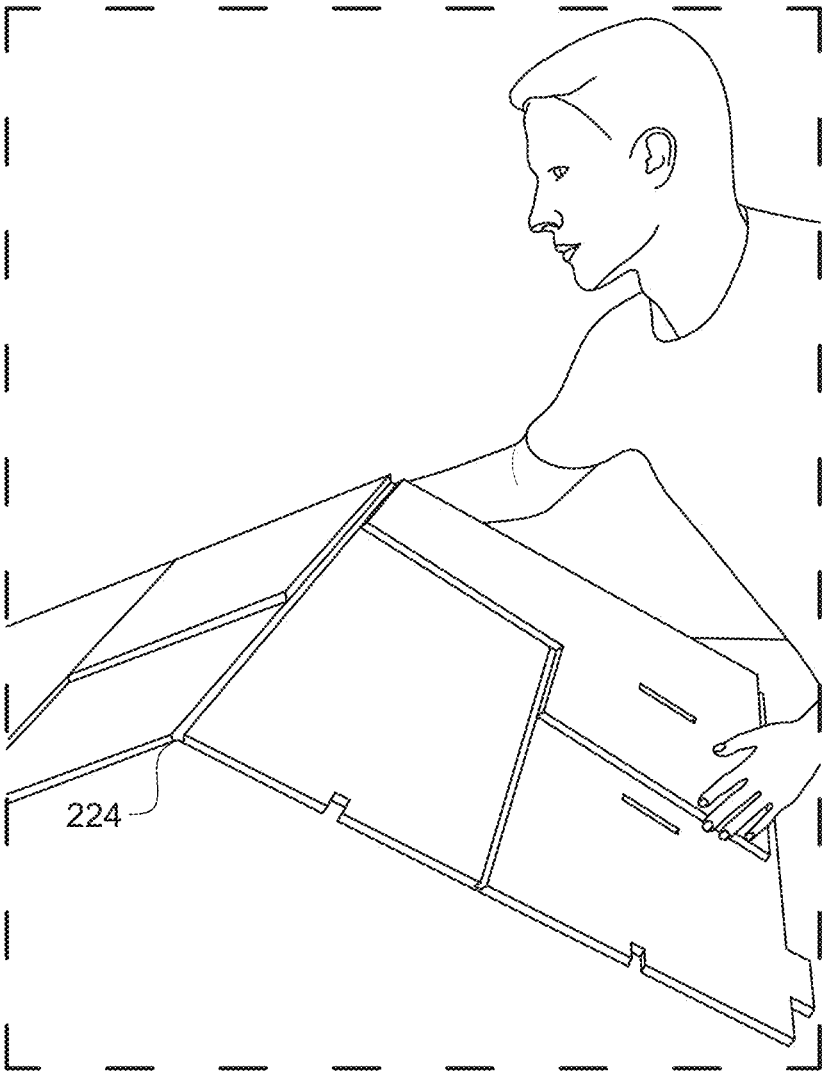
FIG. 2S depicts a dispensing station in the process of being disassembled according to an embodiment.
Figure 2T:
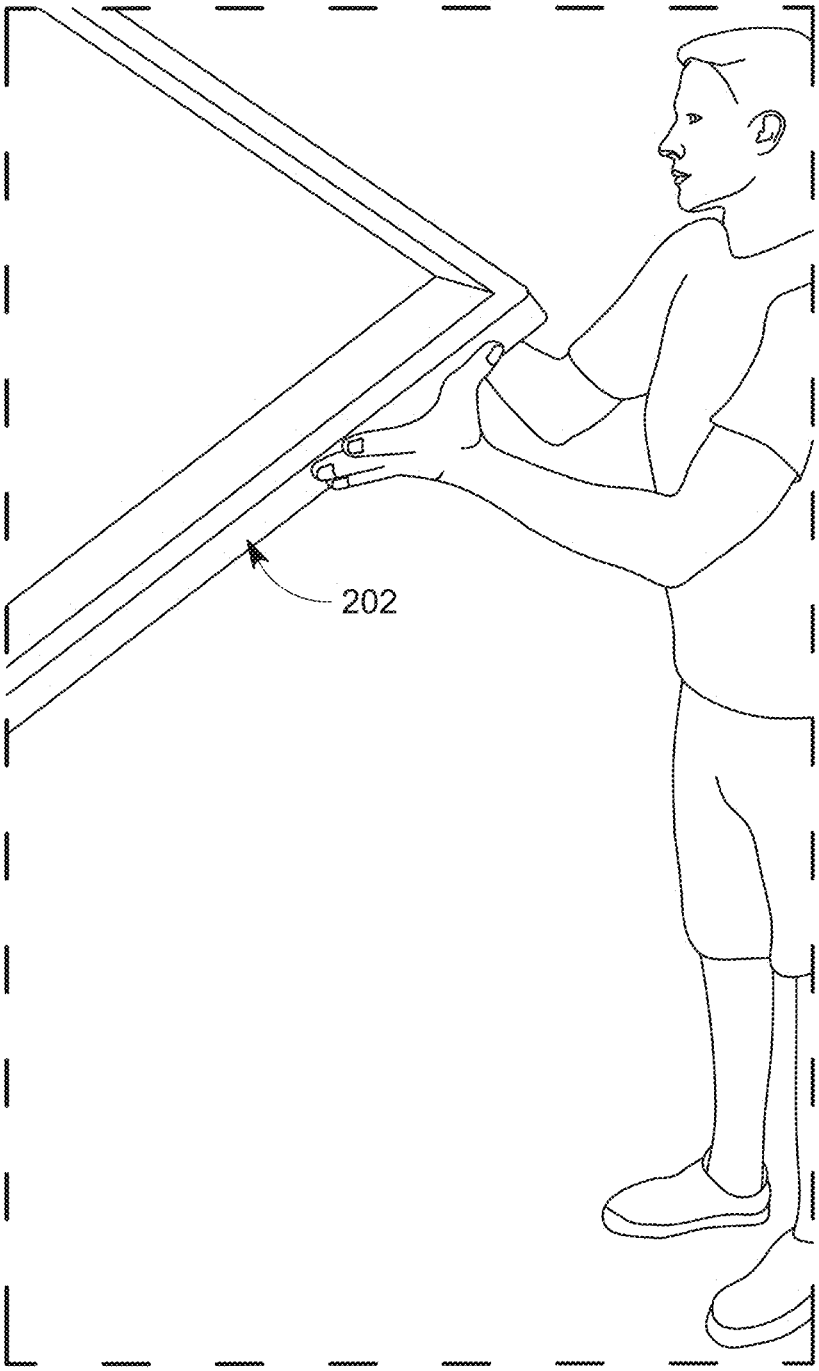
FIG. 2T depicts a dispensing station in the process of being disassembled according to an embodiment.
Figure 2U:
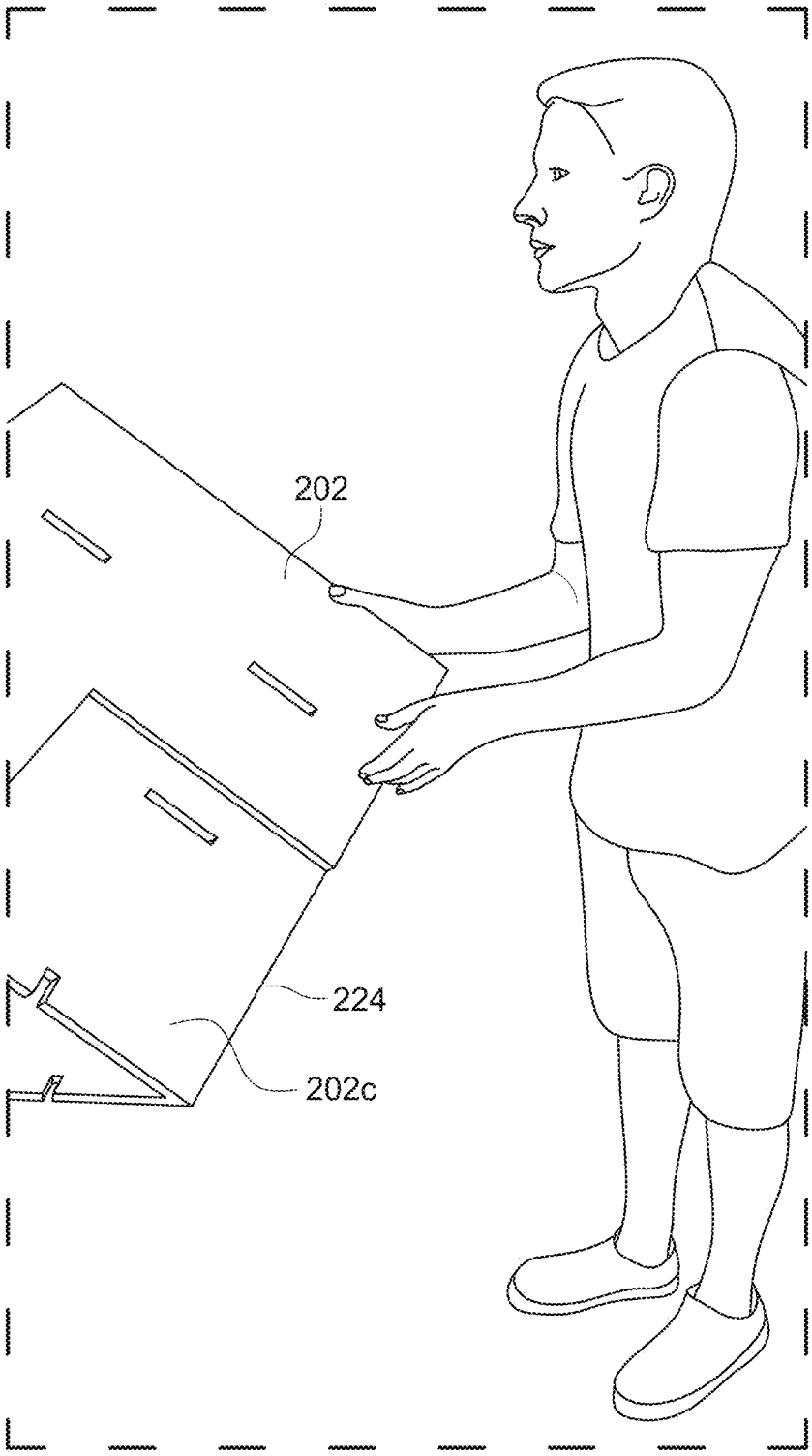
FIG. 2U depicts a dispensing station in the process of being disassembled according to an embodiment.
Figure 2V:
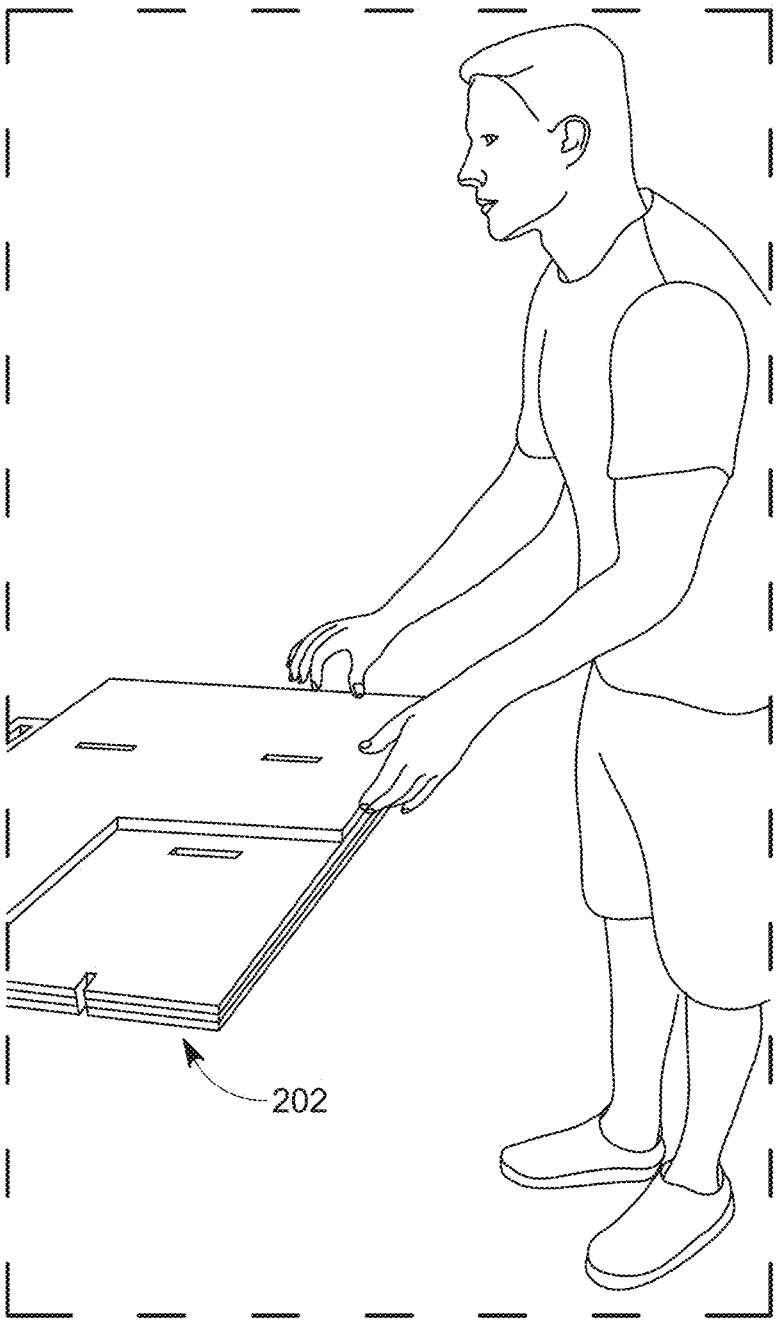
FIG. 2V depicts a dispensing station in the process of being disassembled according to an embodiment.

FIG. 2A depicts a flat-pack liquid dispensing station at the beginning of its deconstruction or teardown process. The front wall panel 202*a* is shown slightly pulled away and partially detached from wall panel 202*c*. The partial detachment of wall panel 202*a* from wall panel 202*c* provides an indication as to how the wall panels may be folded into smaller sections, which is described in more detail below.

FIG. 2B-F shows the dispensing station placed on its side on a work table to facilitate the removal of the supporting feet 206 from the wall panel notches 220. A work table is not necessary to remove the supporting feet 206 from the wall panel notches 220. The dispensing station may be positioned in any number of ways to expose the supporting feet 206 for removal (e.g., laid on a floor on the station's side, laid on a floor on the station's head, held upside down by a user).

While the supporting feet 206 are depicted as substantially semicircular in shape, they may comprise any number of shapes (e.g., trapezoids, squares, triangles, quarter-circles, non-geometric shapes) suitable for increasing the stability of the dispensing station. As with other components of the dispensing station, the supporting feet 206 may be comprised of sheet material (e.g., corrugated plastic, corrugated fiberboard, non-corrugated sheet material). The supporting feet 206 further comprise supporting feet notches 228 to make the interface with the wall panel notches 220 more secure. The additional leverage provided by the supporting feet 206 protect against or lessen the tipping of a dispenser station. Accordingly, that allows the overall footprint of the station to remain more compact. For example, the wall panels 202 can remain generally rectangular, but without the supporting feet, there may be configurations of a dispensing station where the wall panels would require shapes that broaden at the bottom. For example, in such situations, the wall panels may require a trapezoidal shape in order to create a wider base at the bottom. The trapezoidal shapes of such wall panels may create a skirt-like appearance and increase the footprint of such a station, therefore reducing the number of options for a user to place a station and, at least, making it more difficult to handle, pack, transport, and/or assemble the station.

While the figures show a certain number of supporting feet arranged in a particular formation on the assembled dispensing station, it is contemplated that the number of supporting feet and their arrangements may differ, so long as they assist maintaining the upright position of a dispensing station. In other embodiments of the station, there may be no supporting feet as they are not required in those embodiments.

FIGS. 2G-2L depict the return of the dispenser station back onto the ground and placed in a substantially vertical position along with the release or removal of the wall panel tabs 210 from the wall panel slotted tabs 212. In various embodiments, the wall panel tabs 210 may be removably inserted, removably secured, or removably locked to the wall panel slotted tabs 212 by a variety of mechanisms (e.g., friction, locking tab system). Similarly, the shelves 213 each comprise shelf tabs 214, which may be removably inserted, removably secured, or removably locked into the wall panel shelf slots 216 by a variety of mechanisms (e.g., friction, locking tab system). Once the wall panel tabs 210 are released from the wall panel slotted tabs 212, the shelf slots 216*b* of rear wall panel 202*b* may be removed from the corresponding shelf tabs 214*a*. In this embodiment, the wall panel tabs 210 and shelf tabs 214 are held in position when inserted into their respective slots by friction, which is in part caused by the relatively close fit between the tabs and the slots.

The shelf tabs 214*b-c* may be removed by hand from the wall panel shelf slots 216*b-c*, resulting in the full removal of the shelves 213 from the dispensing station assembly wall panels. The shelves 213, like other components of the dispensing station assembly, may be comprised of sheet material. The shelves 213 in this embodiment further comprise a pump passthrough shelf 213*a*. The pump passthrough shelf 213*a* includes an opening 222 suitable for allowing the head and/or neck of a liquid dispensing pump to pass through. The pump passthrough shelf 213*a* also comprises a front edge that recedes towards the center of the pump passthrough shelf and allows visual and manual access to a container of liquid below the pump passthrough shelf despite the presence of a front wall panel 202*a*. In this embodiment, the pump passthrough shelf front edge comprises a crescent shape, although in other embodiments, it may comprise other shapes that provides access to the container or bottle below. In some embodiments, the pump passthrough shelf aids in the aesthetic appearance of the assembled dispensing station by at least partially hiding from view of a container of liquid placed on the shelf below. The pump passthrough opening 222 allows the head of a liquid dispensing pump to be activated by a user. Further, the pump passthrough opening 222 may further restrict the movements of a container of liquid placed (e.g., keeping the head of a pump centered in the dispensing station, minimizing the movement of the container of liquid supported by a shelf).

FIGS. 2M-2V depict the wall panels 202 as detached of any supporting feet 206 or shelves 213. Those figures also depict the wall panels 202 being returned to a work table to be folded into a more compact form. In this embodiment, the four wall panels 202 are hingeably connected and comprises one contiguous piece of sheet material. The wall panels 202 comprise at least two fold lines 224 and at least one cut line 226. The four wall panels 202 may be hingeably connected along these fold lines 224 by cutting partially, not completely, through the sheet material along fold lines 224. These partial cuts may be made on the interior or exterior of the wall panels 202. The cut line 226 represent cuts made completely through the sheet material. In other embodiments, a dispensing station may comprise more or less than four wall panels. For example, a dispensing station with a triangular footprint might have three walls. In another example, a dispensing station with an octagonal footprint might have 8 walls.

Cut lines or fold lines may be visible because of markings printed on the sheet material. In other cases, the cut lines or fold lines may be visible because of a gap or indentation created for the cut or fold. A cut line may comprise the edge of a cut and not necessarily mean a gap between two pieces created by a cut. In creating fold lines, partial cuts may be made to the sheet material. In some cases, the partial cut creating a fold line may performed on the side of the sheet material that would be the external or outside facing side in an assembled dispenser station. In other cases, the partial cut creating a fold line may be performed on the side of the sheet material that would be the internal or inside facing side in an assembled dispenser station. In some embodiments, a fold line created by a cut made to the interior of a dispensing station may be preferable as it retains a smooth uninterrupted surface around each corner where two wall panels meet.

Returning to FIGS. 2M-2V, each wall panel may be folded into a smaller sections as delineated by fold lines 224 and cut lines 226. Because of how the fold lines 224 and cut lines 226 are configured, the tallest wall panel 202*b* when folded, becomes half its unfolded length; the side wall panels 202*c-d* become approximately two-thirds of their unfolded lengths; and the front wall panel 202*a* becomes approximately three-quarters of its unfolded length.

In this embodiment, a fold line 224 runs perpendicular to the length of each wall panel. The fold line is further configured to be positioned from the bottom at a distance that is substantially half the length of the longest unfolded wall panel, which, in this embodiment, is the rear wall panel 202*b*. Once the wall panels 202 are laid flat on a surface, the cut line 226 allows a top portion of each wall panel 202 to fold onto itself and create a straight edge, which is advantageous for handling, packing, and transporting.

Further, a fold line 224 is configured to run between front wall panel 202*a* and side wall panel 202*c* from the bottom end of the wall panels 202 for a length approximately half that of the longest wall panel, the rear wall panel 202*b*. Once the top portions of each wall panel are folded over along cut line 226, the wall panels may then be folded along fold line 224, substantially halving the surface area of the wall panels 202, which is advantageous for handling, packing, and transporting. Therefore, the wall panels 202 are configured to be folded into a substantially rectangular shape that is approximately one quarter the area of the wall panels 202 laid flat and unfolded and comprises substantially straight sides.

Embodiments with a Pump Passthrough Shelf

Figure 3A:
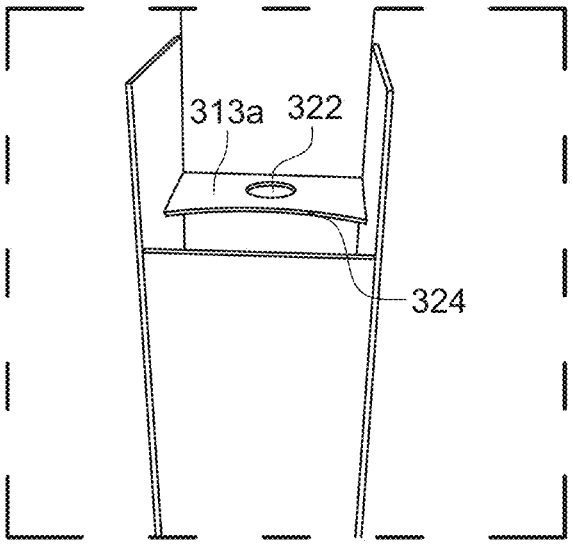
FIG. 3A illustrates a front perspective view of a dispensing station according to an embodiment.

FIG. 3A depicts a perspective view of an assembled dispensing station according to an embodiment with a pump passthrough shelf 313*a* being visible. The pump passthrough shelf 313*a* comprises an opening 322 and a front edge 324 configured so that it recedes, or sweeps back towards the center of the pump passthrough shelf 313*a*.

Figure 3B:
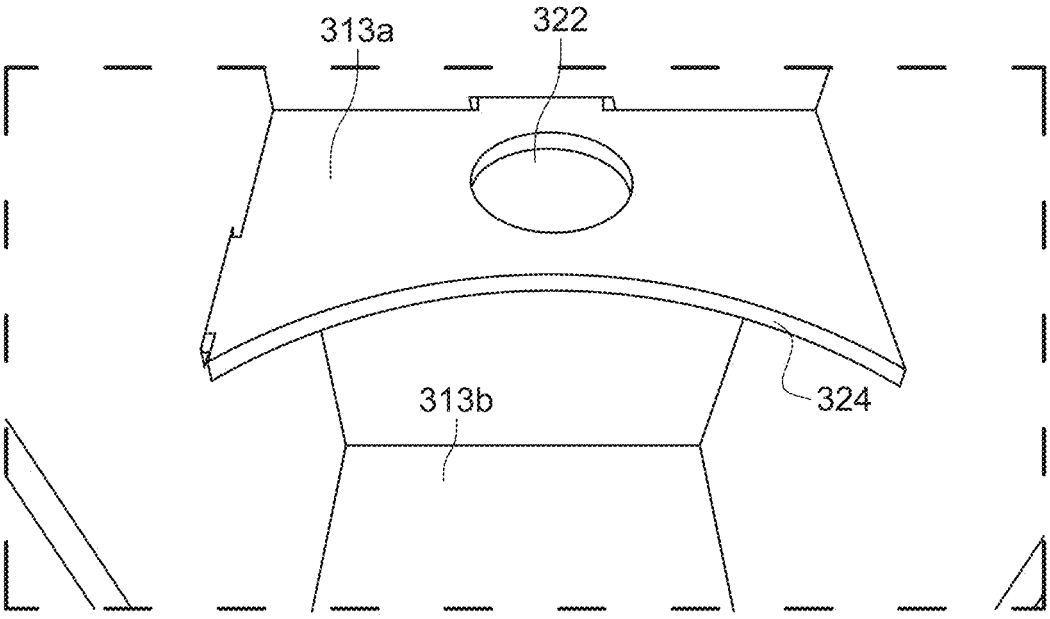
FIG. 3B illustrates a close-up top-front perspective view of a dispensing station according to an embodiment.

FIG. 3B depicts a close-up perspective view of a pump-passthrough shelf 313*a* according to an embodiment within an assembled dispensing station. The shape of the front edge 324 provides a gap through which a user may more easily access a container of liquid resting on the shelf 313*b* below the pump passthrough shelf 313*a*.

Figure 4:
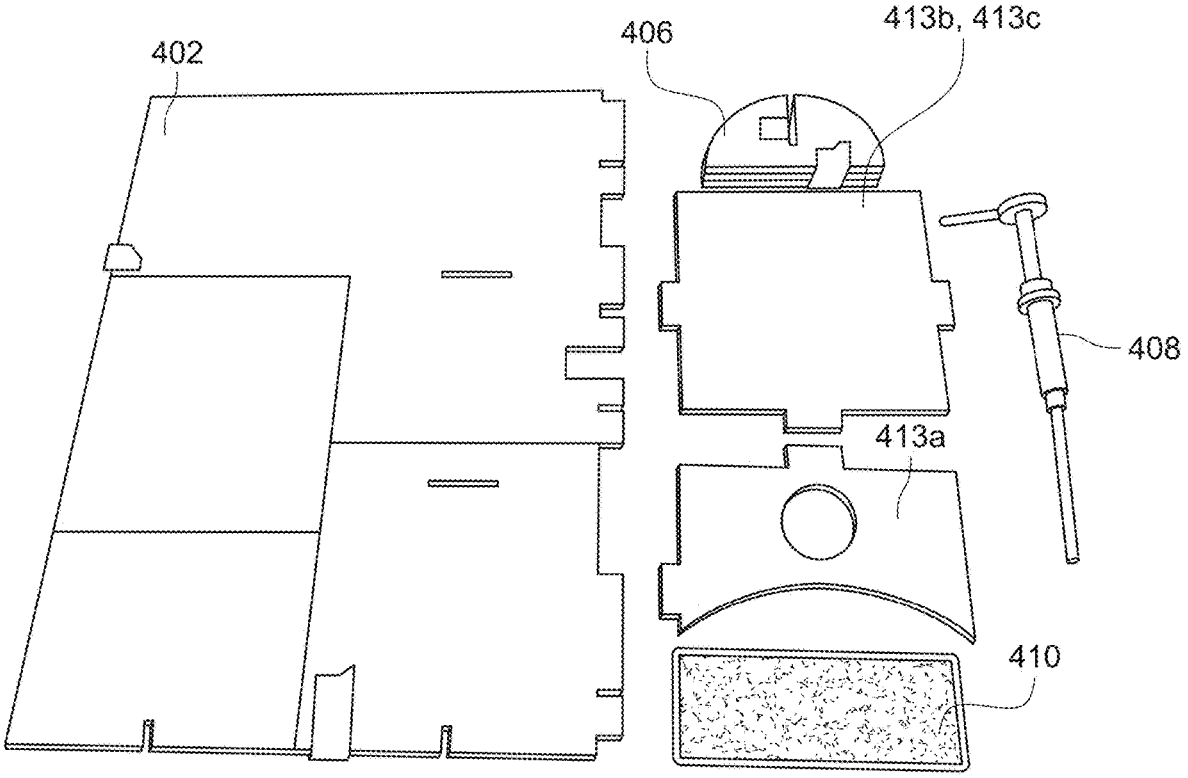
FIG. 4 depicts a disassembled dispensing station according to an embodiment.

FIG. 4 depicts components for a dispensing station, with the wall panels 402 being folded into its most compact configuration and pre-printed with an example of branding and or ad-copy. FIG. 4 further depicts three shelves 413, including one pump passthrough shelf 413*a* and two full shelves 413*b* and 413*c*; four supporting feet 406, a liquid dispensing pump 408 and a drip pad 410.

Layouts of Various Embodiments

The following figures that depict the design layout of various embodiments of the dispensing station are drawn to scale. Dimensions and ranges discussed in the specification or displayed in the figures may be instructive. However, any proportions, dimensions, or ranges mentioned throughout this disclosure should not be construed as limiting the variety of embodiments the disclosed invention may comprise.

Figure 5A:
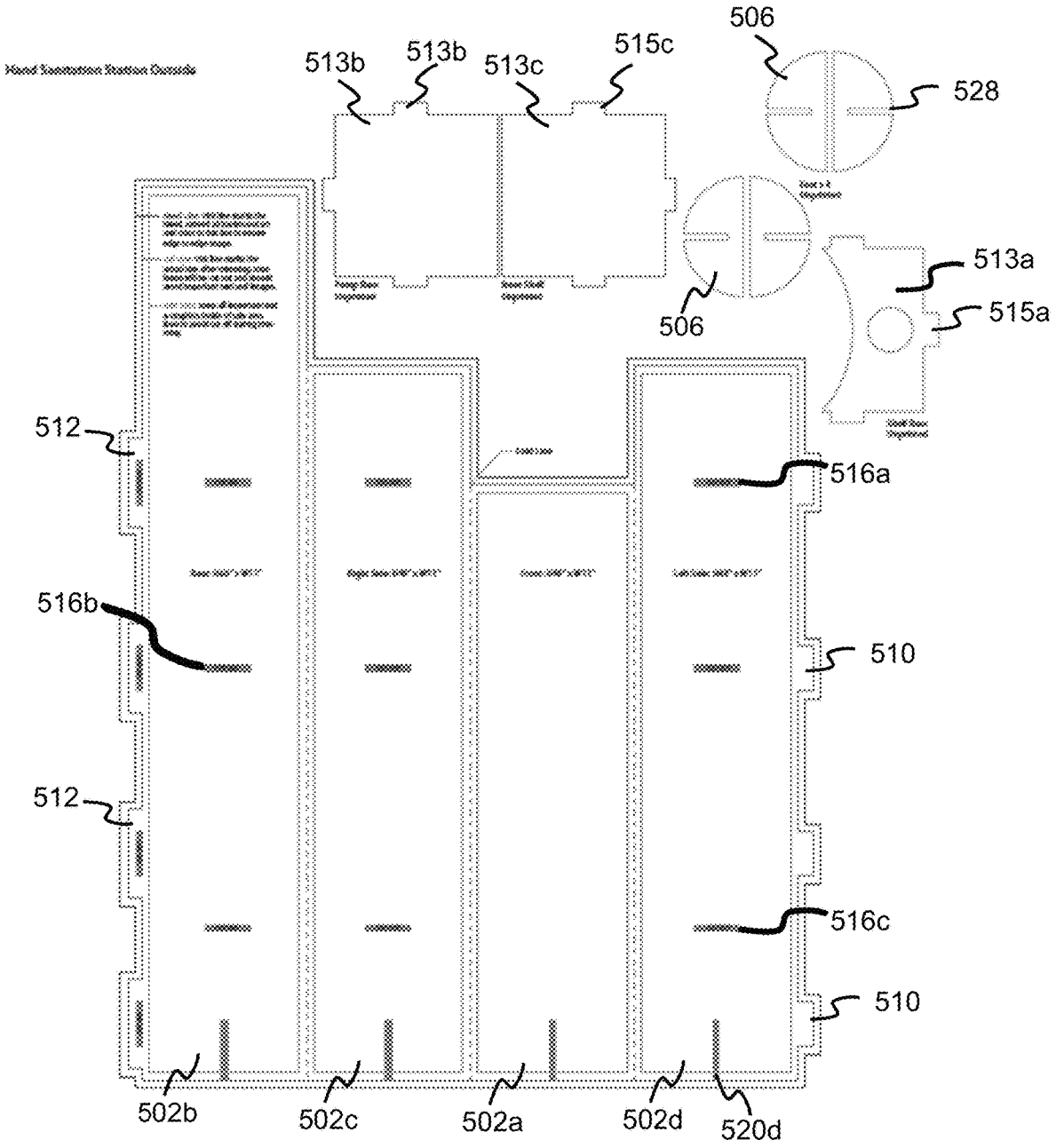
FIG. 5A depicts a layout design of a dispensing station according to an embodiment.

FIG. 5A depicts a design layout for a dispensing station on a single piece of sheet material, such that when the designs of the components for the dispensing station are removed, freed, cut, and/or punched out of the sheet material according to the outlines, the components may be easily packed, shipped, and/or assembled to create a tangible dispenser station. FIG. 5A depicts a layout to scale. In other embodiments, the design layout may be formatted for more than one piece of sheet material. For example, each component may require a separate piece of sheet material. The design layout in various embodiments may be made directly on the sheet material, on paper representing the sheet material, or on a computing device as a representation of the sheet material (e.g., digitally). It is contemplated that the liquid dispensing pump can be cut from the sheet material by methods well known in the art (e.g., cutting by scissors, die stamping, laser cutting). The layout includes outlines for wall panels 502, shelves 513, and supporting feet 506. The shelves 513 further comprise a pump passthrough shelf 513*a*, a container shelf 513*b*, and a storage shelf 513*c*.

The wall panels 502 each comprise wall panel shelf slots 516. Wall panel 502*c*, a side wall panel, further comprises wall panel tabs 510, and wall panel 502*b*, a rear wall panel, further comprises wall panel slotted tabs 512. The wall panel tabs 510 may be removably inserted into the wall panel slotted tabs 512. The wall panels depicted in FIG. 5A include lengths ranging from 48 inches to 60 inches. The widths of each wall panel is 11 inches. These dimensions advantageously create a square footprint for the dispensing station no greater than 144 inches square in area.

The shelves 513 each comprise at least one shelf tab 515. The shelf tabs 515 may be removably inserted into the wall panel shelf slots 516. The shelf tabs 515 and the wall panel shelf slots 516, are configured to place the shelves on the interior of an assembled dispensing station in a substantially horizontal position. In the embodiment of FIG. 5A, the wall panels 502 are hingeably and foldably connected along fold lines 524. The wall panels 502 are capable of folding to substantially ninety degree angles to form a dispensing station interior with a substantially square footprint. The shelves 513 are configured to be positioned within the interior of the dispensing station; the shelf tabs 515*a* insert into wall panel shelf slots 516*a*; the shelf tabs 515*b* insert into wall panel shelf slots 516*b*, and the shelf tabs 515*c* insert into wall panel shelf slots 516*c*.

The pump passthrough shelf 513*a* is configured to be positioned within the interior of an assembled dispensing station with the front edge 524 of the pump passthrough shelf 513*a* facing towards the wall panel 502*a*, the front wall panel, in a physically assembled dispensing station. It is envisioned that the pump passthrough shelf 513*a* may support any number of items beneficial to users of a dispensing station, including but not limited to disposable gloves, disposable masks, and disposable napkins.

The container shelf 513*b* is configured to support a container of liquid and be positioned within the interior of an assembled dispensing station below the pump passthrough shelf 513*a* according to the embodiment of FIG. 5A. The wall panel shelf slots 516*b* are positioned at a distance below the wall panel shelf slots 516*a* so that shelves, when inserted into the wall panel shelf slots 516, provide space for a conventional one gallon container of liquid sanitizer to sit on container shelf 514*b* and below pump passthrough shelf 513*a* while allowing a liquid dispensing pump to stick through the opening 522 of the pump passthrough shelf 513*a*. This arrangement provides users access to the pump in order to actuate the pump and dispense liquid sanitizer. It is envisioned that the pump passthrough shelf 513*b* may support any number of items beneficial to users of a dispensing station, including but not limited to disposable gloves, disposable masks, and disposable napkins.

The storage shelf 513*c* is configured to support a backup and/or empty container of liquid or other materials (e.g., masks, gloves), and be positioned within the interior of an assembled dispensing station below the container shelf 513*a*. It is envisioned that storage shelf 513*c* may support any number of items beneficial to users of a dispensing station, including but not limited to disposable gloves, disposable masks, and disposable napkins.

The outlines of the supporting feet 506 are designed so when they are removed, cut, or punched out of sheet material, the supporting feet notches 528 intersect with the wall panel notches 520 to provide additional stability to an assembled freestanding dispensing station. Once inserted into the wall panel notches 520, the support feet 506 are positioned to be vertical and substantially normal to the broadside plane of the wall panel 502 that it has intersected with.

Figure 5B:
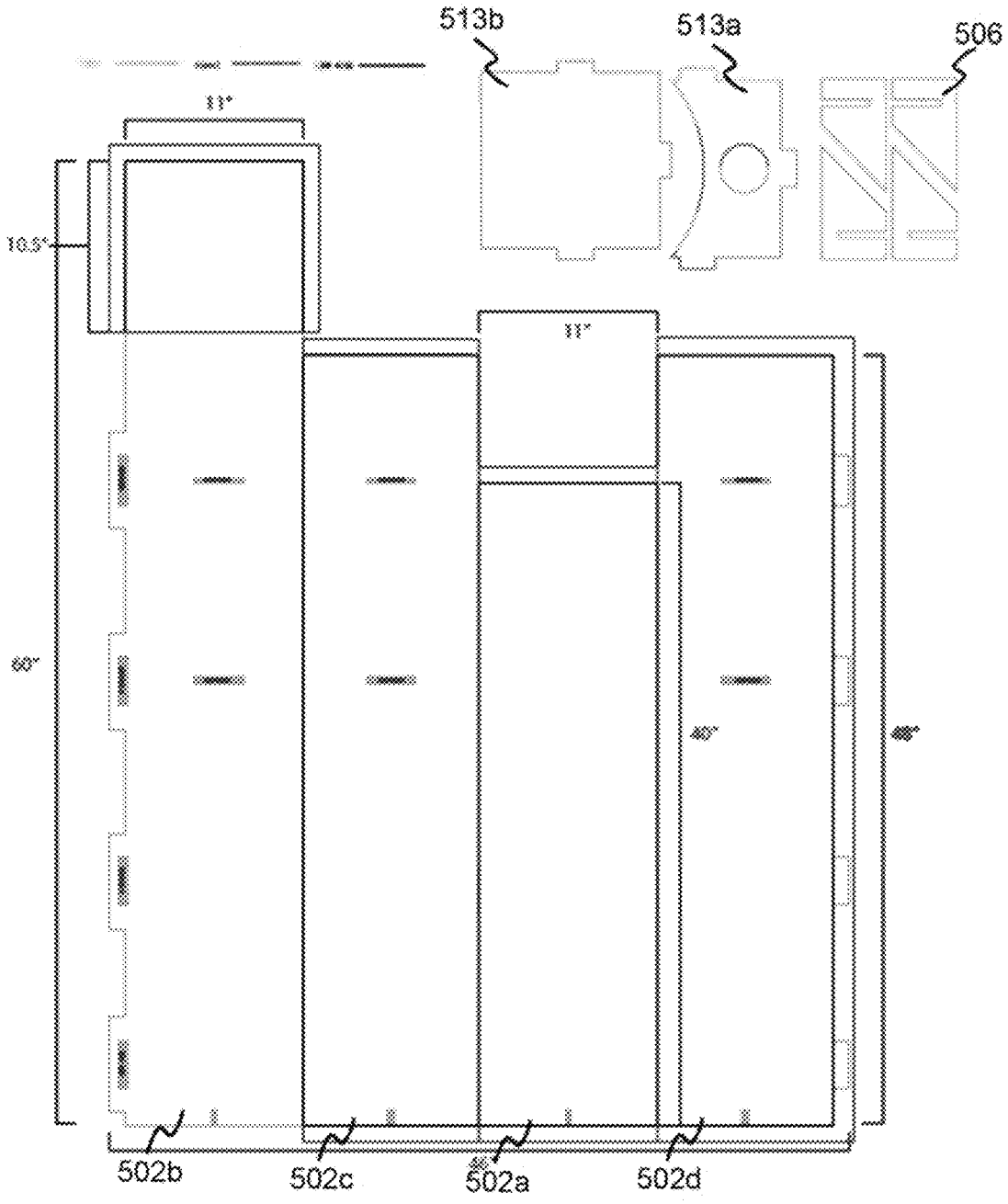
FIG. 5B depicts a layout design of a dispensing station according to an embodiment.

FIG. 5B depicts a design layout for a dispensing station on a single piece of sheet material. The embodiment of FIG. 5B includes supporting feet 506, each with a shape comprising right trapezoids that further comprise supporting feet notches 528. It is contemplated that the dispensing station can be cut from the sheet material by methods well known in the art (e.g., scissors, die cutting, laser cutting). The layout includes outlines for wall panels 502, shelves 513, and supporting feet 506. The shelves 513 further comprise a pump passthrough shelf 513*a* and a container shelf 513*b*. In the embodiment depicted in FIG. 5B, the length of the tallest wall panel, the rear wall, is 60 inches, wherein the shortest wall panel, the front wall, measures 40 inches high. The side wall panels each measure 48 inches tall. Each wall panel is configured for a width of 11 inches.

Figure 5C:
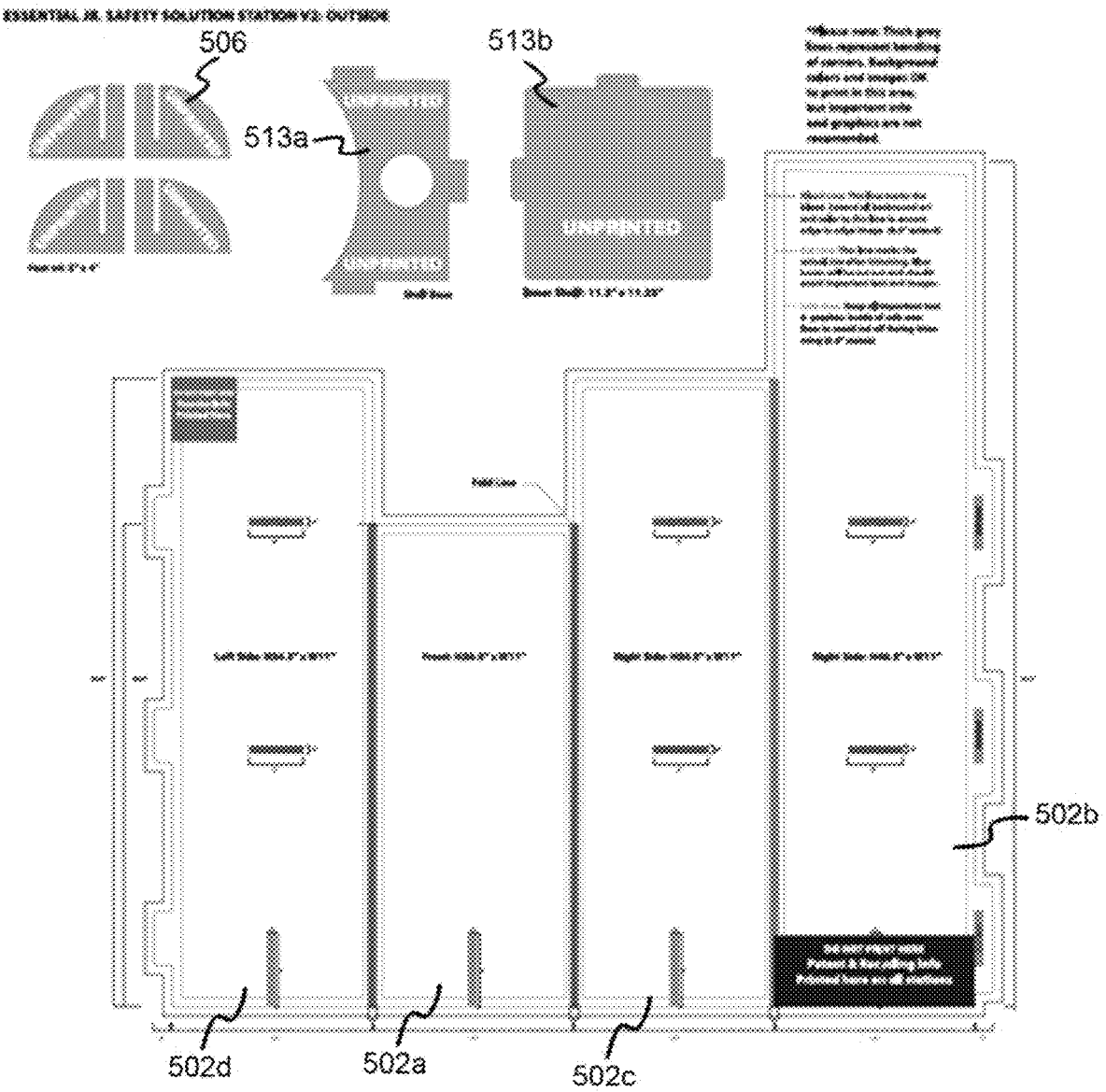
FIG. 5C depicts a layout design of a dispensing station according to an embodiment.

FIG. 5C depicts a design layout for a dispensing station on a single piece of sheet material according to an embodiment. The design layout is configured to be better suited for children and includes supporting feet 506, each supporting foot 506 comprising a shape that resembles an elongated quarter circle and further comprising supporting feet notches 528. It is contemplated that the dispensing station can be cut from the sheet material by methods well known in the art (e.g., scissors, die cutting, laser cutting). The layout includes outlines for wall panels 502, shelves 513, and supporting feet 506. The shelves 513 further comprise a cover shelf 513*a* and a container shelf 513*b*.

In the embodiment shown in FIG. 5C, the wall panel widths are each 11 inches. The tallest wall panel measures 46.5 inches tall, and the side wall panels each measure 34.45 inches tall. The front wall panel measures 24.5 inches high. The pedal measures approximately 9 inches long by 4 inches wide. The supporting feet are approximately 5 inches long by four inches high. The container shelf measures 11.3 inches by 11.25 inches while the cover shelf measures 11.3 inches by 11.25 inches.

Figure 5D:
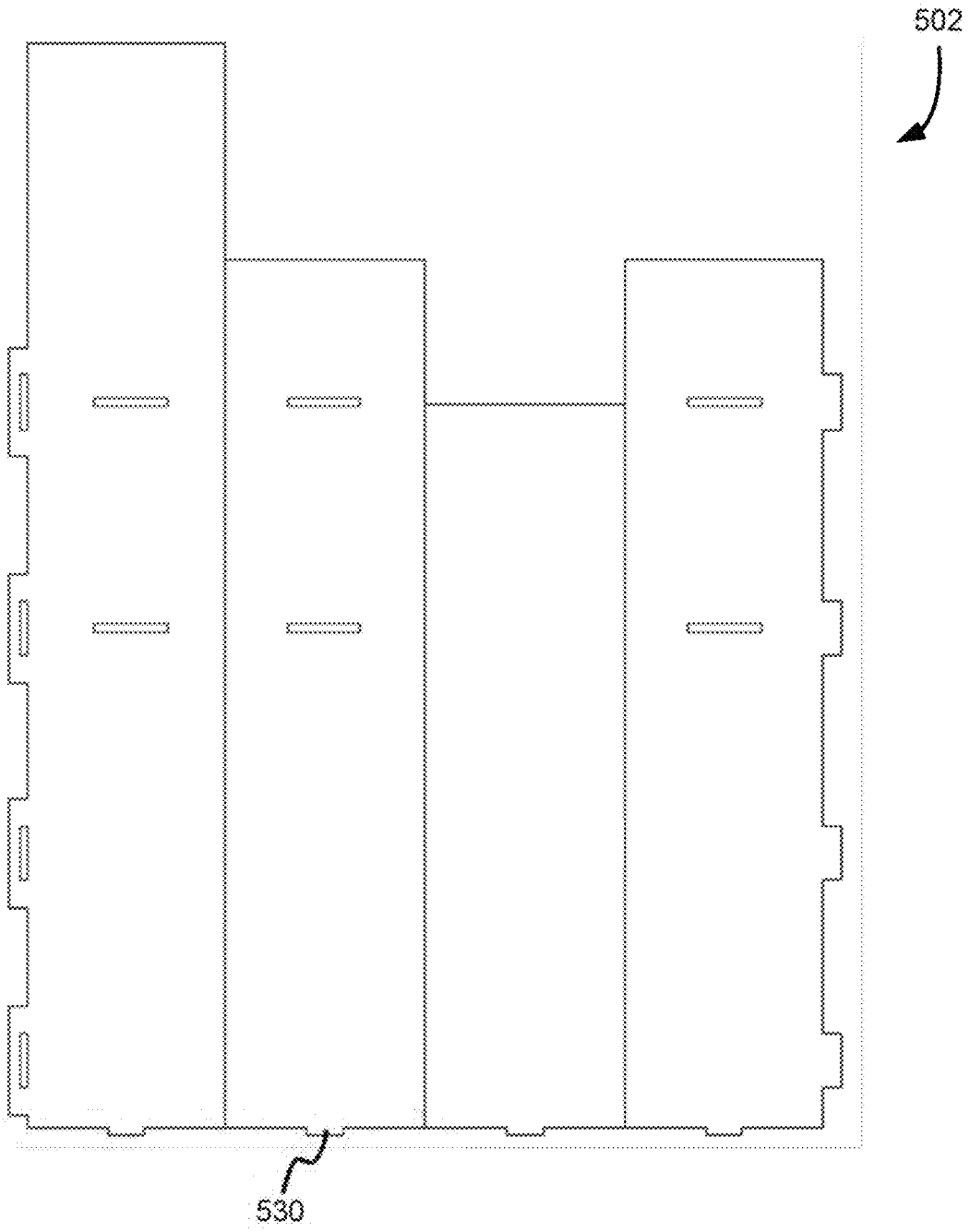
FIG. 5D depicts a layout design of a dispensing station according to an embodiment.
Figure 5E:
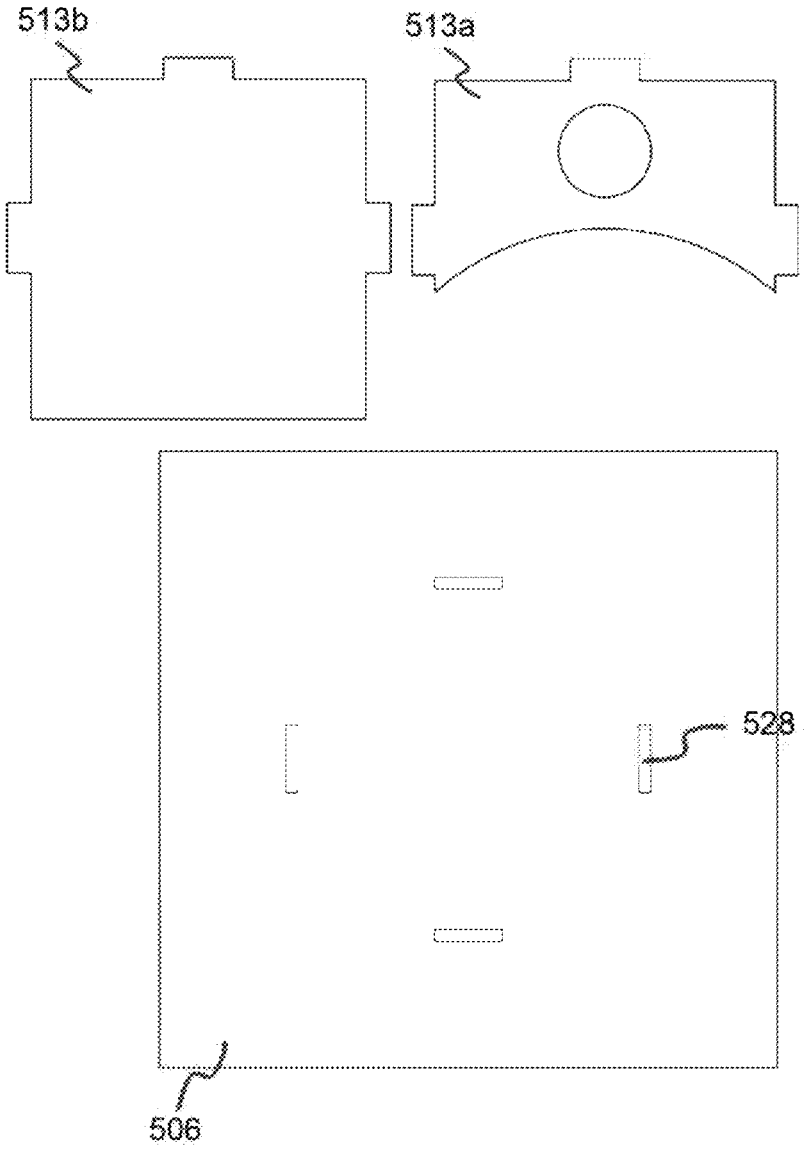
FIG. 5E depicts a layout design of a dispensing station according to an embodiment.

FIGS. 5D-5E depict a design layout for a dispensing station to be fabricate from sheet material. The embodiments contained in FIGS. 5D-E includes a single supporting foot 506 comprising an outline in the shape of a square and further comprising outlines for supporting foot notches 528. The layout includes outlines for wall panels 502, and shelves 513. The shelves 513 further comprise a pump passthrough shelf 513*a* and a container shelf 513*b*. The supporting foot 506 layout is designed so when it is removed, cut, or punched out of sheet material, its supporting foot notches 528 intersect with the wall panel foot tabs 530 to provide additional stability for an assembled freestanding dispensing station. Once inserted into the wall panel foot tabs 530, the supporting foot 506 is oriented to be flat to the ground.

Figure 5F:
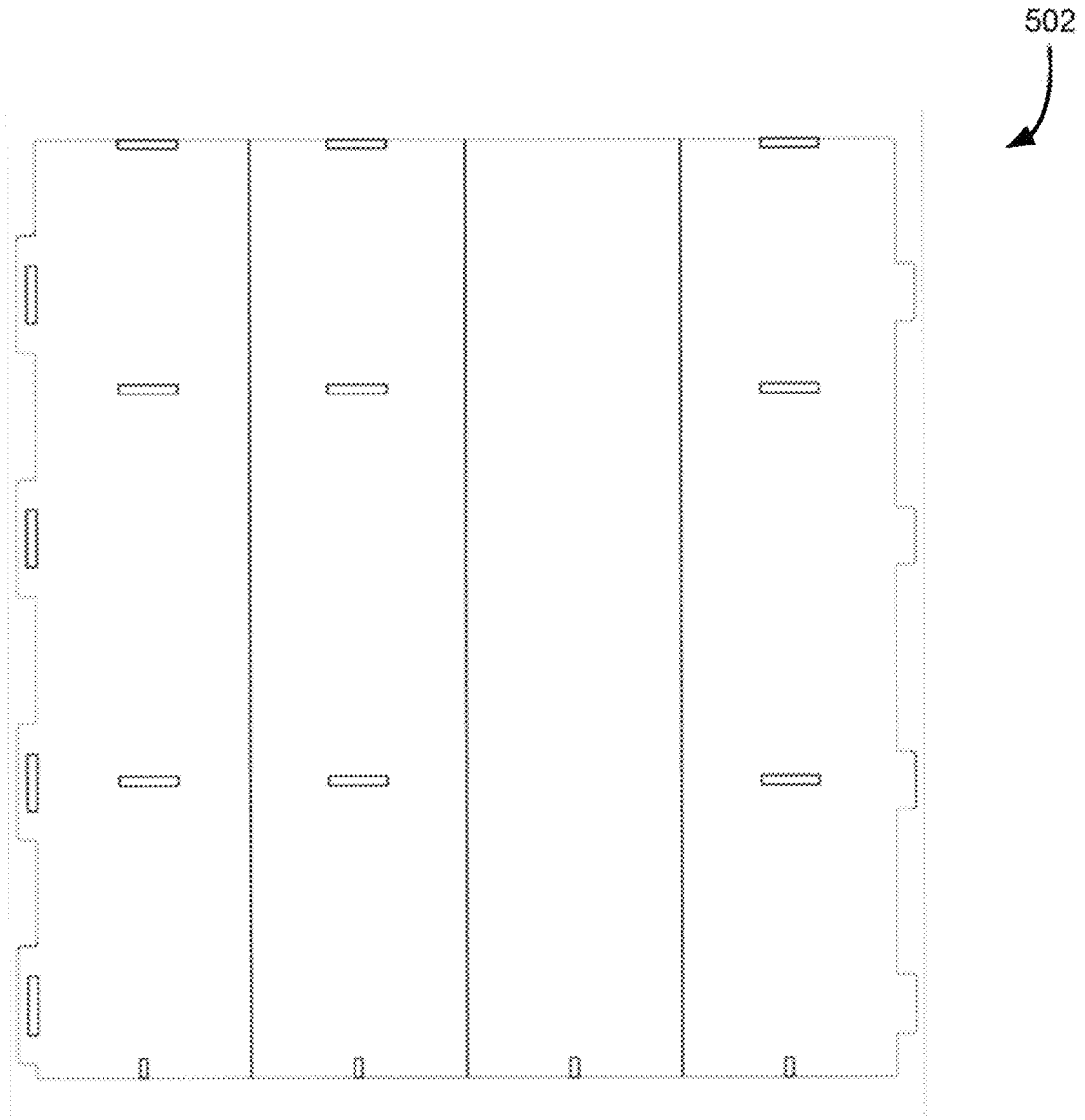
FIG. 5F depicts a layout design of a dispensing station according to an embodiment.

FIG. 5F depicts a design layout for wall panels according to an embodiment. The wall panels 502 are all of equal length.

Figure 5G:
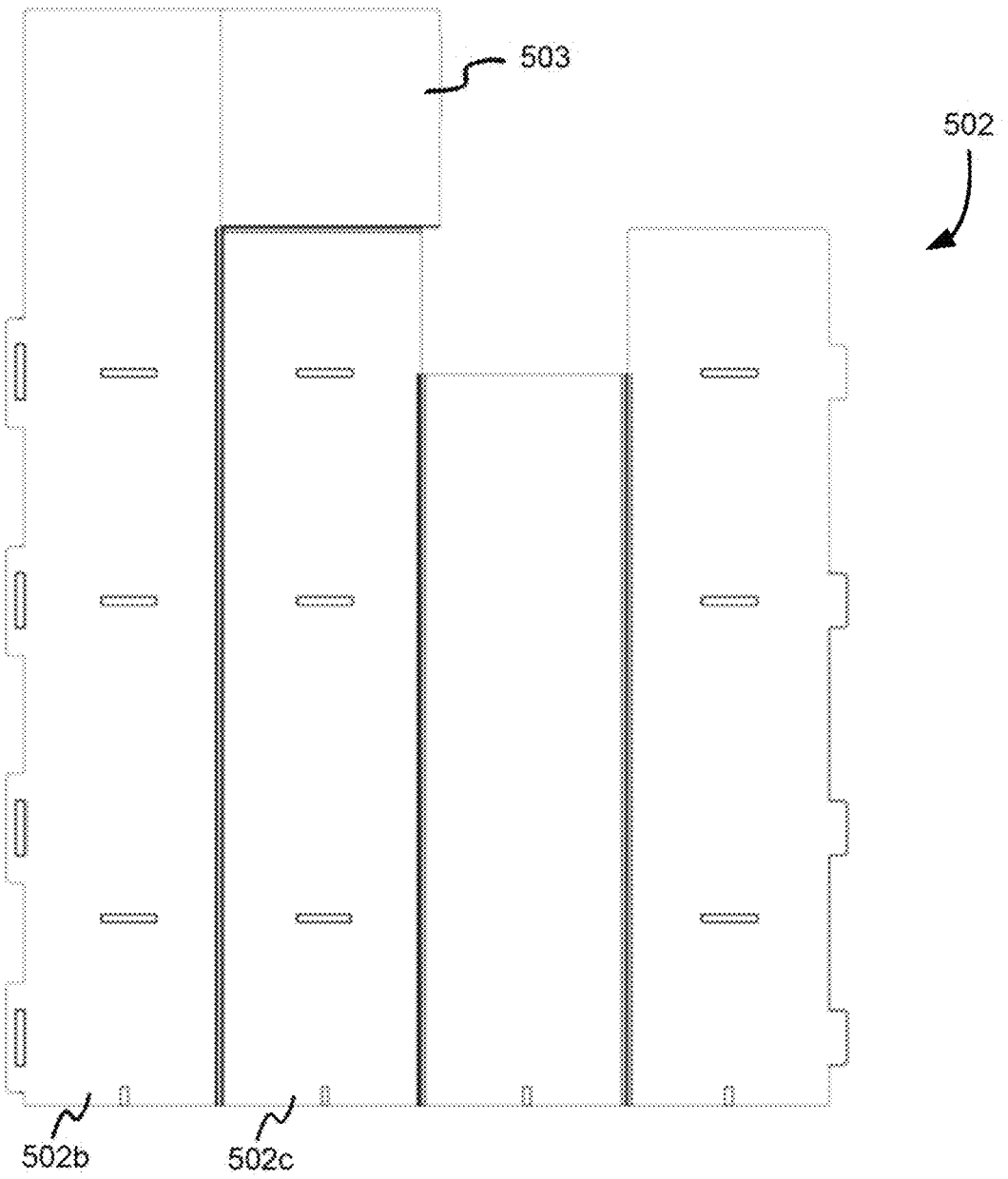
FIG. 5G depicts a layout design of a dispensing station according to an embodiment.

FIG. 5G depicts a design layout for wall panels according to an embodiment. The wall panel 502*b*, which would be the rear wall panel in an assembled dispensing station, further comprises a extension panel 503 to provide extra area for printing. In another embodiment, the wall panel 502*c*, which would be the left side wall panel in an assembled dispensing station, further comprises the extension panel 503.

Figure 5H:
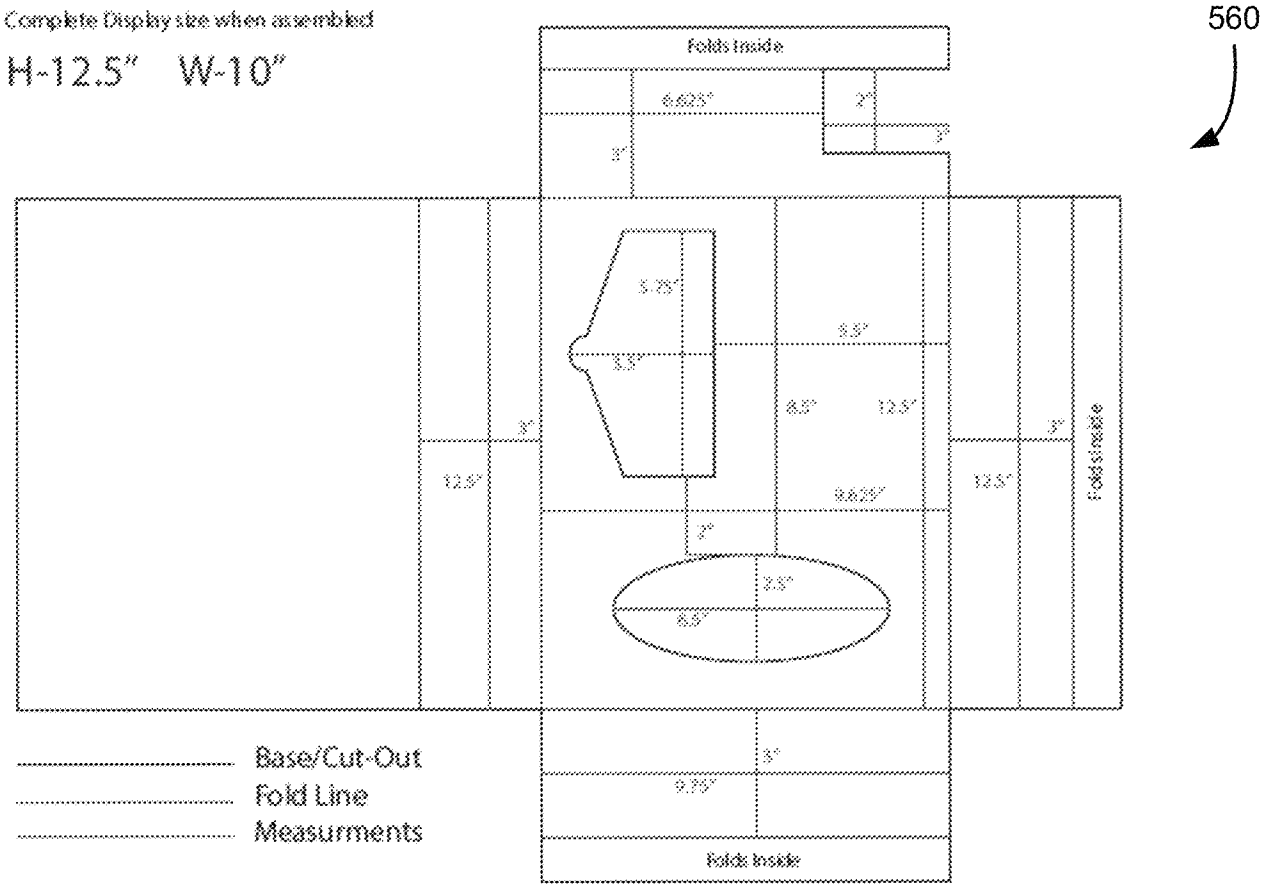
FIG. 5H depicts a layout design of a dispensing station box according to an embodiment.

FIG. 5H depicts a design layout for a foldable box 560 that may be mounted to or placed on an assembled dispenser station. Once punched out of sheet material, the foldable box may be assembled to contain and dispense items such as disposable gloves, masks, and/or napkins. The box, when assembled, measures approximately 12.5 inches high by 10 inches wide by 3 inches deep.

Figure 5I:
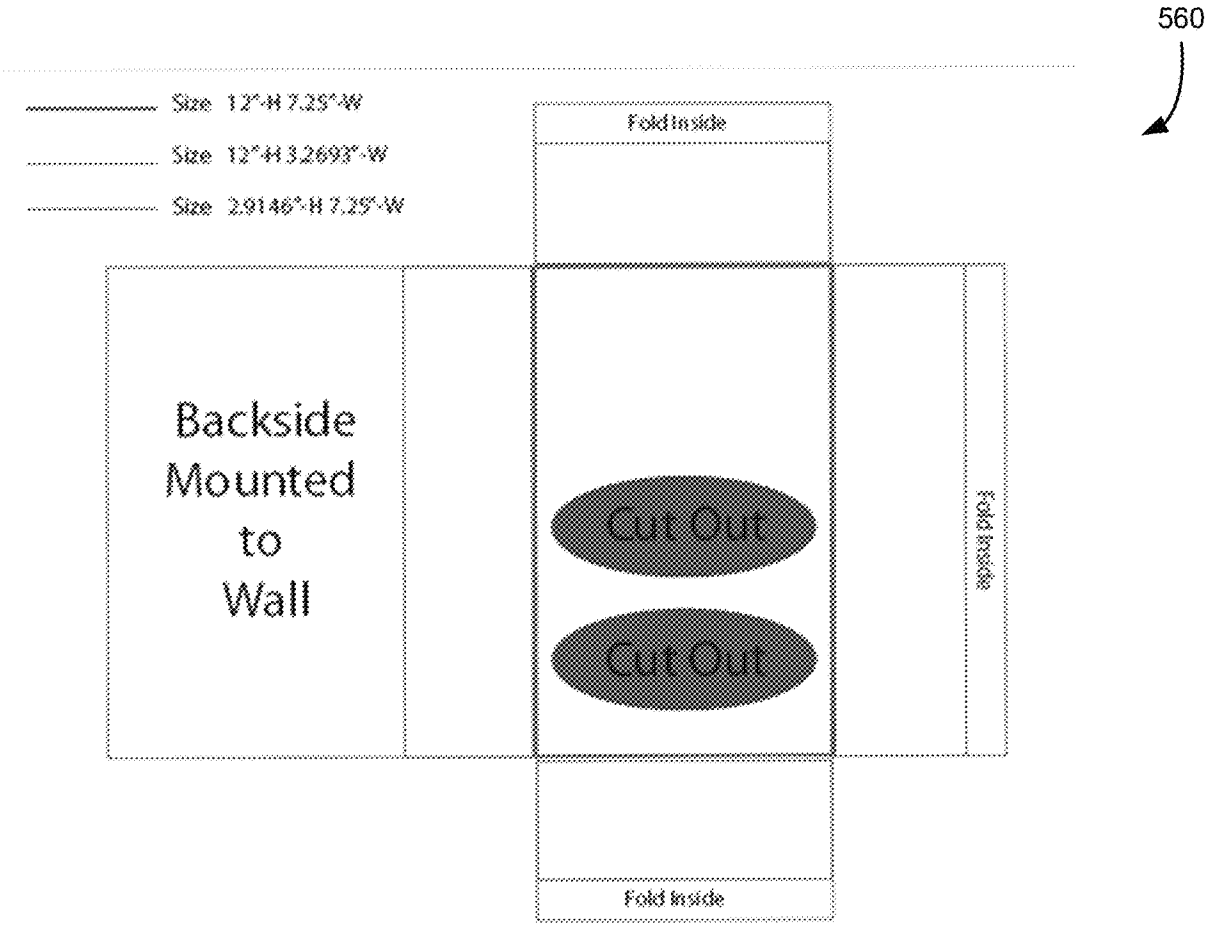
FIG. 5I depicts a layout design of a dispensing station box according to an embodiment.

FIG. 5I depicts a design layout for another embodiment of a foldable box 560 that may be mounted to or placed on an assembled dispenser station. The foldable box may be mounted by an suitable means such as adhesion, hook and loop fasteners, double-sided tape and the like. The box, when assembled, measures approximately 12 inches high by 7.25 inches wide by 3 inches deep.

Figure 6:
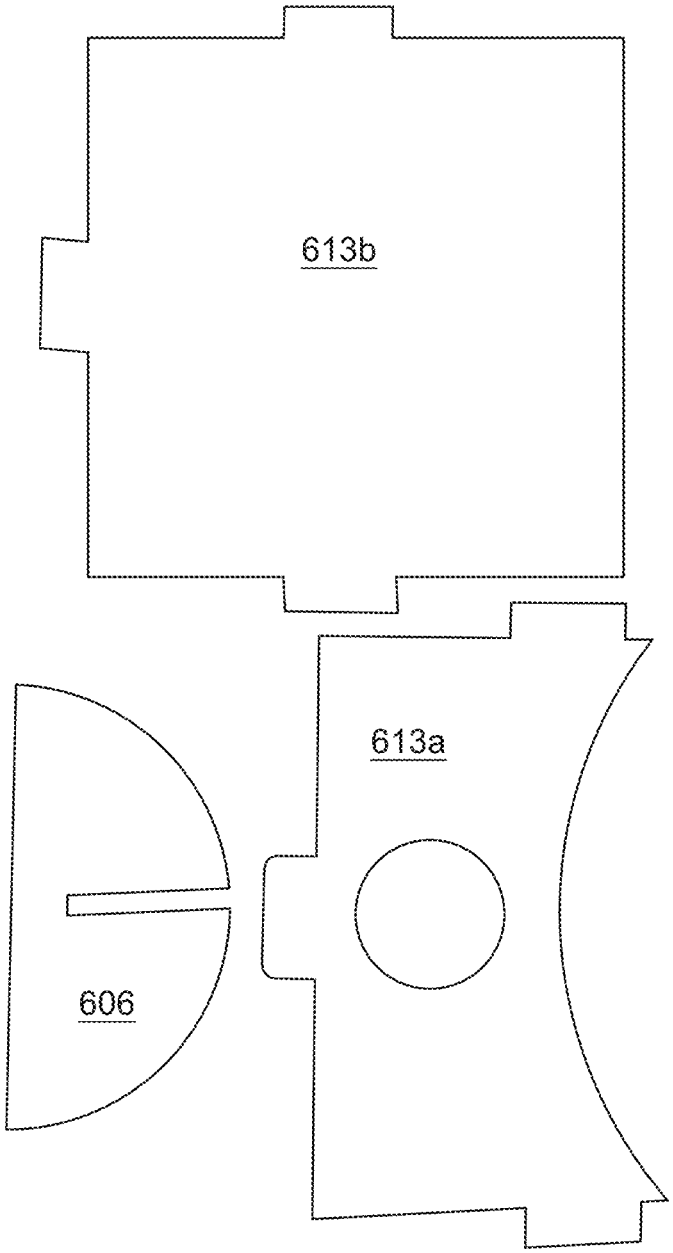
FIG. 6 depicts a dispensing station according to an embodiment.

FIG. 6 depicts a perspective view of punched out components of the dispensing station according to an embodiment. The components include a pump passthrough shelf 613*a*, container shelf 613*b*, and a supporting foot 606. The corrugation of the sheet material is partially visible. The thickness of the dispenser station components will vary with the thickness of the sheet material used. Conventional thicknesses for corrugated plastic sheets include 2 mm, 3 mm, 4 mm, 5 mm, 6 mm, 8 mm, and 10 mm although it is contemplated that a wide variety of other thicknesses may be used for the invention. In other embodiments, the thickness of the dispensing station components may vary from component to component, which may result from the availability of sheet material, the structural requirements of the station, or other reasons apparent to those skilled in the art.

Folding Wall Panels According to an Embodiment

Figure 7A:
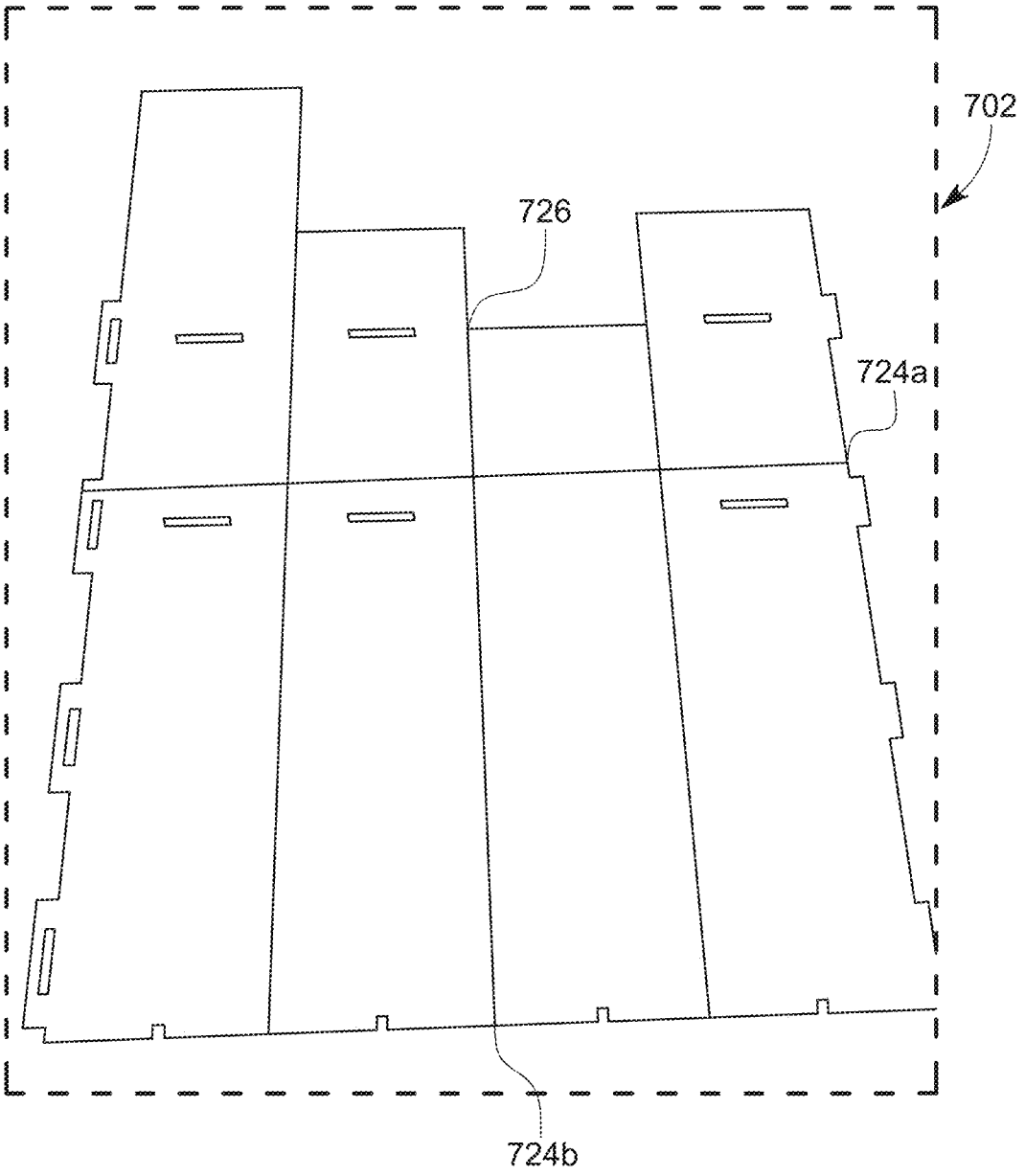
FIG. 7A depicts unfolded wall panels of a dispensing station according to an embodiment.

FIGS. 7A-D depict the folding of wall panels 702 into a compact configuration better suited for handling, packaging, and shipping. In this embodiment, the exterior surfaces of a physically-assembled station comprises examples of printing. Anything suitable for printing on the sheet material of a dispenser station may be printed on wall panels (e.g., branding, ad copy, schedule information, symbols indicating the station's utility such as sanitizer dispensing, design patterns, event guidelines, high-visibility colors, directional information to guide guests along a path). FIG. 7A depicts fully unfolded wall panels 702 laid flat and made from a single piece of sheet material with the printed side facing up. The wall panels 702 comprise fold lines 724 and cut lines 726. The fold lines 724 and the cut lines 726 do not extend the entire length of the wall panels. In alternate embodiments, the wall panels may be cut from a single piece of sheet material, but then separated into four unconnected wall panels.

Figure 7B:
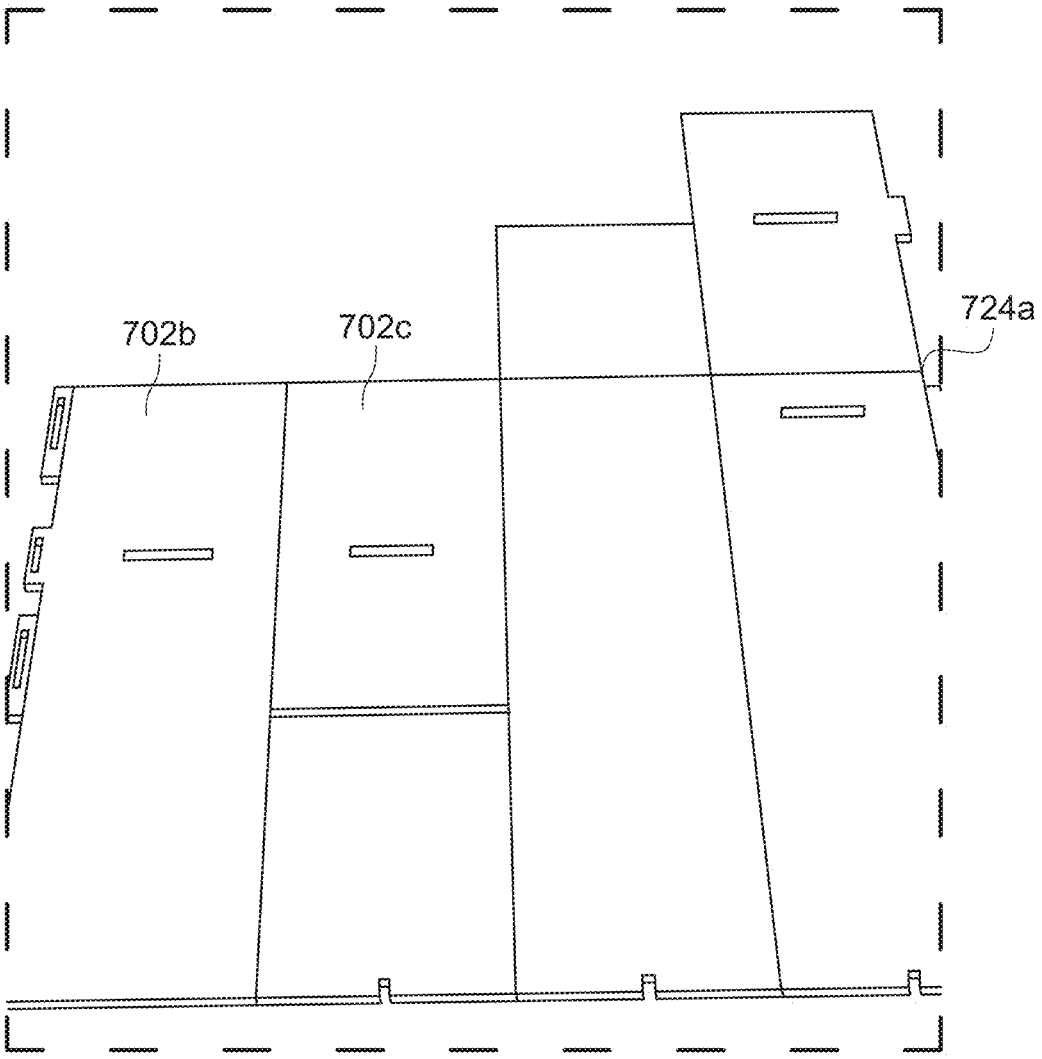
FIG. 7B depicts folded wall panels of a dispensing station according to an embodiment.

FIG. 7B depicts wall panel 702*b*, the rear wall panel of an assembled dispenser station folded along fold line 724*a*. Also folded along fold line 724*a* is wall panel 702*c*, which would be the left side wall panel if facing an assembled dispenser station.

Figure 7C:
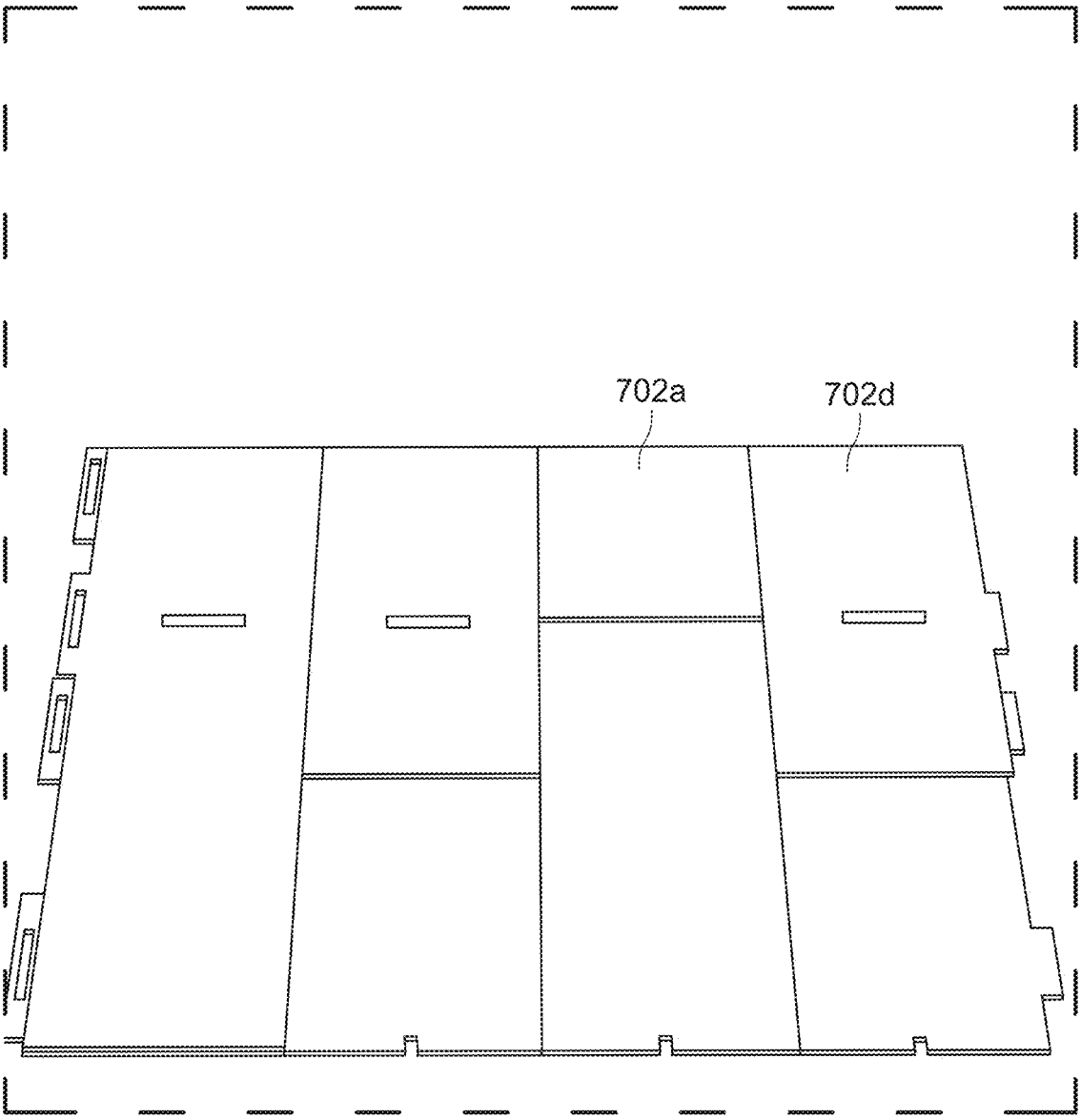
FIG. 7C depicts folded wall panels of a dispensing station according to an embodiment.

FIG. 7C depicts wall panel 702*a*, the front wall panel of an assembled dispenser station folded along fold line 724*a*. Also folded along fold line 724*a* is wall panel 702*d*, which would be the right side wall panel if facing an assembled dispenser station.

Figure 7D:
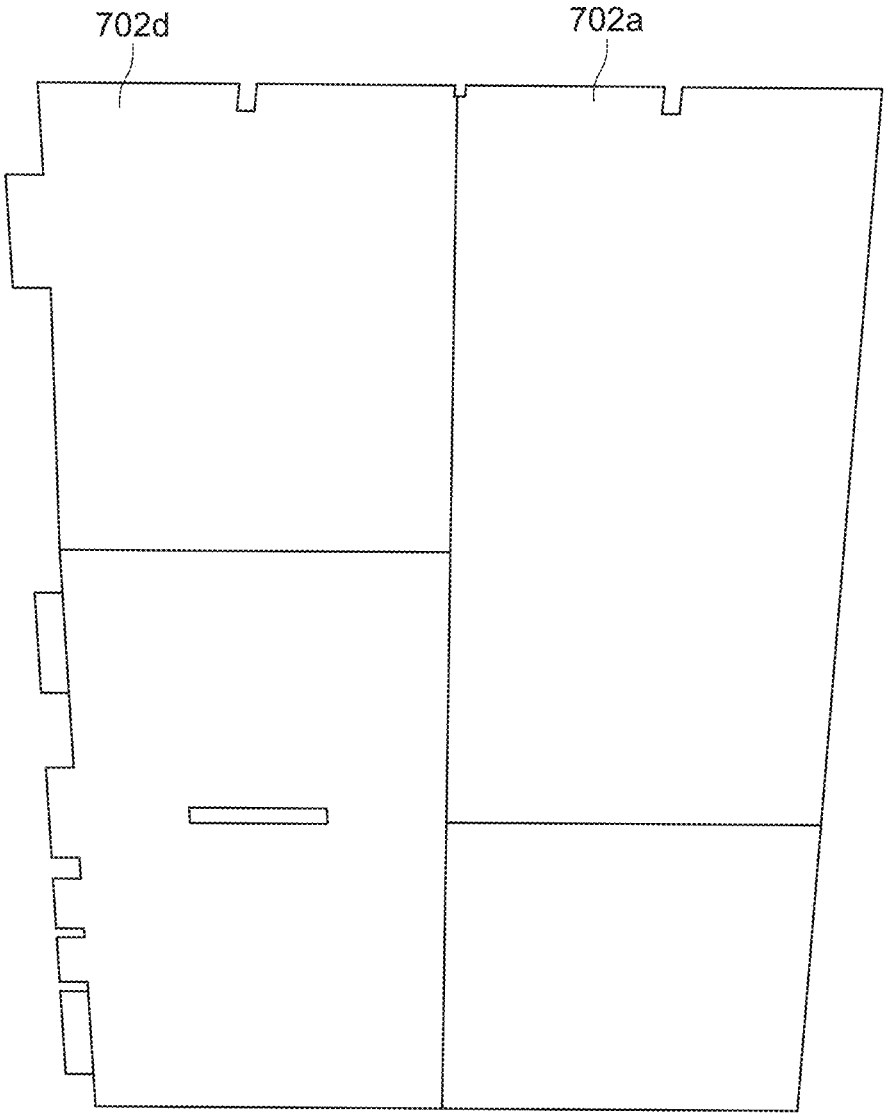
FIG. 7D depicts folded wall panels of a dispensing station according to an embodiment.

FIG. 7D depicts wall panels 702*a*, 702*d* folded over on top of wall panels 702*b*, 702*c*. The shape of the folded wall panels show its most compact form according to this embodiment. The area of these wall panels 702 in this folded form is at least half the area of the wall panels when fully unfolded. While shown in a substantially compact rectangular shape, it is envisioned that wall panels of other embodiments may be configured with additional fold lines and cut lines of various combinations to allow the wall panels to fold into a more compact form comprising many types of shapes (e.g., squares, triangles, trapezoids), and comprise an area approximately approaching one-third or one-quarter the area of the wall panels when fully unfolded.

FURTHER EMBODIMENTS

Figure 8A:
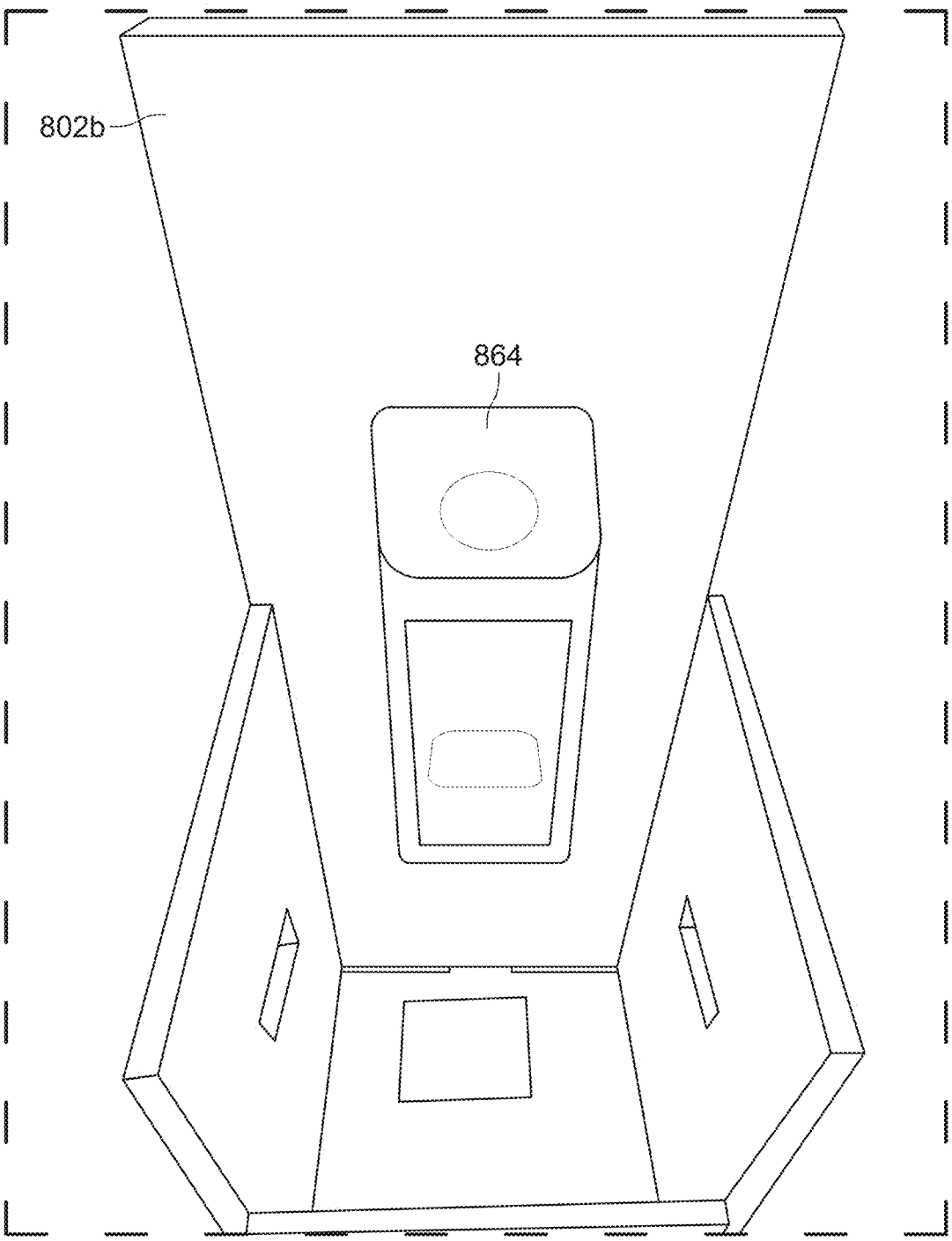
FIG. 8A illustrates a dispensing station with a wall-mounted liquid dispenser according to an embodiment.

FIG. 8A depicts an embodiment of a dispenser station 800. In this embodiment, the container of liquid 864 is affixed to the rear wall panel 802*b*. The container of liquid 864 comprises a dispenser typical for wall-mounted hand dispensers of soap and sanitizer. This embodiment comprises unused wall panel shelf slots 816 for the option of installing a pump passthrough shelf in the event a container or bottle of liquid is used. The wall-mounted liquid dispenser may comprise many types of dispensers including powered touchless dispensers that sense a hand underneath the dispenser, dispensers that require a user to manually pull forward a trigger and the like. The wall-mounted liquid dispenser may be affixed by a variety of means (e.g., adhesion, screws, nails).

Figure 8B:
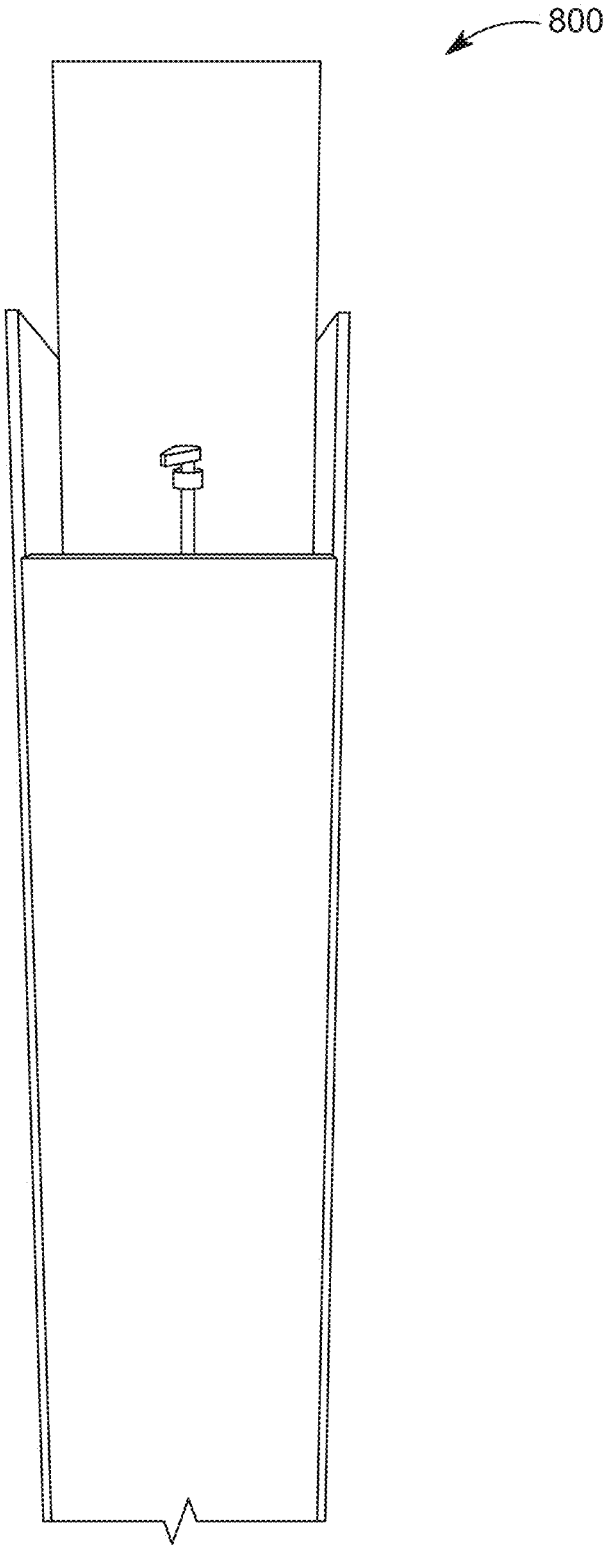
FIG. 8B depicts a front view of a dispensing station according to an embodiment.

FIG. 8B depicts an embodiment of an assembled dispenser station 800. In this embodiment of an assembled dispenser station, no supporting feet are installed.

Figure 8C:
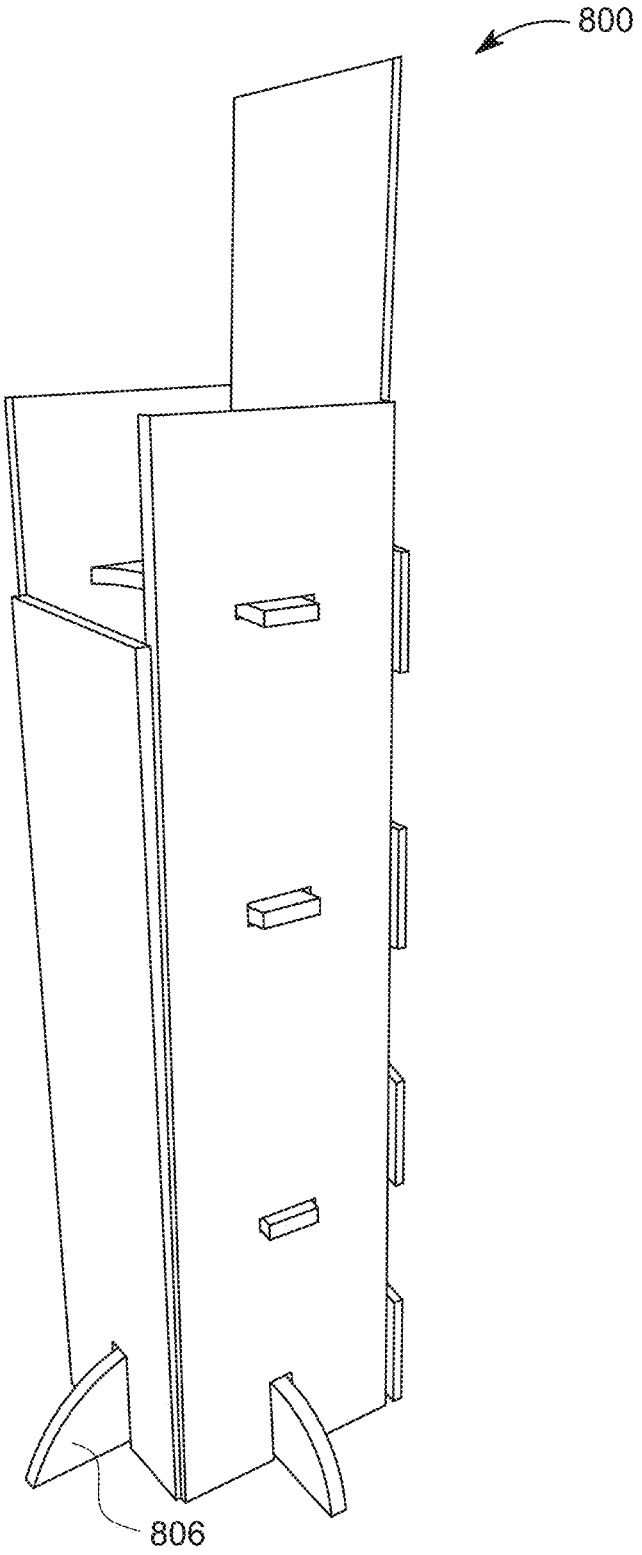
FIG. 8C depicts right-front perspective view of a dispensing station according to an embodiment.

FIG. 8C depicts an embodiment of an assembled dispenser station 800. In this embodiment of an assembled dispenser station, the external portions of the supporting feet 806 are triangular.

Figure 8D:
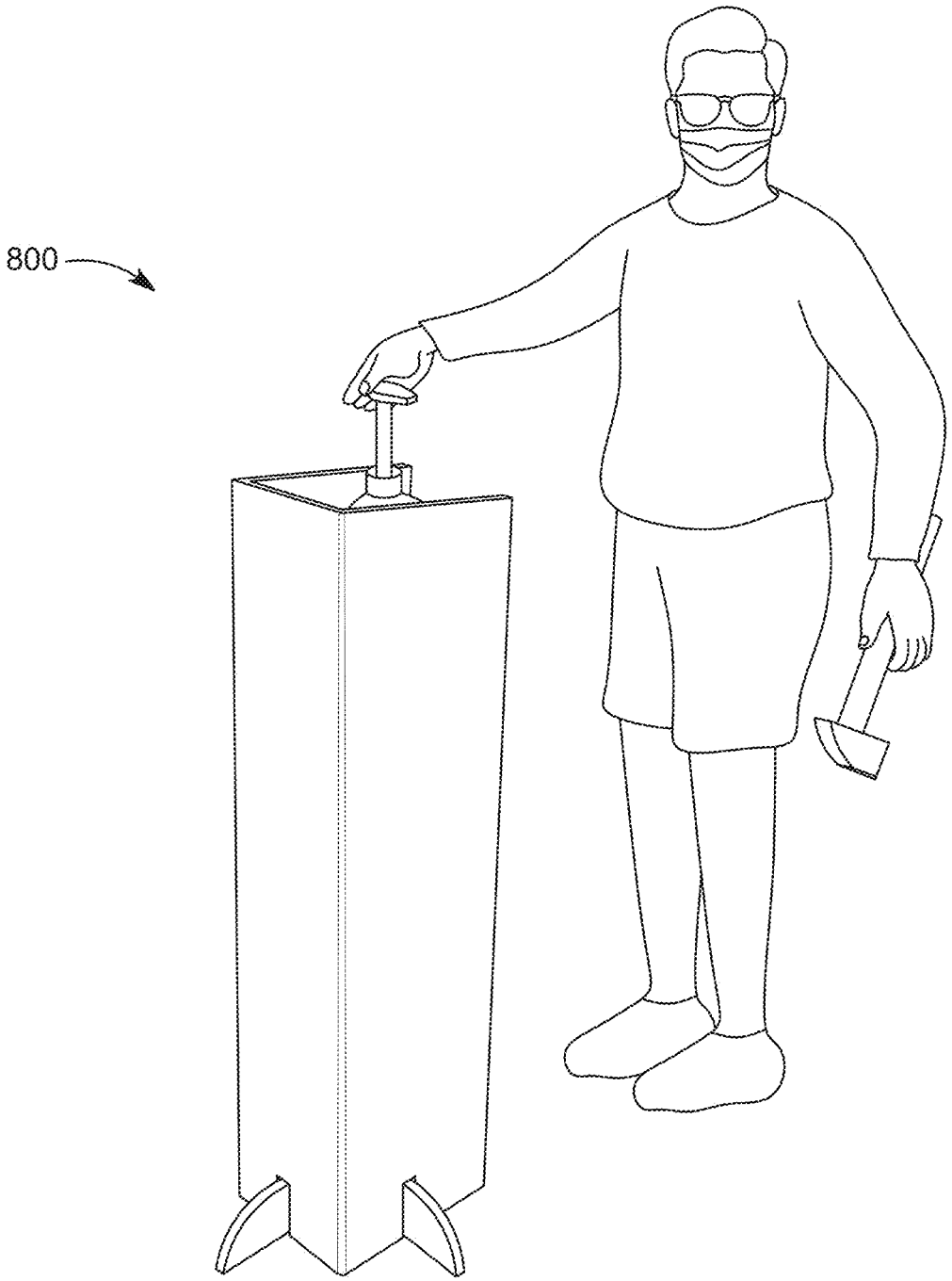
FIG. 8D depicts left-front view of a dispensing station according to an embodiment.

FIG. 8D depicts an embodiment of an assembled dispenser station 800. In this embodiment of an assembled dispenser station, the wall panels 802 are each configured to be the same height, making the pump head visible in 360 degrees.

Pedal-Operated Dispensing Stations

In some embodiments, the dispenser station may feature a foot pedal used to activate a liquid dispensing pump, thus allowing a user to dispense liquid without using hands. Such a pedal-operated dispenser station may sometimes be referred to as a touchless dispensing station.

Figure 9:
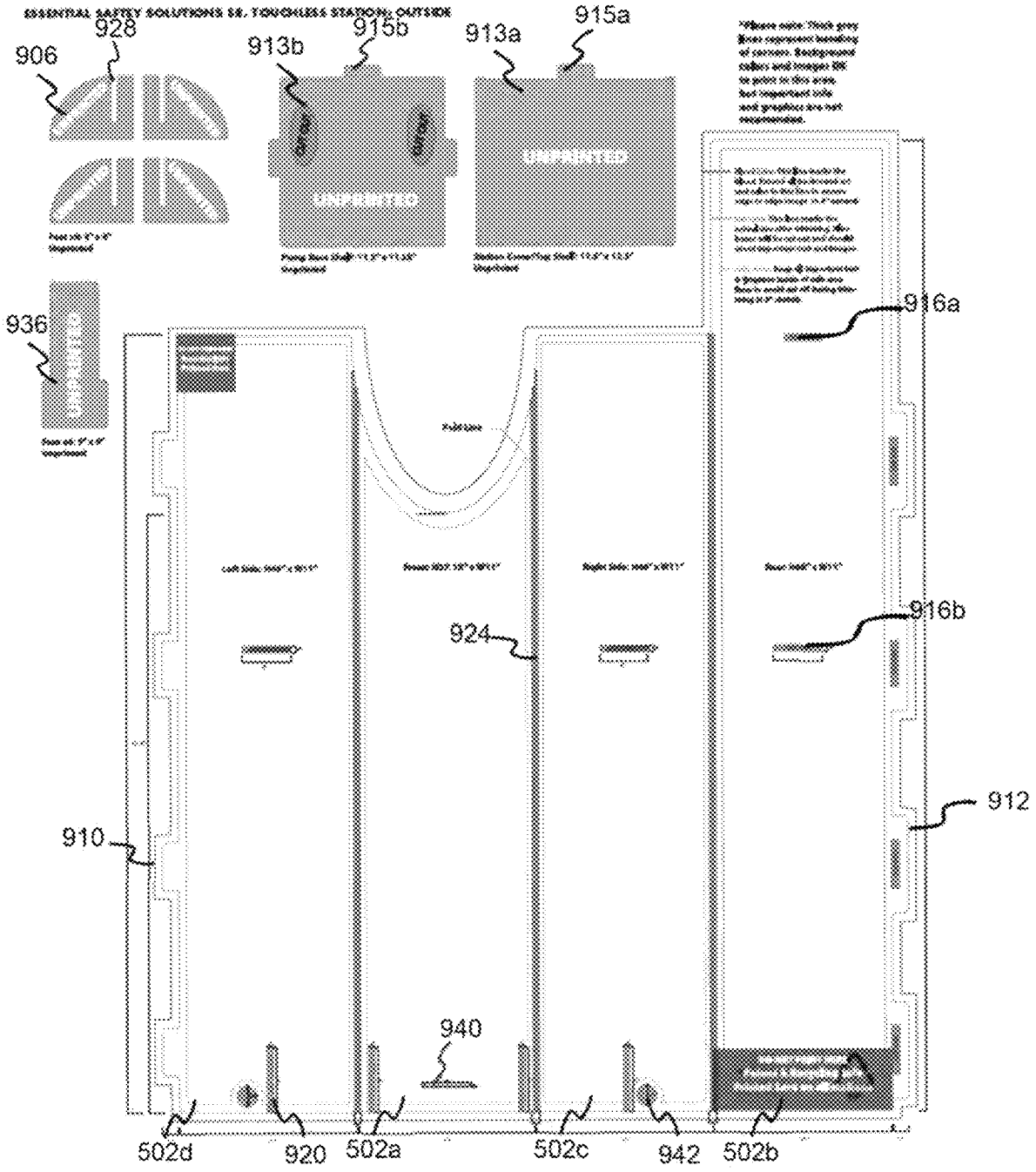
FIG. 9 depicts a layout design of a dispensing station according to an embodiment.

FIG. 9 depicts a design layout for a touchless dispensing station to be cut from a single piece of sheet material, such that when the components of the dispensing station are removed, freed, cut, and or punched out of the sheet material according to the outlines, the components may be easily packed, shipped, and assembled to form a touchless dispenser station. The design layout may be applied directly to sheet material, applied on paper representing the sheet material, or implemented on a computing device (e.g., digitally). It is contemplated that the liquid dispensing pump can be cut from the sheet material by methods well known in the art (e.g., scissors, die cutting, laser cutting). The layout includes outlines for wall panels 902, shelves 913, supporting feet 906, and a pedal 936. The shelves 913 further comprise, a cover shelf 913*a*, and a container shelf 913*b*.

The wall panels 902 each comprise wall panel shelf slots 916. Wall panel 902*d*, a side wall panel, further comprises wall panel tabs 910, and wall panel 902*b*, a rear wall panel, further comprises wall panel slotted tabs 912. The wall panel tabs 910 may be removably inserted into the wall panel slotted tabs 912.

The shelves 913 each comprise at least one shelf tab 915. The shelf tabs 915 may be removably inserted into the wall panel shelf slots 916. The shelf tabs 915 and the wall panel shelf slots 916, are configured to position the shelves on the interior of an assembled dispensing station in a horizontal position. In the embodiment of FIG. 9, the wall panels 902 are hingeably and foldably connected along fold lines 924. The wall panels 902 fold at substantially ninety degree angles (e.g., 85 to 95 degrees) to form a dispensing station interior with a square or rectangular footprint. The shelves 913 are configured to be positioned within the interior of the dispensing station; the shelf tab 915*a* inserts into wall panel shelf slot 916*a*; the shelf tabs 915*b* insert into wall panel shelf slots 916*b*. In an embodiment, the shelf cover 913*a* partially rests on top of two side wall panels, wall panels 902*c* and 902*d* in an assembled station. The single shelf tab 915*a* of shelf cover 913*a* allows, when inserted into an assembled dispenser station, allows the shelf cover 913*a* to be hingeably and removably attached to the rear wall panel 902*b*. As a result, a user may lift the shelf 913*a* to access the interior of the assembled dispenser station.

The container shelf 913*b* is suitable for supporting a container of liquid when positioned within the interior of an assembled dispensing station. The container shelf 913*b* further comprises strap guide openings 938. The wall panel shelf slots 916*b* are positioned at a distance below the wall panel shelf slots 916*a* so that there is space for a conventional one gallon container of liquid sanitizer to sit on container shelf 914*b* and below shelf cover 913*a*. It is envisioned that cover shelf 913*a* and container shelf 913*b* may support any number of items beneficial to users of a dispensing station, including but not limited to disposable gloves, disposable masks, and disposable napkins.

The supporting feet 906 layouts are designed so when they are fabricated out of sheet material, their supporting feet notches 928 intersect with the wall panel notches 920 to provide additional stability to an assembled freestanding dispensing station. Once inserted into the wall panel notches 920, the support feet 906 are positioned to be vertical and substantially normal (85 to 95 degrees) to the broadside plane of the wall panel 902 that it has intersected with.

Wall panel 902*a*, or the front wall panel in an assembled dispenser station, is designed to be shorter than the side or rear wall panels to provide user access to a liquid dispensing pump. The design increases the amount of area on which branding or ad copy may be printed. Wall panel 902*b*, or the rear wall panel, comprises a pedal slot 940 for removably receiving a pedal 936.

In other embodiments, electronic devices (e.g., tablets, monitors, cameras, sensors, tv screens, lights) may be mounted to the dispensing station by various means (e.g., adhesives, screws, nails, hooks, hook and loop fasteners) to provide additional functionality to users (e.g., security, entertainment, signaling).

The side wall panels 902*c* and 902*d* further comprise cross member openings 942 for receiving a cross member as part of a pedal assembly.

Figure 10A:
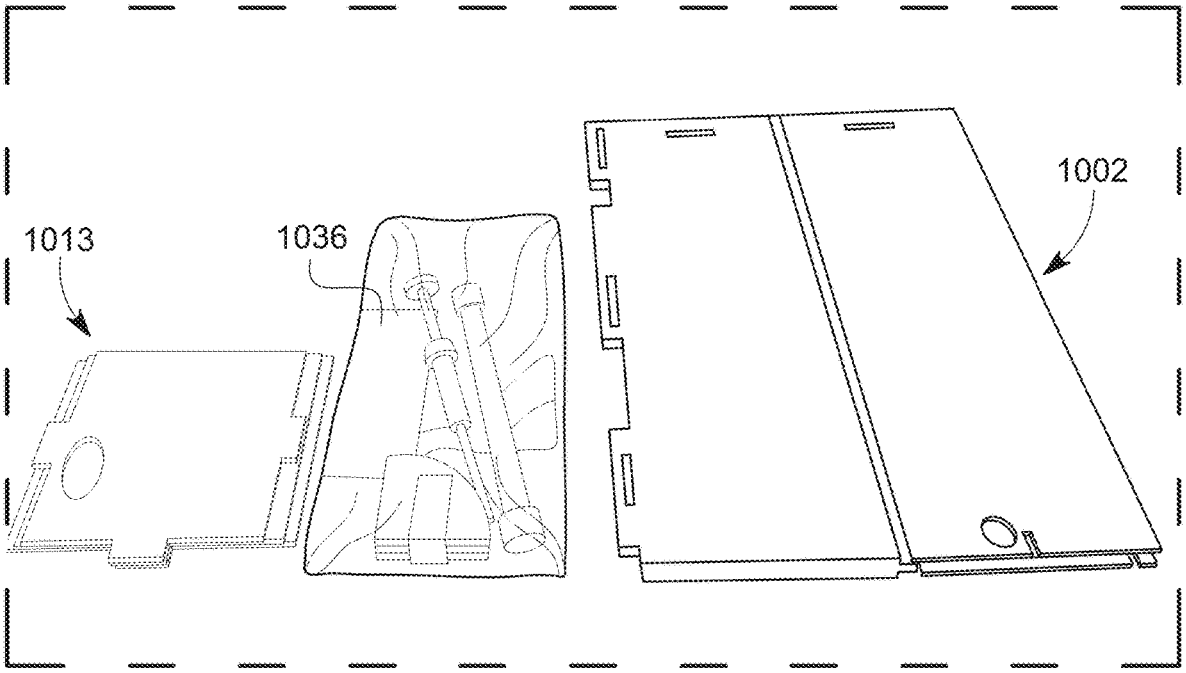
FIG. 10A depicts a disassembled dispensing station according to an embodiment.

FIGS. 10A-10K depict the assembly of a touchless dispensing station according to an embodiment. FIG. 10A illustrates the components of a touchless dispensing station as they might appear shortly after removing those components from a package. The components include wall panels 1002, supporting feet 1006, a liquid dispensing pump 1008, shelves 1013, a cross-member 1032, a strap 1034, and a drip pad 1036. A strap 1034 can be of any relatively flexible yet inelastic material (e.g., nylon, polypropylene) and often take the form of a flat strip or band.

Figure 10B:
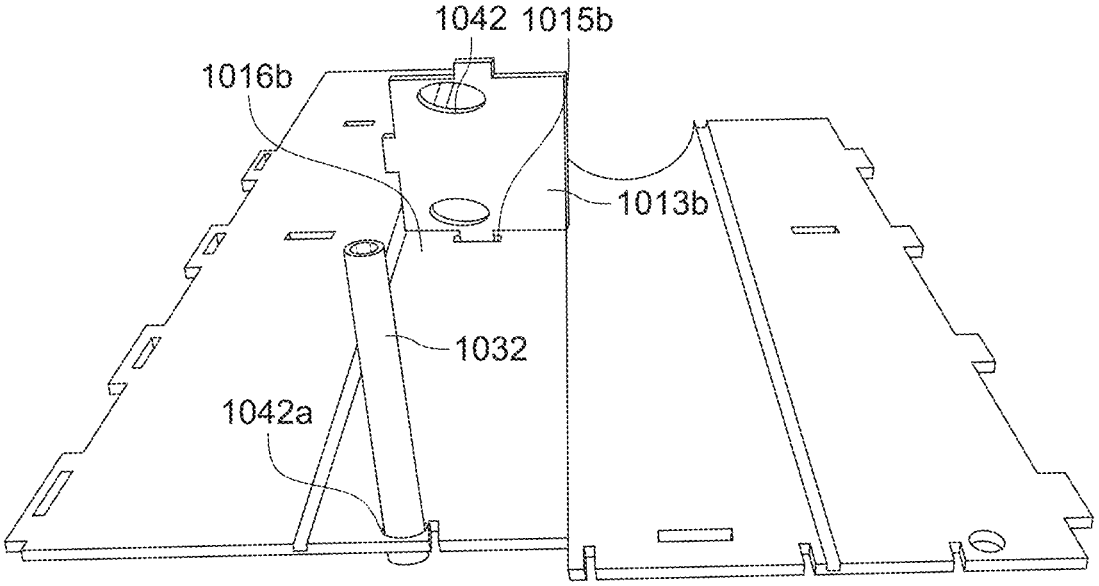
FIG. 10B depicts a dispensing station in the process of being assembled according to an embodiment.

FIG. 10B illustrates the wall panels 1002 fully unfolded and laid flat, with one shelf tab 1015*b* inserted into a wall panel shelf slot 1016*b*, and a cross member 1032 with one of its two ends inserted into cross member opening 1042*a*. The cross member opening 1042 is of a diameter that leaves minimal gaps between the cross member 1032 and the edge of the cross member opening 1042. The cross member may be comprised of any material suitable for bracing against the pressure applied by a strap connected to a depressed pedal and a liquid dispensing pump. Such materials may include plastic, wood, metal, and the like. The cross member 1032 depicted in FIG. 10B is a substantially cylindrical and hollow plastic tube. Such plastic may include polyvinyl chloride (PVC), acrylonitirile butadiene styrene (ABS), high-density polyethylene (HDPE) and the like. In other embodiments, however, the cross member 1032 may comprise other forms and materials such as plastic rods, wooden rods, metal tubes or any other suitable material or forms, including non-cylindrical forms. The cross member may further be comprised of multiple components such as, but not limited to ball bearings installed in the cross member opening to allow a rod to rotate; a rotating wheel affixed to an axle; an adjustable pulley system that alters the tension on the strap.

The container shelf 1013*b* comprises two strap guide openings 1042. The strap guide openings 1042 are shown as generally oval-shaped, but may comprise, in other embodiments, other shapes (e.g., rectangles, squares, circles)

Figure 10C:
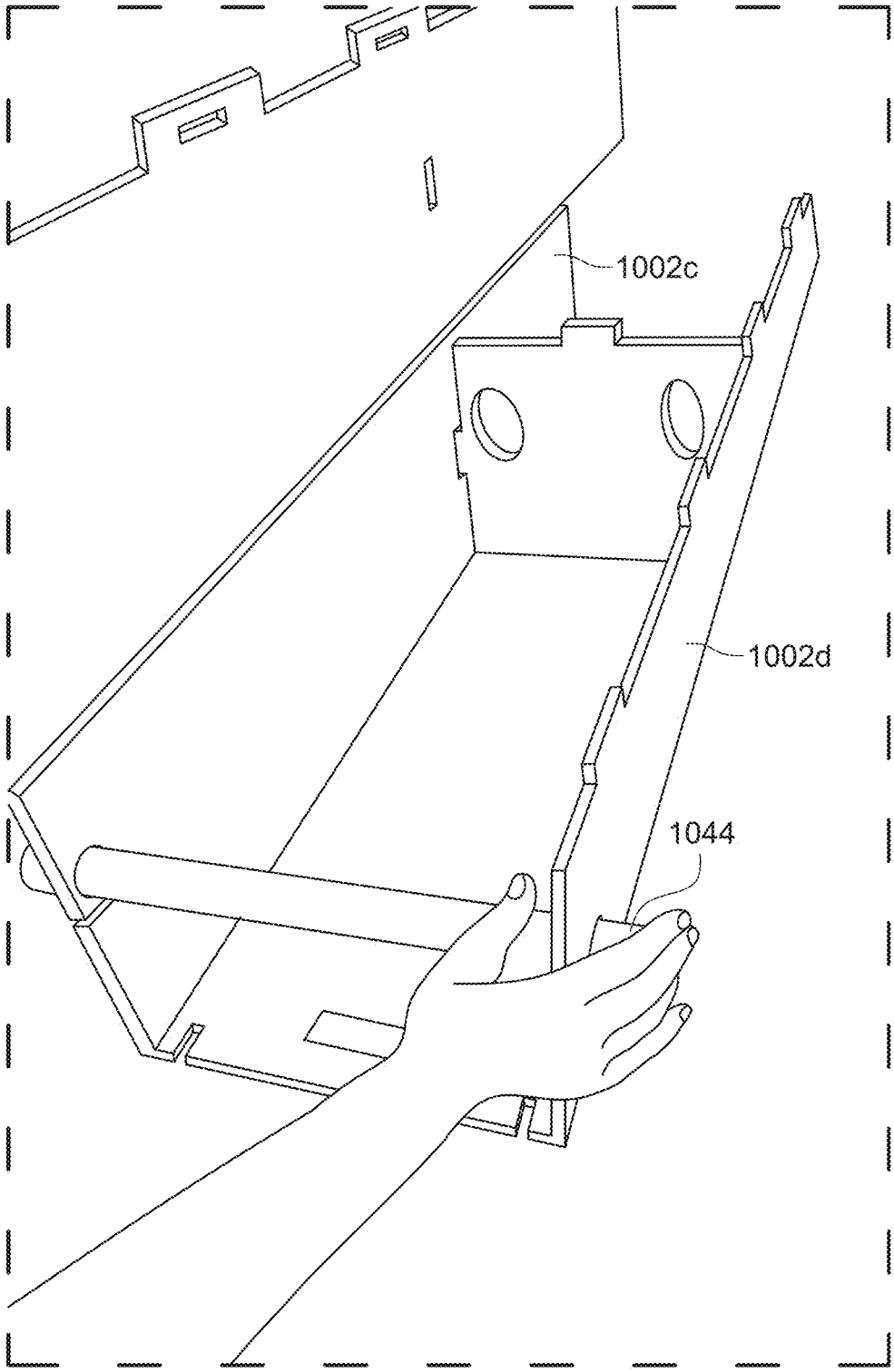
FIG. 10C depicts a dispensing station in the process of being assembled according to an embodiment.

FIG. 10C depicts the folding upwards of wall panels 1002*c* and 1002*d*, and the insertion of the other end of the cross member 1032 through cross member opening 1042*b*. The ends of the cross member 1032 protrude past the wall panels 1002*c* and 1002*d* and are fitted with two end caps 1044, one for each end of the cross member 1032. The end caps 1044 are plastic caps made of a elastomeric material that snugly fits onto the ends of the cross member 1032. The friction caused by the compression of the elastomeric material on the end caps 1044 combined with the diameter of the end caps 1044 being larger than the diameter of the cross member openings 1042 prevents or minimizes the cross member 1032 from unwanted lateral sliding, keeping the cross member 1032 in position.

In other embodiments, the end caps 1044 may comprise other materials and/or forms so long as they are suitable for keeping the cross member 1032 in position. Such materials and/or forms may include rubber rings, metal rings, metal collars, plastic collars, screws, cotter pins, ring pins, and the like. In other examples, the cross member may have threaded ends so that complimentarily threaded end caps may be screwed on to the cross member ends to secure the cross member in position.

Figure 10D:
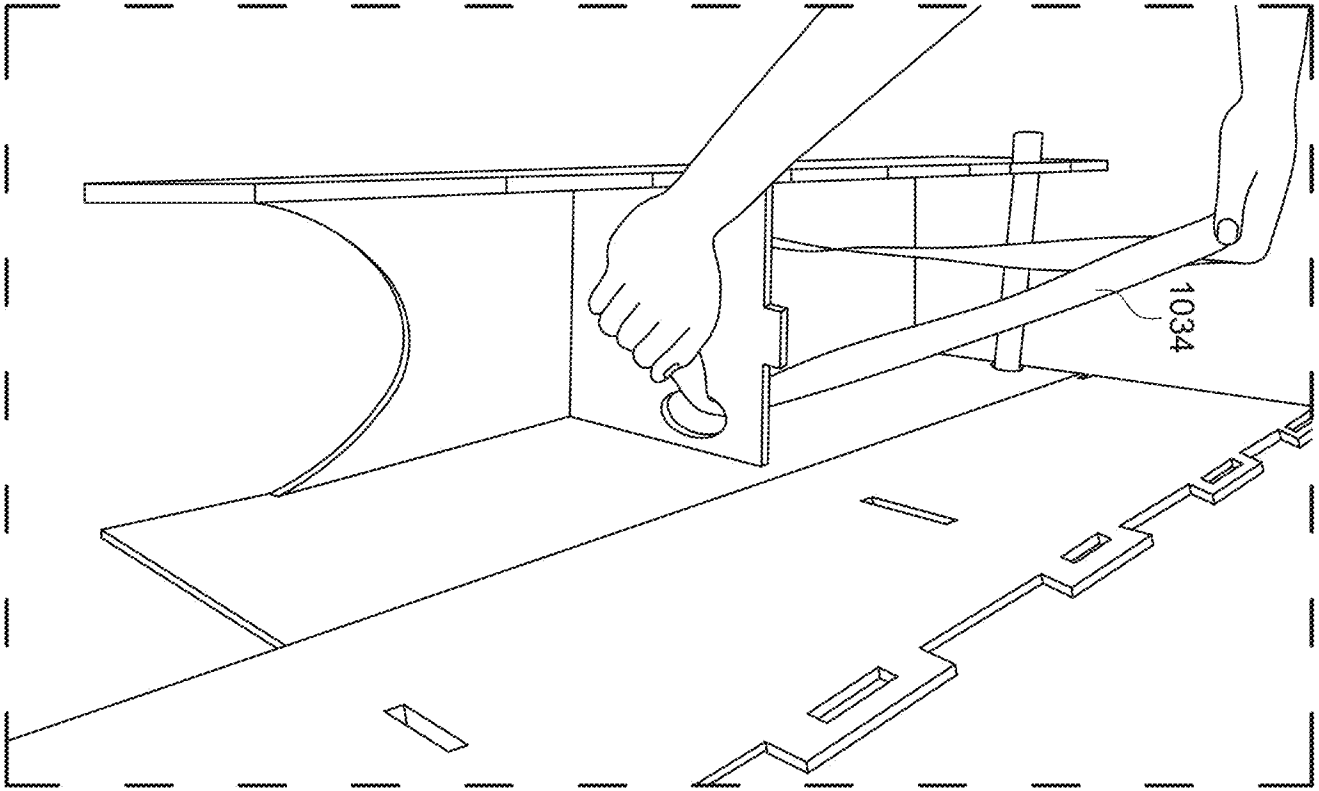
FIG. 10D depicts a dispensing station in the process of being assembled according to an embodiment.

FIG. 10D depicts a top perspective view of a strap 1034 threaded through the two strap guide openings 1042. The ends of the strap 1034 are positioned towards the bottom of the dispenser station assembly while the strap's midpoint is positioned above the container shelf 1013*b*.

Figure 10E:
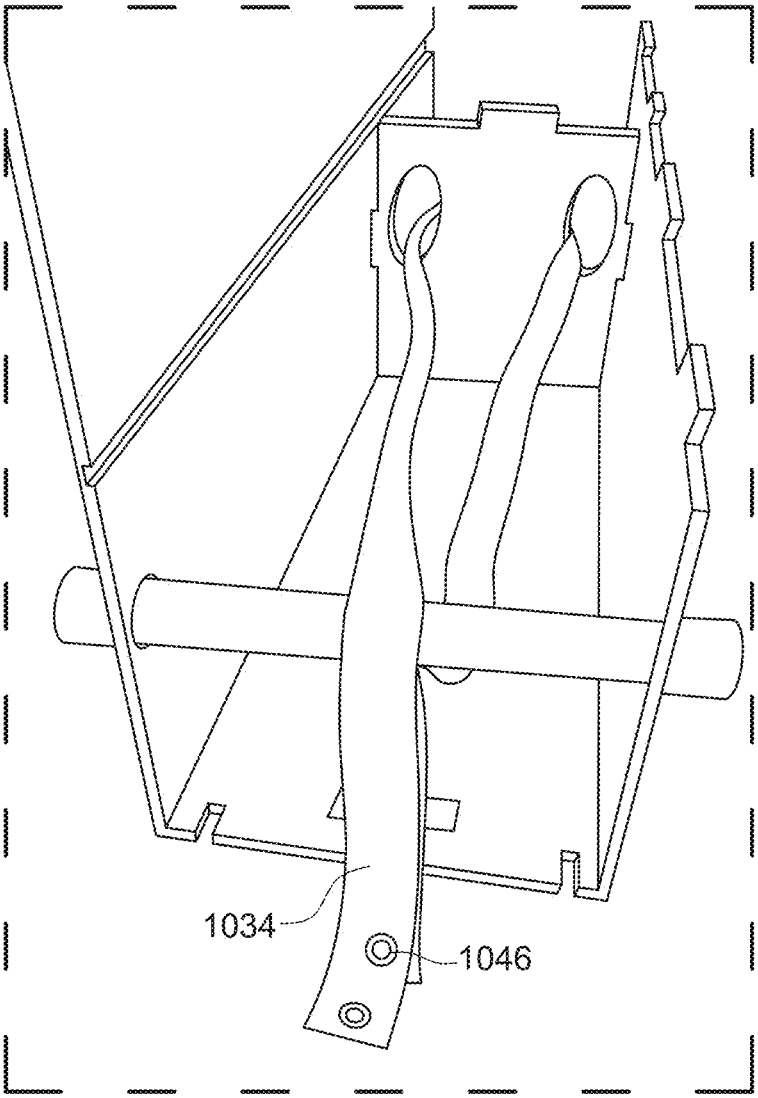
FIG. 10E depicts a dispensing station in the process of being assembled according to an embodiment.

FIG. 10E illustrates a bottom perspective view of a strap 1034 threaded through the two strap guide openings 1042. Each end of the strap 1034 comprises a grommet 1046.

Figure 10F:
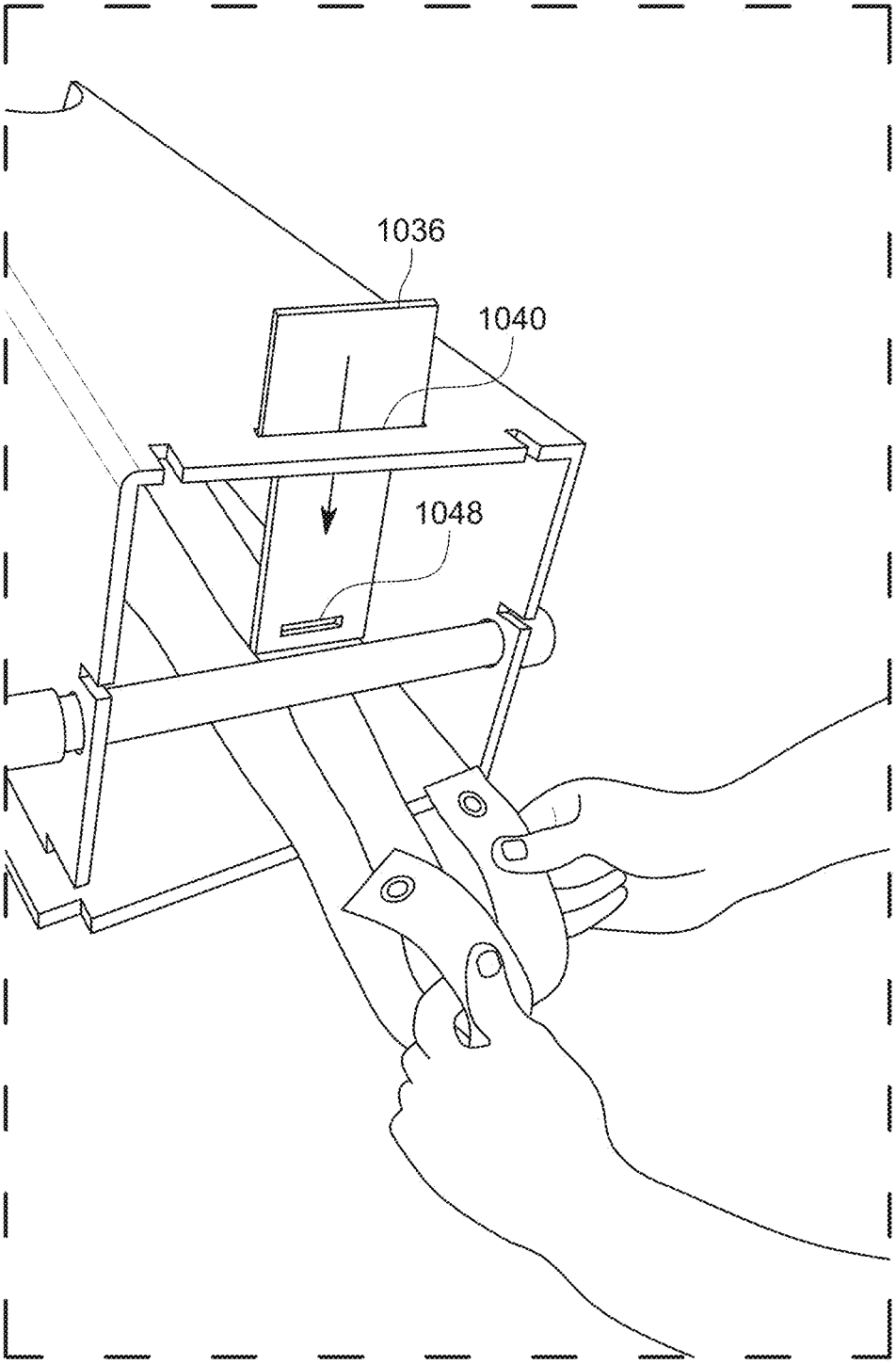
FIG. 10F depicts a dispensing station in the process of being assembled according to an embodiment.

FIG. 10F illustrates the pedal 1036 inserted into a pedal opening—pedal slot 1040. The pedal slot 1040 is positioned near the bottom of the dispensing station assembly, suitable for access by a user's foot. The pedal slot 1040 comprises a width and thickness to allow the two ends of the strap 1034 to simultaneously be threaded through the pedal slot 1040 with minimal gaps between the strap 1034 and the edges of the pedal slot 1040. The entire pedal 1036 is prevented from falling through the pedal slot 1040 due to the footboard portion of pedal 1036 being wider than the opening of pedal slot 1040. An arrow is printed on the pedal 1036 to aid an assembler in inserting the pedal 1036. On the end opposite the footboard is a pedal strap slot 1048.

Figure 10G:
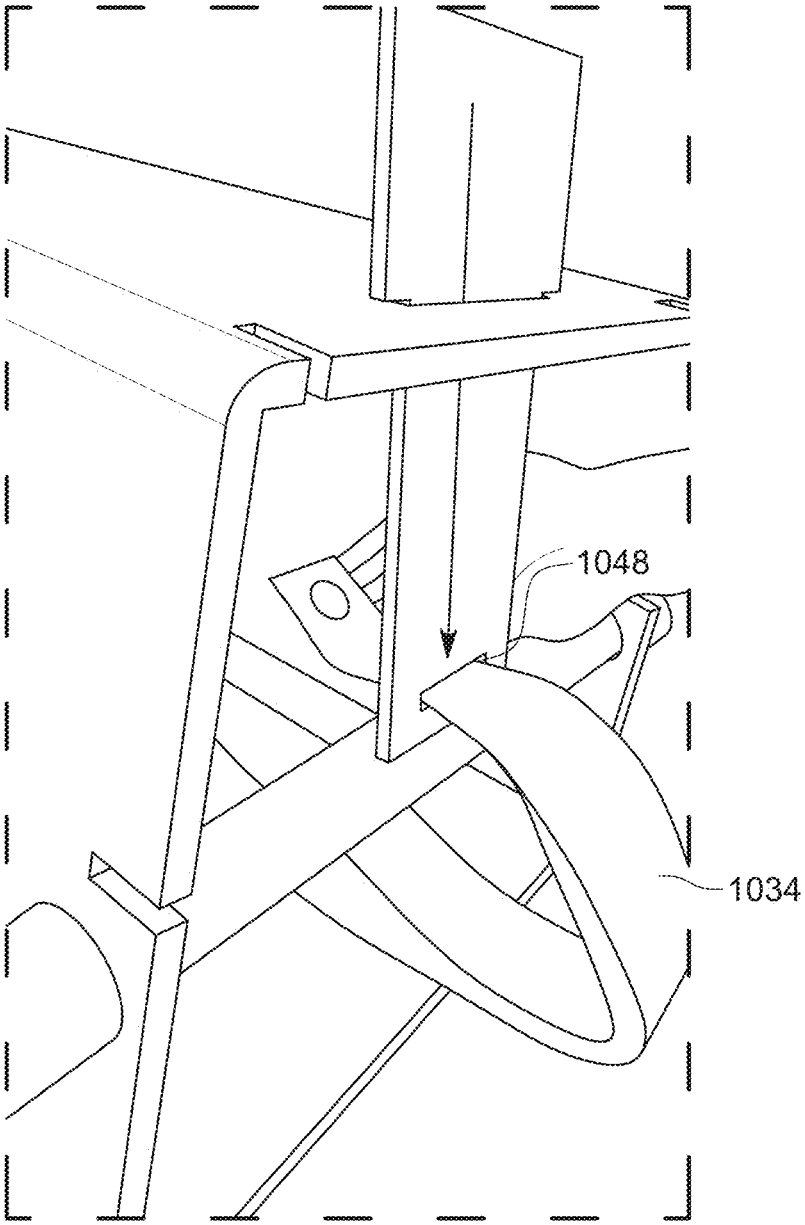
FIG. 10G depicts a dispensing station in the process of being assembled according to an embodiment.

FIG. 10G depicts the strap 1034 as pulled through pedal strap slot 1048. The strap 1034 runs from the container shelf, below and around the cross member, and up through the pedal strap slot 1048.

Figure 10H:
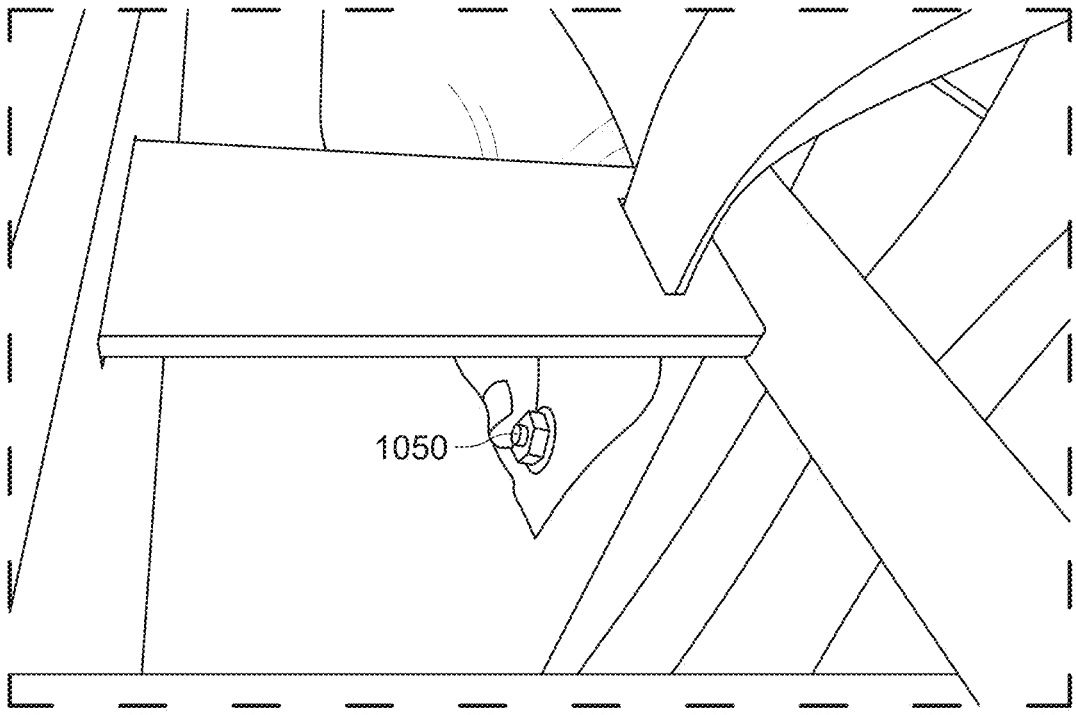
FIG. 10H depicts a dispensing station in the process of being assembled according to an embodiment.

FIG. 10H further shows the installation of a nut or screw inserted through the two grommets 1046 and secured with a bolt, creating a strap anchor 1050. The protrusion of strap anchor 1050 from each side of the bolted together strap ends prevents those strap ends from sliding through the pedal strap slot 1048.

Figure 10I:
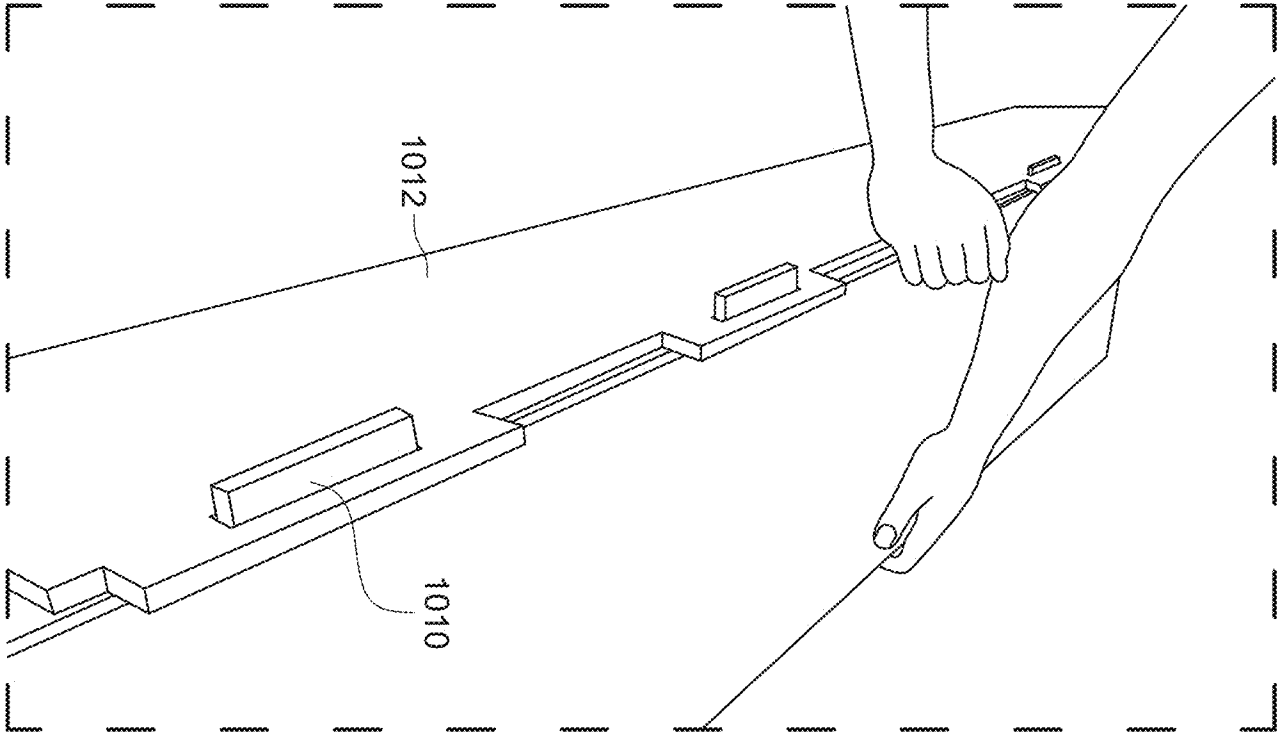
FIG. 10I depicts a dispensing station in the process of being assembled according to an embodiment.

FIG. 10I illustrates the insertion of wall panel tabs 1010 inserted into wall panel slotted tabs 1012, creating an interior enclosure for the dispensing station that has a substantially square footprint.

Figure 10J:
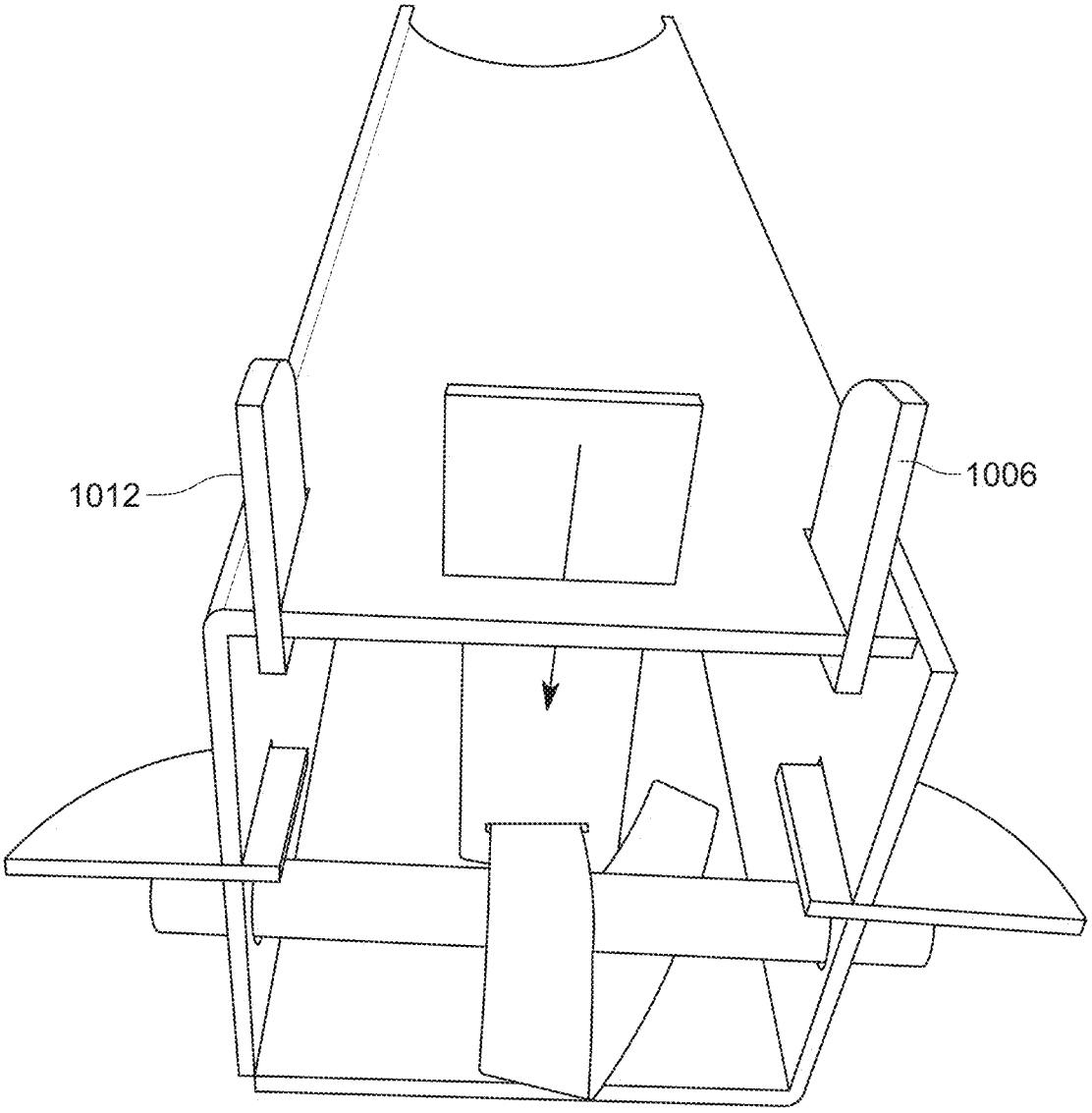
FIG. 10J depicts a dispensing station in the process of being assembled according to an embodiment.

FIG. 10J depicts supporting feet 1006 installed at the bottom of the dispensing station. The front wall panel 1002*a* comprises two supporting feet notches 1028 to receive two supporting feet 1006 at the bottom front of the dispensing station. These two supporting feet 1006 increase the resistance against the dispensing station tipping forward during pedal usage. The strap 1034 is anchored to pedal 1036 and runs underneath the cross member 1032.

Figure 10K:
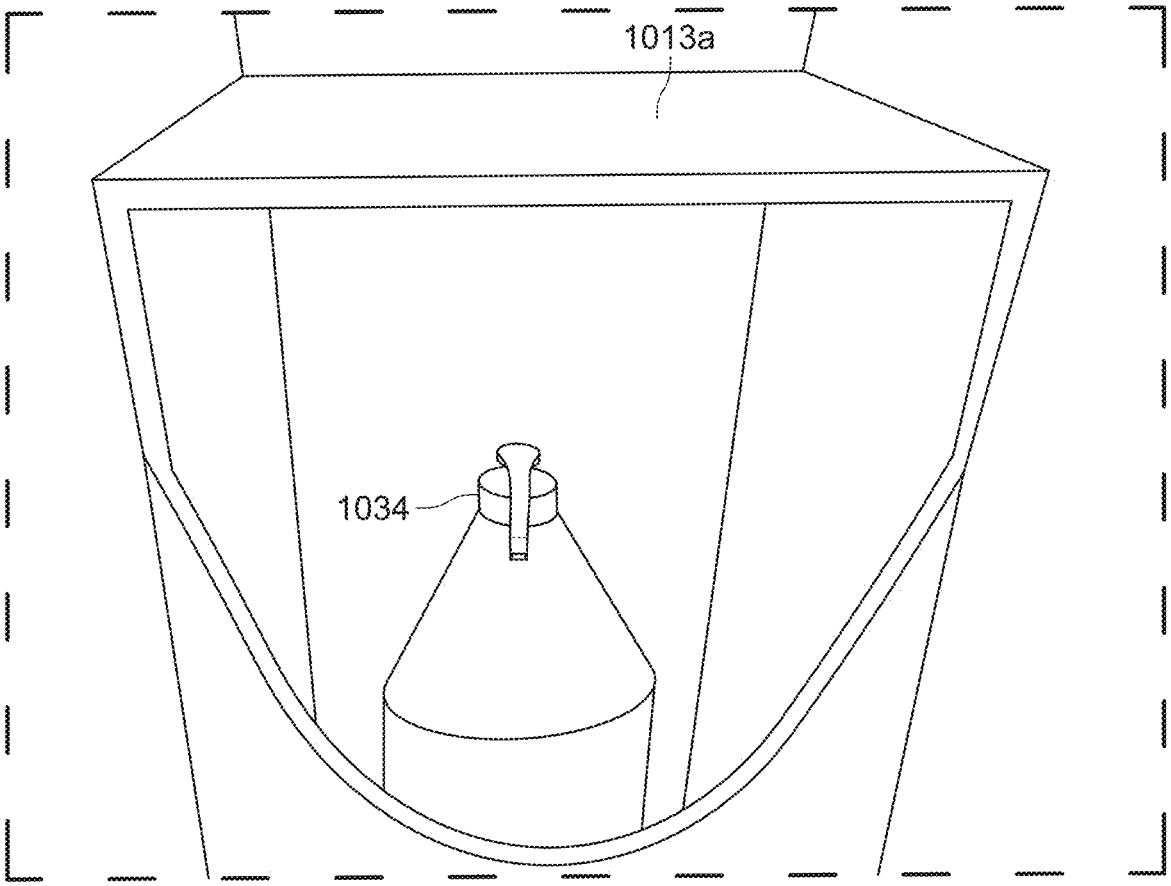
FIG. 10K depicts a dispensing station in the process of being assembled according to an embodiment.
Figure 10L:
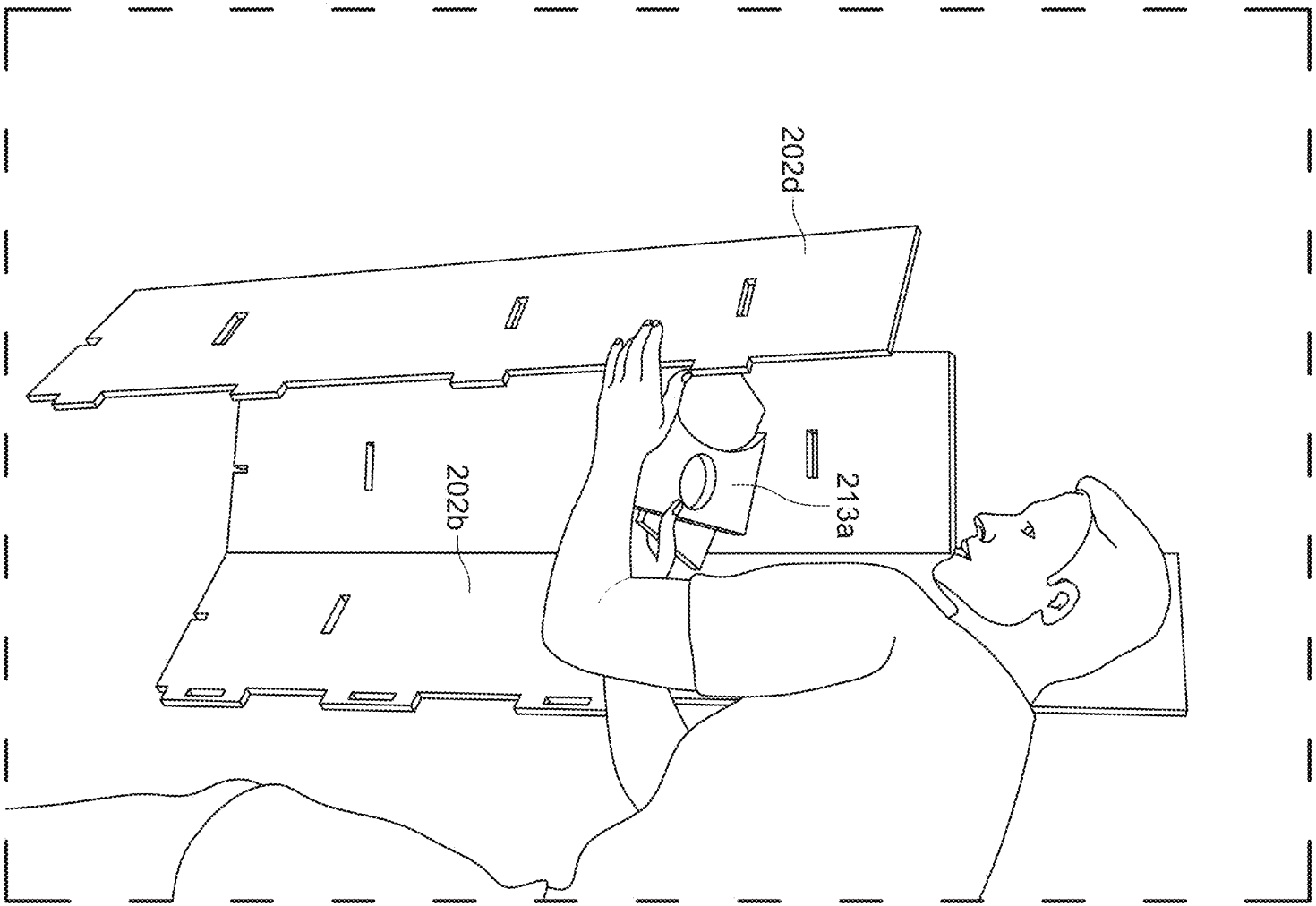

FIG. 10K illustrates the inclusion of a top shelf or shelf cover 1013*a*. The strap 1034 is shown looped over the top of a liquid dispensing pump, which is installed on gallon container of liquid. Out of view, the gallon container rests on the container shelf. The front wall panel 1002*a* comprises a cut out that creates parabolic top edge, which forms an opening for a user to access the hand pump.

In an embodiment, a cross member is positioned on the interior of the assembled station, near the pedal, facing the pedal lengthwise, and at a height equal to or lower than the pedal's pivoting axis, wherein the cross member is configured to allow the strap to moveably wrap underneath the cross member and permit the strap end attached to the head of the liquid dispensing pump to apply a downward force when the pedal is depressed and cause the pump to dispense liquid.

Figure 11A:
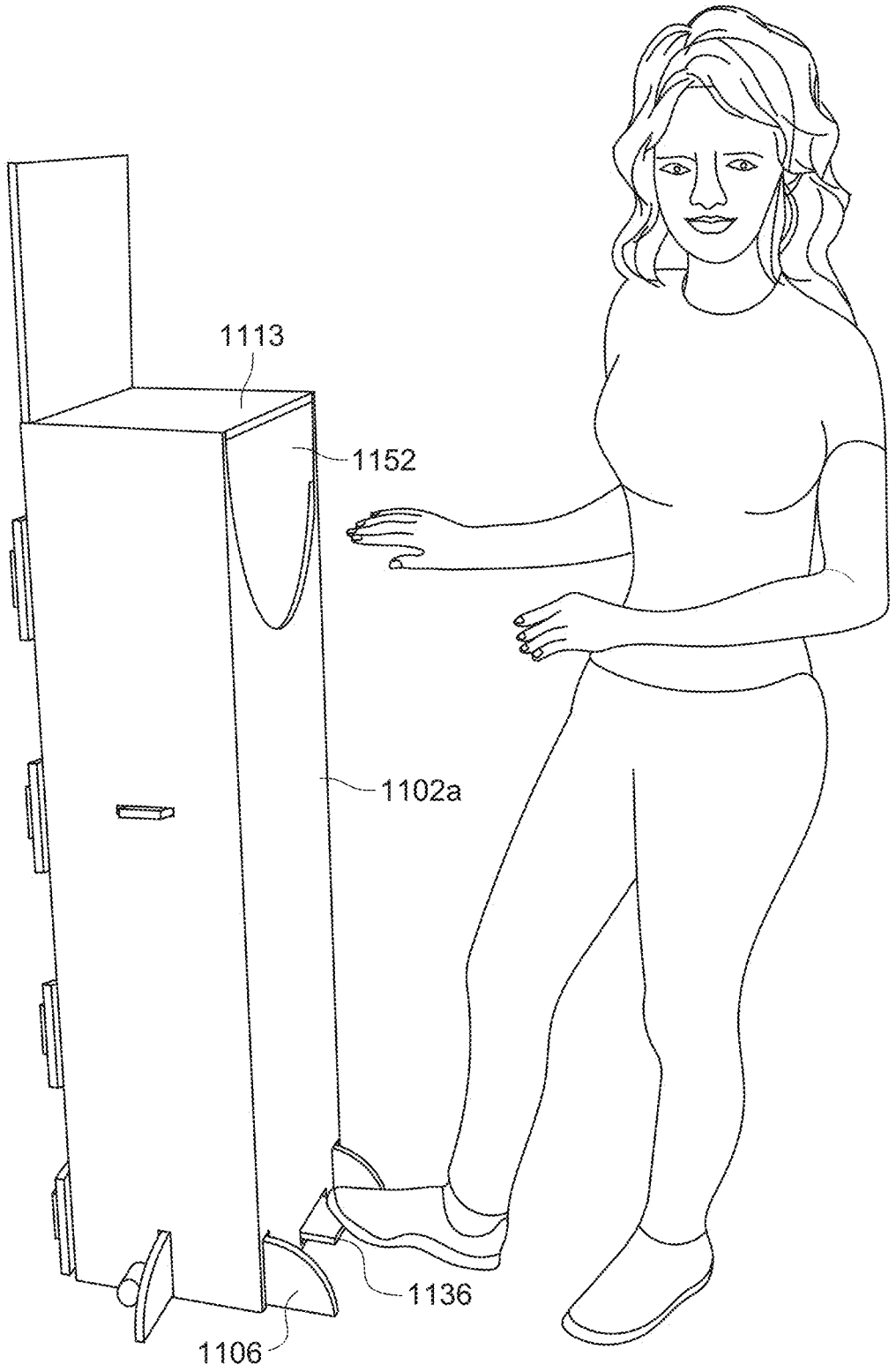
FIG. 11A illustrates a front-left perspective view of a dispensing station according to an embodiment.

FIG. 11A is a depiction of an assembled dispensing station that uses the pressing of a pedal to activate the pump actuator according to an embodiment. Visible elements of the dispensing station in FIG. 11 include wall panels 1102, supporting feet 1106, a shelf 1113, a pedal 1136, and a dispensing opening 1152 formed by the shelf 1113 and the cutout of front wall panel 1102*a*. The cutout of front wall panel 1102*a* is generally a parabolic shape. However, the cutout may comprise many shapes (e.g., square, rectangle, circle, oval) suitable for a user's hand to reach the liquid dispensed from the pump.

Figure 11B:
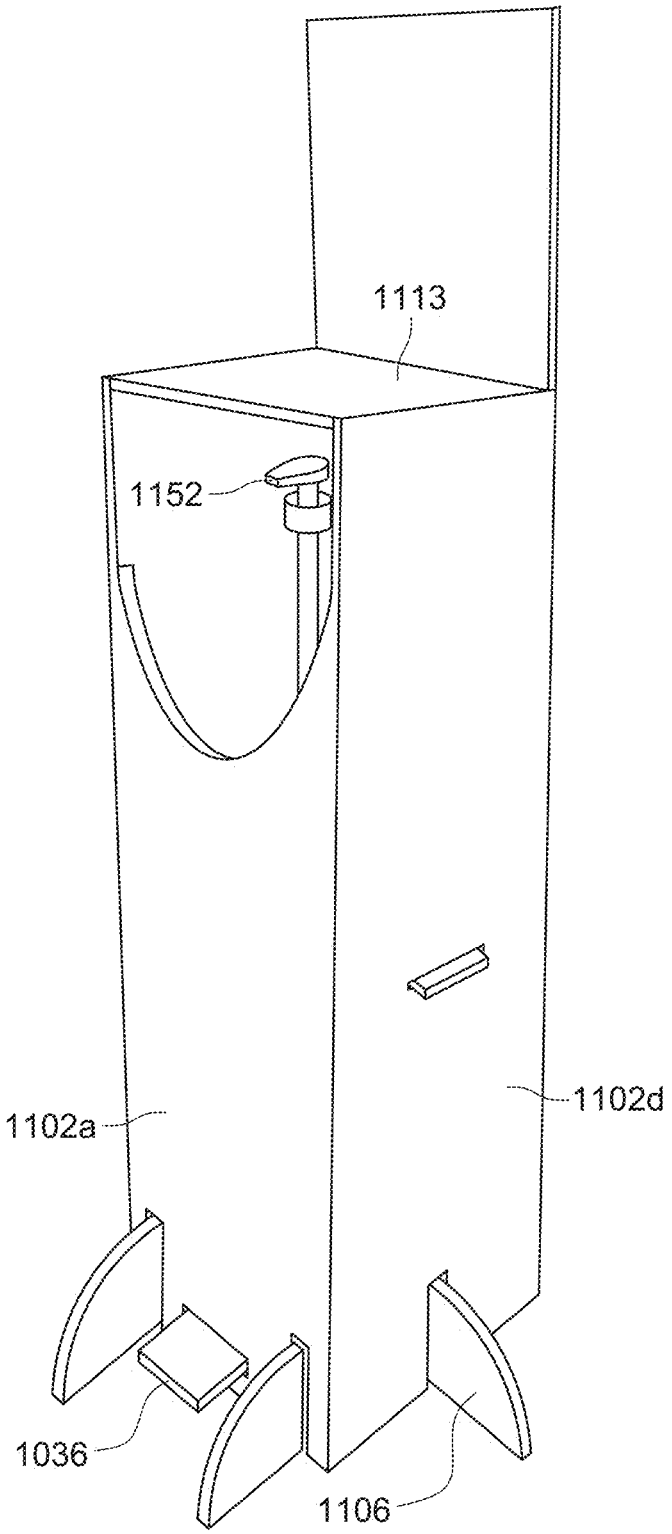
FIG. 11B illustrates a front-right perspective view of a dispensing station according to an embodiment.

FIG. 11B is a depiction of an assembled dispensing station designed for children. The dispensing station in this embodiment uses the pressing of a pedal to activate the pump actuator. Visible elements of the dispensing station in FIG. 11 include wall panels 1102, supporting feet 1106, a shelf 1113, a pedal 1136, and an dispensing opening 1152 formed by the shelf 1113 and the cutout of front wall panel 1102*a*.

Figure 12A:
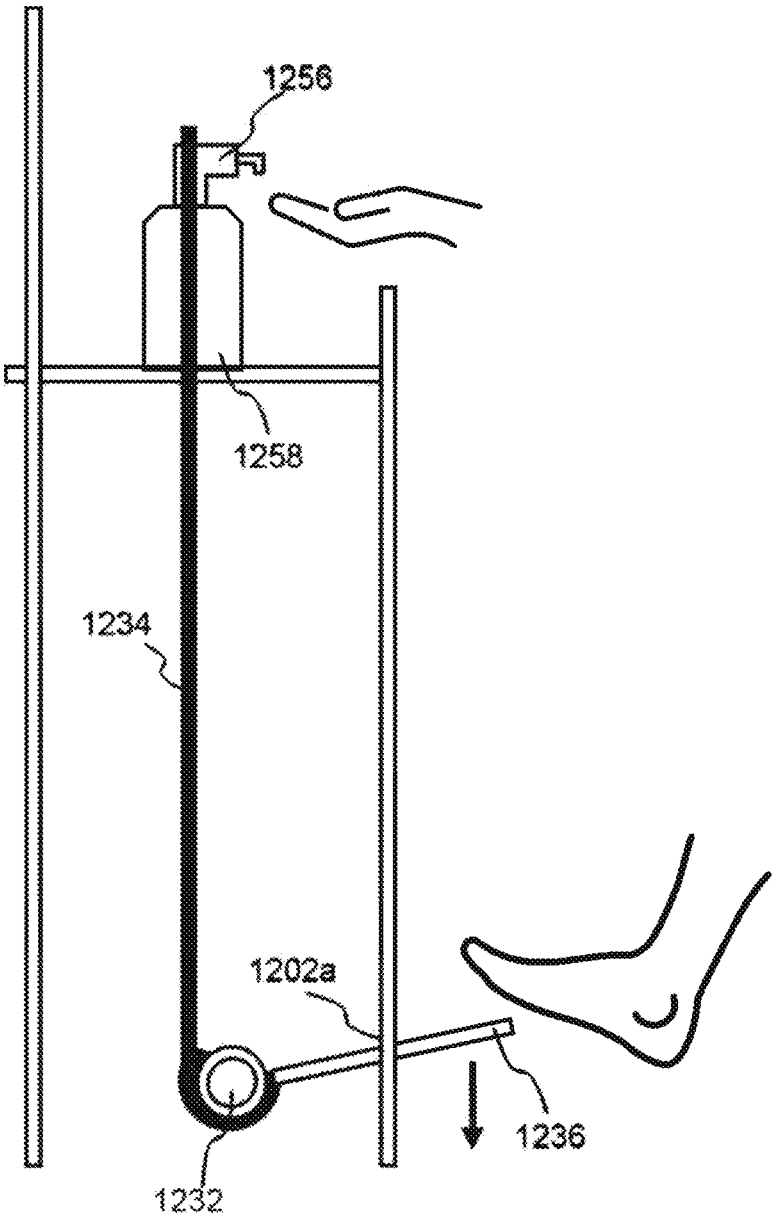
FIG. 12A illustrates a cross-sectional side view of a dispensing station according to an embodiment.

FIG. 12A illustrates an embodiment of the dispenser station from cross-sectional side view. The footbed of the pedal 1236 is located on the exterior of the station while its interior end is attached to a strap 1234 that runs underneath a cross member 1232. The strap is further attached to a liquid dispensing pump 1256 installed on a container of liquid 1258. When the pedal is depressed, the strap exerts a downward force on the pump 1256, dispensing the liquid.

Figure 12B:
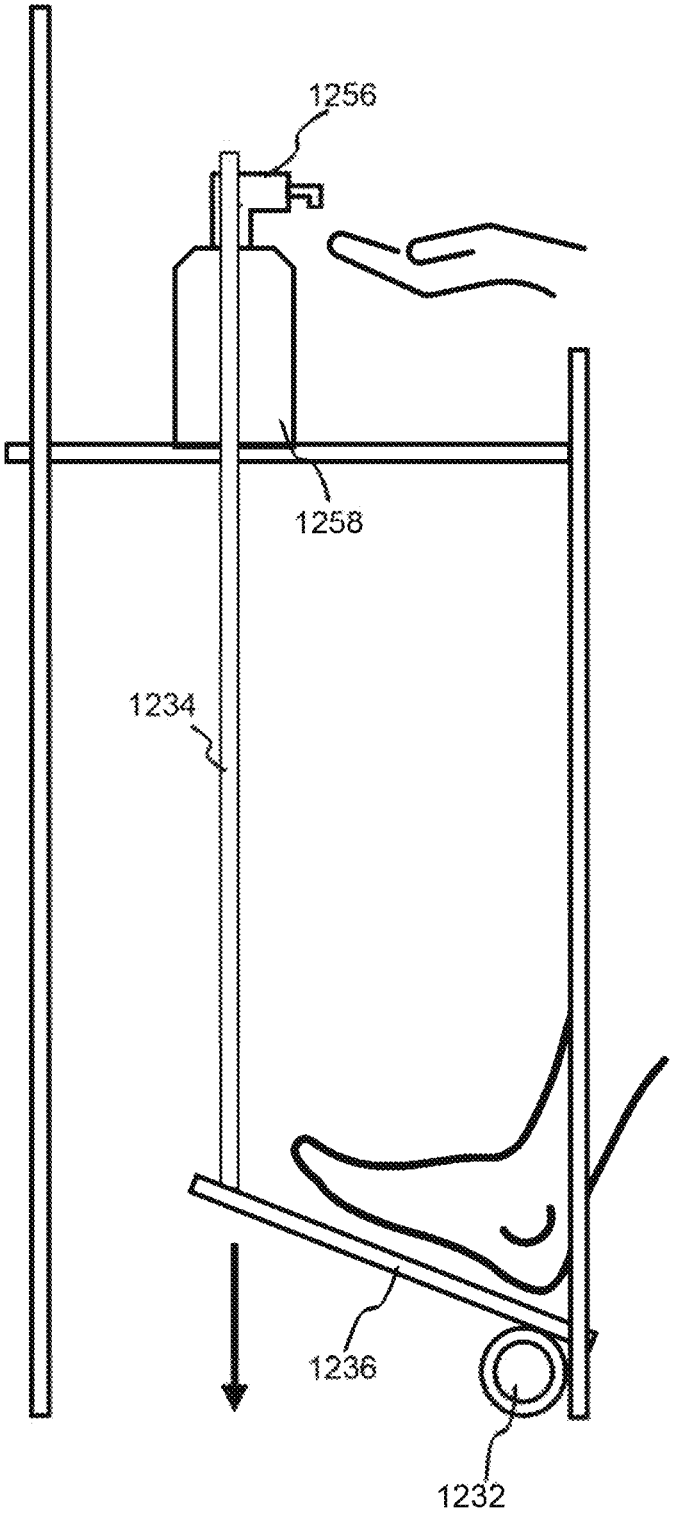
FIG. 12B illustrates a cross-sectional side view of a dispensing station according to an embodiment.

FIG. 12B illustrates another embodiment of the dispenser station from a cross-sectional side view. The entire pedal 1236 comprises the footbed and is pivotally affixed to a cross member 1232 positioned at or near the bottom and at or near the front of the dispensing station, wherein the interior-most end of the pedal is connected to a strap 1234 looped over a liquid dispensing pump 1256 installed on a container of liquid 1258. The container of liquid 1258 is suitably located in the upper center to upper rear interior of the dispensing station so when the pedal is depressed, the strap exerts a primarily downward force on the pump 1256.

Figure 13:
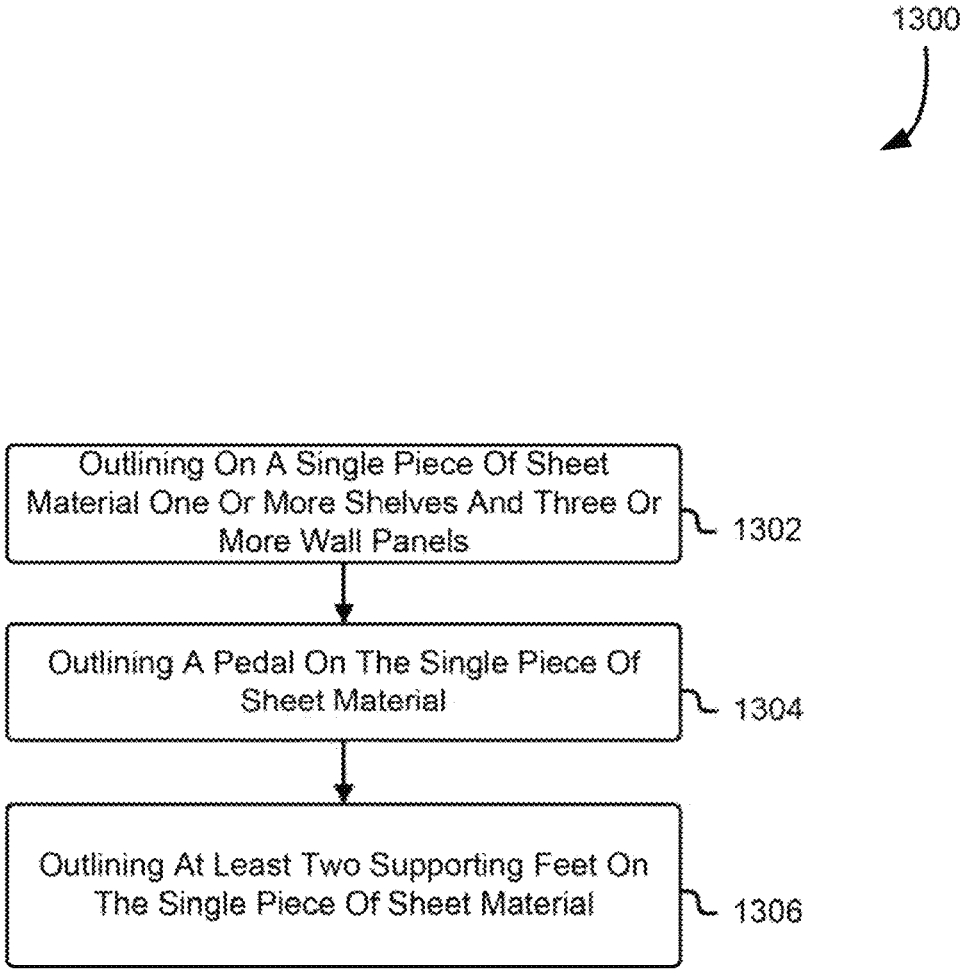
FIG. 13 is a flow chart for a method of creating a dispensing station according to an embodiment.

FIG. 13 describes the a process for creating a flat-packable liquid dispensing station. Step 1302 comprises the outlining on one piece of sheet material one or more shelves, and three or more wall panels. According to an embodiment, the outlining of shelves and wall panels may be done directly upon the single sheet of material. This may be done by any means that creates the outlines on the sheet material (e.g., drawing the outlines with a writing instrument; scoring the outlines on the sheet material using a cutter, knife, or die press; perforating the outlines onto the sheet material; creasing the outlines in the sheet material, imaging the outlines on the sheet material with focused light or lasers). In other embodiments, the outlining steps may be accomplished by creating outlines on material other than the sheet material (e.g., outlining on paper with a writing instrument, forming the outlines within a die set for die stamping, digitizing and storing the outlines onto a computer-readable storage medium, copying the outlines using dispenser station components already cut from the sheet material). Other examples may comprise the step of outlining two or more shelves and/or three or more wall panels to be made from two or more pieces of sheet material. In some embodiments, only two wall panels may be required for a freestanding dispensing station.

The wall panels, if cut or punched out of the sheet material by using the outlines, may be configured to assemble a freestanding station with a footprint no more than 324 square inches, or 0.209 square meters, in area, providing a very compact, lightweight, and flat-packable dispensing station. In other embodiments, the footprint may exceed 324 square inches in area. According to another embodiment, the freestanding station comprises a footprint of approximately 144 square inches, or 0.093 square meters, with each wall panel exhibiting a width or depth of approximately 12 inches, or 0.305 meters. The wall panels, when assembled, further comprise an interior space with at least three sides.

The shelves and the wall panels, if cut or punched out of the sheet material by using the outlines, are configured so that each shelf may be attached to the wall panels and be positioned within the interior of the freestanding station. According to an embodiment, at least one of the shelves is configured to support a container of liquid, (e.g., a gallon bottle of liquid hand sanitizer, a gallon bottle of foaming soap), and be positioned within the interior of the freestanding station at a height suitable for a user to receive by hand a liquid dispensed from the container.

Step 1304 of FIG. 13 comprises the outlining of a pedal on the single piece of sheet material. The pedal outline may further comprise at least one strap opening configured to allow a strap, or two ends of a strap with one on top of the other, to pass or thread through the strap opening. In an embodiment, the wall panel outlines further comprise a pedal opening located in one of the wall panels, the pedal opening being positioned at or near the bottom of that wall panel. If that wall panel's outline were punched out, the pedal may be pivotally inserted into the pedal opening. Further, the shelf configured to support a container of liquid, or container shelf, the wall panels, and the pedal would allow a strap to attach to the pedal, pass through the at least one strap opening and interact with the head of a liquid dispensing pump (e.g., actuator of a pump, handle of a pump) so that when a user depresses the pedal, the strap would exert a force on the head of the pump and dispense a liquid from a container sitting on the container shelf.

Step 1306 shown in FIG. 13 comprises the outlining of at least two supporting feet on the single piece of sheet material. With the use of supporting feet, the outlines for the wall panels may further comprise at least one notch in at least two wall panels, each notch being positioned to be at the bottom of an assembled dispensing station. If cut or punched out, the supporting feet may be inserted into a wall panel notch, with the inserted supporting foot being substantially normal to the broadest plane of the wall panel.

In other embodiments, the outlines of one or more shelves further comprises the outline of at least one pump-passthrough shelf, the pump passthrough shelf outline including at least one opening through which the head of a liquid dispensing pump may pass if the pump passthrough shelf outline were cut or punched out of the sheet material. The pump passthrough shelf may further comprise at least one front edge, with at least a portion of the front edge receding towards the center of the pump-passthrough shelf to provide access to a container of liquid if the pump-passthrough shelf were cut or punched out of the sheet material and positioned over a container of liquid in an assembled freestanding station.

In an embodiment, the outline for the three or more wall panels may further comprise two or more fold lines that delineate the wall panels when the wall panels are cut or punched out, and the cut or punched out wall panels are configured to be folded along the fold lines, wherein the wall panels further comprise substantially rectangular shapes. These fold lines permit the wall panels to fold into a freestanding stationary structure, and by retaining the hingability between the wall panels, additional structural support is achieved when compared to wall panels that are completely separated from each other. The outline for the three or more wall panels may also include cut lines in addition to the fold lines. These cut and fold lines permit the wall panels, by area the largest components of the dispensing station, to be folded into a more compact area for easier handling, packaging, storage, and/or shipping.

In some embodiments, the one or more shelves and two or more wall panels are outlined on a single piece of sheet material or outlined on a representation of the singular piece of the sheet material such as programming a computer software program designed to automate the cutting of sheet material according to the outlines.

In some examples, the outlines for the container shelf and the three or more wall panels are further configured to position the container shelf at a height suitable for a child to receive by hand a liquid dispensed from the container if the container shelf and the wall panels were cut or punched out of the sheet material.

In another example, the outlining of the wall panels further comprise a fourth wall panel, wherein the wall panels comprise a front wall panel, a rear wall panel, and two side wall panels, wherein the front wall panel is configured to be shorter than the rear wall panel when cut or punched out of the sheet material and assembled in a freestanding station and accommodate user access to a liquid dispensing container mounted to the rear wall. The wall panels, when assembled into a dispensing station, may create a footprint that is substantially square.

While the steps of FIG. 13 involve a single sheet of material, in other embodiments, multiple pieces of sheet material may be used for the outlines of the shelves, wall panels, pedal, and supporting feet.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, elements of a given embodiment should not be construed to be applicable to only that example embodiment and therefore elements of one example embodiment can be applicable to other embodiments. Additionally, elements that are specifically shown in example embodiments should be construed to cover embodiments that comprise, consist essentially of, or consist of such elements, or such elements can be explicitly absent from further embodiments. Accordingly, the recitation of an element being present in one example should be construed to support some embodiments where such an element is explicitly absent.

What is claimed is:

1. A method for creating a flat-pack liquid dispensing station comprising:

outlining on a single piece of sheet material one or more shelves, and three or more wall panels, wherein the wall panels are configured to assemble a freestanding station with a footprint no more than 324 square inches in area, the freestanding station further comprising an interior space with at least three sides if the wall panels were cut or punched out of the sheet material, wherein the shelves and wall panels are configured so that each shelf may be attached to the wall panels and be positioned within the interior of the freestanding station if the shelf and wall panels were cut or punched out of the sheet material, wherein at least one shelf is a container shelf configured to support a container of liquid and be positioned within the interior of the freestanding station at a height suitable for a user to receive by hand a liquid dispensed from the container if the container shelf was cut or punched out of the sheet material, wherein one or more of the wall panels comprise an opening through which a cross member may pass to support a strap, and wherein one or more of the wall panels comprise an outline of a pedal opening positioned at or near a bottom of the one or more wall panels when the freestanding station is assembled.

2. The method of claim 1, further comprising the steps of:

outlining a pedal on the single piece of sheet material;

wherein the outline of the container shelf further comprises an outline for at least one opening for the strap;

wherein the pedal is configured to be pivotally inserted into the pedal opening if the pedal and pedal opening were cut or punched out of the sheet material, wherein the at least one opening for the strap is configured to allow the strap to pass through if the container shelf were cut or punched out of the sheet material, and wherein the container shelf, the wall panels, and the pedal are configured, if cut or punched out of the sheet material and assembled into a freestanding station, to allow the strap to attach to the pedal, pass through the at least one opening for the strap and interact with a head of a liquid dispensing pump such that a depression of the pedal would cause the pump to dispense liquid, wherein the head of the liquid dispensing pump is positioned atop a container of liquid and the container of liquid is being supported by the container shelf.

3. The method of claim 1, further comprising the steps of:

outlining at least two supporting feet on the single piece of sheet material, wherein the outline for the three or more wall panels further comprises at least one notch in at least two wall panels, each notch being positioned to be at the bottom of the assembled freestanding station, and wherein each of the at least two supporting feet may be inserted into one of the notches, with the inserted supporting feet being substantially normal to the broadest plane of the wall panel if at least one of the supporting feet and at least one of the wall panels were cut or punched out from the sheet material.

4. The method of claim 1, wherein the outlines of one or more shelves further comprises the outline of at least one pump-passthrough shelf, the pump passthrough shelf outline including at least one opening through which a head of a liquid dispensing pump may pass if the pump passthrough shelf outline were cut or punched out of the sheet material.

5. The method of claim 4, wherein the outline of the pump-passthrough shelf comprises at least one front edge at least a portion of which recedes towards a center of the pump-passthrough shelf to provide access to a container of liquid if the pump-passthrough shelf were cut or punched out of the sheet material and positioned over a container of liquid in the assembled freestanding station.

6. The method of claim 1, wherein the outline for the three or more wall panels further comprise two or more fold lines that delineate the wall panels when the wall panels are cut or punched out, and the cut or punched out wall panels are configured to be folded along the fold lines, wherein the wall panels further comprise substantially rectangular shapes.

7. The method of claim 6, further comprising one or more cut lines wherein the two or more fold lines and one or more cut lines delineate where each wall panel may be folded into smaller sections if the wall panels were cut or punched out of the sheet material.

8. The method of claim 1, wherein the one or more shelves and two or more wall panels are outlined on a single piece of the sheet material or outlined on a representation of the single piece of the sheet material.

9. The method of claim 1, wherein the outlines for the container shelf and the three or more wall panels are further configured to position the container shelf at a height suitable for a child to receive by hand a liquid dispensed from the container if the container shelf and the wall panels were cut or punched out of the sheet material.

10. The method of claim 1, wherein the outlining of at least three wall panels further comprises a fourth wall panel, wherein the wall panels comprise a front wall panel, a rear wall panel, and two side wall panels, wherein the front, wall panel is configured to be shorter than the rear wall panel when cut or punched out of the sheet material and assembled in a freestanding station and accommodate user access to a liquid dispensing container mounted to the rear wall.

11. The method of claim 1, further comprising creating the pedal opening by cutting or punching out a portion of the sheet material according to an outline of the pedal opening on the sheet material.

* * * * *